US009879401B2

(12) United States Patent
Lynch

(10) Patent No.: US 9,879,401 B2
(45) Date of Patent: Jan. 30, 2018

(54) OIL AND GAS WELL AND FIELD INTEGRITY PROTECTION SYSTEM

(71) Applicant: FUTURE ENERGY INNOVATIONS PTY LTD, QLD (AU)

(72) Inventor: Gary Michael Lynch, Qld (AU)

(73) Assignee: FUTURE ENERGY INNOVATIONS PTY LTD, Queensland (AU)

( * ) Notice: Subject to any disclaimer, the term of this patent is extended or adjusted under 35 U.S.C. 154(b) by 0 days.

(21) Appl. No.: 14/977,908

(22) Filed: Dec. 22, 2015

(65) Prior Publication Data

US 2016/0177676 A1 Jun. 23, 2016

(30) Foreign Application Priority Data

Dec. 22, 2014 (AU) ..... 2014905200
May 30, 2015 (AU) ..... 2015202948

(51) Int. Cl.
*E02D 31/08* (2006.01)
*E02D 5/22* (2006.01)
*E21B 41/00* (2006.01)

(52) U.S. Cl.
CPC ..... *E02D 31/08* (2013.01); *E02D 5/226* (2013.01); *E21B 41/0035* (2013.01)

(58) Field of Classification Search
CPC ..... E02D 31/02; E02D 31/08; E02D 31/10
USPC ..... 405/52, 53, 55, 57, 266–267, 128.15, 405/129.35, 129.4, 129.45, 129.5, 129.55, 405/129.6; 166/50; 175/61, 62
See application file for complete search history.

(56) References Cited

U.S. PATENT DOCUMENTS 4,484,423 A * 11/1984 McClure, Jr. ..... E02D 31/08 52/167.1
6,328,113 B1 * 12/2001 Cook ..... E21B 29/10 166/117.6
6,357,968 B1 * 3/2002 Dwyer ..... E02D 3/12 405/128.1
7,032,660 B2 * 4/2006 Vinegar ..... E21B 43/243 166/245
2005/0186030 A1 * 8/2005 Peters ..... B65G 5/005 405/53

FOREIGN PATENT DOCUMENTS

AU 2013224747 B 7/2014
JP 11209998 A * 9/1999
JP 201310821 A * 6/2013
WO 2014/131092 A1 9/2014

* cited by examiner

*Primary Examiner* — Sunil Singh
(74) *Attorney, Agent, or Firm* — Studebaker & Brackett PC

(57) ABSTRACT

The present invention relates in general to a system to protect and monitor production and non-production oil and gas wells. The present invention provides an oil or gas well and field integrity system for a well which passes through at least one subterranean formation containing pressurized formation fluids. The system comprising at least one oil or gas well located within a designated oil or gas field; and at least one bund wall formed within a target zone of the at least one subterranean formation, each bund extending along at least a portion of a perimeter surrounding the oil or gas field or along at least a portion of a section surrounding one or more oil or gas wells within the oil or gas field to assist in maintaining hydrostatic pressure on at least one side of the bund wall within the target zone thereby reducing the possibility of subsidence within the oil or gas field.

20 Claims, 34 Drawing Sheets

OIL AND GAS WELL AND FIELD INTEGRITY PROTECTION SYSTEM

FIELD OF THE INVENTION

The invention relates in general to a system to protect and/or monitor production and non-production oil and/or gas wells. In particular, the present invention relates to a system to protect production and non-production oil and/or gas wells from cracking or fracturing due to ground faults and/or from subsidence caused by dewatering and oil and/or gas removed from reservoirs and coal seams over large unsupported areas by providing a method of structural support and containment around the wells and at the same time monitoring the potential for well leakage into surrounding aquifers and soil.

BACKGROUND OF THE INVENTION

It should be noted that reference to the prior art herein is not to be taken as an acknowledgement that such prior art constitutes common general knowledge in the art.

The Great Artesian Basin (GAB) extends across nearly two million square kilometers covering parts of Queensland, the Northern Territory, South Australia and New South Wales. It comprises 22 percent of the land in Australia. Due to a quirk of geology, the water held in the sponge-like rocks underground is under pressure. This means that when a bore is sunk, farmers often do not need a pump to bring water to the surface—it flows naturally. Like the Great Artesian Basin other countries have similar geological underground water reserves which provide substantial water supplies. The present invention is applicable to all countries having underground water reserves and unstable ground structures subject to subsidence.

Groundwater resources in the GAB and Bowen Basin support an extensive pastoral industry, inland population centres, mining activities, and other industries. There are many resources present in the basins—water, gas, oil and geothermal energy—and demand for these resources is increasing. As it is, the water is squashed between thick layers of sandstone into an interlinked network of aquifers. It "flows" through pores in the rock at the glacial pace of a few meters per year.

Beneath the layers of water lie some of the world's most extensive coal seams. Just as the sandstone aquifers contain water, so the coal seams contain methane dissolved in water. This methane or coal seam gas (CSG) is a form of natural gas that is extracted from the underground coal seams.

Protecting the water wealth of the GAB has created problems for the oil and coal seam gas industry. One of the most common activities causing subsidence is related to the withdrawal of ground fluids such as geothermal water or steam, ground water, and oil and gas. Each of these has the potential to cause maximum subsidence of the same order of magnitude to cause well integrity failure.

CSG or CBM (coal bed methane as it is termed in the United States of America) is trapped by groundwater pressure in the coal bed. CSG extraction occurs by drilling into the coal seam and lowering the groundwater pressure by pumping. Extracted coal seam waters are contaminated with brines and other compounds liberated from shale or coal seams during the drilling or fracking (back-flow) process. The latter often includes natural and induced petroleum compounds along with a certain amount of radionuclides (particularly radium) which has decayed from Uranium over millions of years. Various studies have shown these radiation levels to be highly elevated from the levels that would be acceptable under normal circumstances.

Other radioactive contaminants have included Thorium, Polonium, Radon gas, and some rarer daughter products. Once these radioactive contaminants reach the surface or underlying aquifers they create issues that would not exist if it had been possible to keep them deep underground.

With the increase in the importance, and hence value, of natural and CSG gas, gas leaks have become a very significant public issue. For environmental and other commercial reasons it is therefore desirable to find an affordable and safe way to control the migration of gas to the surface and underlying aquifers, even in wells that are no longer producing on a commercial scale.

Previous attempts by the gas production industry to address the problem have concentrated on variations of one-piece solutions. For example, concreting around the wellhead, attempting to reseal the annular gap around the damaged well stem casing, with Portland cement (the required minimum annular coating thickness around the well stem casing is only 13 mm thick (½ inch thick).

Accidents in the CSG industry are particularly dangerous, for many of the possible (in some cases inevitable) disastrous outcomes are such that they cannot be undone and hence cannot be remediated. Greenhouse gases and well fluids once released from the well stem whether on the surface or underground are unable to be recalled. Likewise the aquifers and soil once contaminated with gases and well fluids (including toxic salts) are rendered damaged beyond repair, and of little use or value for cropping irrigation or for animal and human consumption. Consequent serious human health impacts can have life-long and possible inter-generational repercussions.

It is therefore highly desirable for the protection of the environment that oil and gas well integrity is maintained and the potential for underground well leakage is kept to a minimum due to subsidence.

A major problem with the drilling and production of CSG is that of subsidence. One of the most common activities causing subsidence is related to the withdrawal of ground fluids such as geothermal water or steam, ground water, and oil and gas. Each of these has caused maximum subsidence of the ground or surface areas around oil and gas wells.

Subsidence around the well stem due to intersecting fault lines, either naturally occurring or induced by the collapse of the cap rock above or below the target coal seam area, caused by the compaction of the coal, induced when dewatering occurs, thus leaving an unsupported gap above the targeted coal bed.

The present system overcomes one or more of the above problems by providing a system of cement/concrete support columns and Bund walls, around the production well thereby significantly mitigating damage to environmental, social and personal safety risks bearing in mind that effective remediation options are limited just to re-pressurisation of the coal bed with water.

SUMMARY OF THE INVENTION

The present invention provides a system to stabilise the area surrounding drilled wells so as to preventively minimise the effects of subsidence around the production well base and well bore casing.

In accordance with a first aspect, the present invention provides an oil or gas well and field integrity system which passes through at least one subterranean formation containing pressurised formation fluids, said system comprising: a geographic survey to produce detailed images of the at least one subterranean formation including rock formation and aquifer locations beneath the Earth's surface; at least one oil or gas well located within the oil or gas field; and a plurality of stabilising columns located around and/or spaced from the oil or gas well, the location and required number of stabilising columns is determined using the geographic survey results, wherein the stabilising columns are utilised to reinforce the at least one oil or gas well and reduce the possibility of subsidence within and around the oil or gas field.

Preferably, the geographic survey may be a seismic or aeromagnetic survey. Preferably, the integrity system may further comprise at least one monitoring well located a pre-determined distance from the at least one oil or gas well, wherein the monitoring well is drilled and a core sample is taken from the monitoring well for analysis and for determining a layout and placement of the stabilising columns in conjunction with the geographic surveys.

Preferably, the plurality of stabilising columns may be located in any one or more of the following locations: a) adjacent to the at least one oil or gas well; b) adjacent to the at least one monitoring well; c) at corners of a polygonal shaped figure spaced around and a pre-determined distance from the at least one oil or gas well; d) around a perimeter forming a boundary around the oil or gas field; and e) around a perimeter forming a boundary around a section of the oil or gas field.

Preferably, the integrity system may further comprise a monitoring system located within the at least one monitoring well to determine ground water contaminant characteristics which are caused by leaking gas, oil or other chemicals from and around the at least one oil or gas well, the monitoring system comprising:

a well module with at least one probe and at least one sensor that senses ground water or aquifers and gas contaminant characteristics, a transmitter for transmitting signals concerning ground water, aquifer and gas contaminant characteristics to a remote monitoring station; and a global positioning system that enables an accurate determination of a location of the well in the oil or gas field.

Preferably, the monitoring system may be a continuous real-time system adapted to monitor the quality of the soil and ground water around the at least one oil or gas well. The at least one monitoring well comprises: a bore well having a casing with a cement seal located in targeted oil or gas zones along with any intermediate oil or gas zones detected in the well to seal or isolate the oil or gas zones from the monitoring well, and a plurality of perforations located in the walls of the well casing for accessing the targeted aquifers. The casing may be constructed from any one of plastic, fibreglass, steel, stainless steel or other material deemed to be suitable.

Preferably, the at least one sensor may comprise at least one of an in-situ sensor, vapour sensor, chemical sensor, fibre optics sensor, solid-state sensor, metal oxide sensor, a radar reflector and electrochemical sensor, and combinations thereof. Alternatively, the integrity system may further comprise a plurality of sensors to determine a plurality of fluid characteristics.

Preferably, the at least one monitoring well may further comprise a movable sampling pump to be movable from each aquifer zone with an inflatable sealing collar extending above and below the intake of the sampling pump, so that sampling will occur at that aquifer zone. Alternatively, the at least one monitoring well may further comprise at least one fixed monitoring sampling pump with an inflatable sealing collar extending above and below the intake of the sampling pump, each fixed sampling pump located within an aquifer zone such that sampling will occur at each aquifer zone.

Preferably, the pre-determined distance from the at least one oil or gas well may be approximately 5 meters or more.

Preferably, additional stabilising columns may be located in a pattern around the at least one oil or gas well or at other locations within the oil or gas field, the location of the additional stabilising columns is determined by analysis of the seismic survey, the aeromagnetic survey and/or the core test from the monitoring well hole, the at least one monitoring well being drilled down into the rock below a target coal seam zone or oil production zone.

Preferably, each one of the stabilising columns may be located around the at least one oil or gas well in holes in the subterranean formation by using any one of coil tubing, fast tube drilling, a steerable drill bit or conventional drilling methods to bore the holes. Alternatively, when the stabilising columns are located adjacent to the at least one oil or gas well or the at least one monitoring well, the stabilising columns may be installed using the same bore or wellbore as the oil or gas well or monitoring well and at the same time as the respective well is constructed. When the stabilising columns are installed using the same bore or wellbore as the oil or gas well or monitoring well and at the same time as the respective well is constructed and installed using a directional drill bit or rig.

Preferably, a drilling mud or water with commercial additives may be used to aid the drilling of the bore holes into the subterranean formation. The commercial additive may be a density additive potassium chloride (KCl) used to aid the drilling of the bore holes into the subterranean formation.

Preferably, the stabilising columns may be formed from a structural compound. The structural compound may be Portland cement or a reinforced Portland cement. The stabilising column may be formed with nanoparticles or carbon nanotubes additives for reinforcement. The stabilising column may be further formed with a latex additive for additional flexibility. Further reinforcement can be achieved using fibres comprising steel, titanium, fibreglass or any other conventional or unconventional reinforcing fibre.

Preferably, the stabilising column may further comprise at least one high tensile reinforcing cable installed and running coaxially along the stabilising column. The high tensile reinforcing cable may be a high tensile steel cable. The high tensile cable may be installed inside the stabilising column using a sacrificial polypipe with the high tensile cable adapted to be mounted on the outside of the polypipe using cable ties or the like.

Preferably, the stabilising column bore holes may be drilled through the target oil or gas zone and into the underlying base cap rock of the target oil or gas zone so as to reinforce the base and anchor the stabilising column. The hole bored in the underlying base cap rock may be drilled or keyed into the base cap rock to provide for underpinning of the stabilising column. The drilled bore holes for the stabilising columns may be fracked with water and proppants to enhance the column strength by opening up any fractures that will radiate out from the drilled diameter of the bore, thus effectively increasing final column strength and effective diameter when the stabilising column is filled with cement.

Preferably, the stabilising column may further comprise a locating calibrated resistance wire installed inside the stabilising column to establish where a future break or fracture of the stabilising column has occurred due to target zone subsidence.

Preferably, the stabilising columns and/or the at least one monitoring well and/or the at least one oil or gas production well may further comprise a hollow tube inserted into and running coaxially along the length of the column or well for accommodating a radioactive tracer logging system. The radioactive tracer logging system may comprise at least one tool passing through the hollow tube and used to fire radioactive Cesium slug tracers into the walls of the stabilising columns and/or the at least one monitoring well and or the at least one oil or gas production well, and at least one gamma ray detector with circuitry to amplify and transmit the detector counts to the surface, for recording and/or further transmission to a remote recording station.

Preferably, the bore hole in the at least one target oil or gas zone may be increased in diameter by undercutting, which will increase the effective support strength of the stabilising column when the stabilising column is filled with the structural compound.

Preferably, the integrity system may comprise two or more monitoring wells located around the at least one oil or gas well and located a pre-determined distance from the at least one oil or gas well. The two or more monitoring wells may be positioned with at least one monitoring well on the low side of the at least one oil or gas well and at least one monitoring well on the high side of the at least one oil or gas well, so that monitoring of any well leakage of gases or fluid pollutants into the surrounding ground water can be detected.

Preferably, the at least one oil or gas well may further comprise a down bore wire logging system adapted to detect gas infusion into the aquifer along with well water contamination water from the dewatering of the target oil or gas zone.

Preferably, the stabilising columns may further comprise two types of column, a first column which extends into the target gas zone and a second column which extends into a base cap rock.

Preferably, the at least one oil or gas production well, the plurality of stabilising columns and the at least one monitoring well may comprise at least one vertically drilled well and column and at least one horizontally drilled well and column. The stabilising columns may be drilled vertically through the subterranean formation and drilled horizontally to allow the stabilising column to pass into the target oil or gas zone, the stabilising column being drilled and fracked to open up any cracks in the subterranean structure prior to being filled with the structural compound.

Preferably, the at least one vertically and horizontally drilled stabilising columns may be utilised around a perimeter forming a boundary around the oil or gas field and/or around a perimeter forming a boundary around a section of the oil or gas field, the columns forming a bund around the perimeter.

Preferably, the plurality of stabilising columns may comprise at least one vertically drilled column; and at least two horizontally drilled columns separated by an angle of approximately 90 degrees between each horizontally drilled column; or at least two horizontally drilled columns separated by an angle of approximately 180 degrees between each horizontally drilled column.

Preferably, the well and field integrity protection system may further comprise a surface wellhead leak detection and collection system comprising: at least one perforated or slotted collection pipe adapted to be placed adjacent to a wellhead and having holes sized to allow the transmission of liquid and gas into the collection pipe, wherein the liquid and gas are leaking from and around the wellhead conductive pipe and the wellhead; a flexible cover, covering at least the adjacent areas around the wellhead and the at least one perforated or slotted collection pipe; and a fluid detector in fluid communication with the at least one perforated or slotted collection pipe.

Preferably, at least one stabilising column may be located at each corner of the surface well head leak detection and collection system, and additional stabilising columns are located at positions identified as required from the seismic survey, the aeromagnetic survey and/or the core sample test taken from the monitoring well or wells.

In accordance with a further aspect, the present invention provides a method of protecting the integrity of an oil or gas well and field which passes through at least one subterranean formation containing pressurized formation fluids, said method comprising the steps of: utilising a seismic survey or an aeromagnetic survey of the underlying subterranean formation to determine the placement of stabilisation columns; drilling bore holes for the stabilising columns; locating a sensor cable within the drilled bore hole; filling the stabilising bore holes with a structural compound; and drilling the oil or gas production well(s) to completion.

Preferably, the method may further comprise the steps of: positioning and drilling at least one monitoring well on the low side of the oil or gas well, the monitoring well being drilled down into and below a target oil or coal seam zone; testing and developing test points within the monitoring well bore to identify potential pollution contamination; and analysing a core test taken from the monitoring well bore to determine the placement of stabilisation columns around the oil or gas well and field.

Preferably, the method of protecting the integrity of an oil or gas well and field may comprise any one of the features of the previous aspect.

Preferably the method may further comprise the step of cleaning the drilled stabilisation bore holes by flushing with water to remove any contaminated drilling mud and salts from the walls and crevices in the walls of the bore hole.

Preferably, the method may further comprise fracking the drilled bore holes with water and proppants to enhance the stabilising column strength by opening up any fractures that radiate out from the drilled diameter of the bore, thus effectively increasing the final column strength and effective support radius when pressure filled with a reinforced structural compound. Concrete stabilisation of the stabilising columns may be achieved by filling the columns from the bottom so as to remove any air or water accumulated from the opened aquifers by pushing out the air or water whilst the concrete is poured cumulatively from the base of the bore hole. Preferably, the method may further comprise the step of reinforcing the oil or gas production well stem with a structural compound.

In accordance with a still further aspect, the present invention provides an oil or gas well and field integrity system which passes through at least one subterranean formation containing pressurised formation fluids, said system comprising: a seismic survey to produce detailed images of the at least one subterranean formation including rock formation and aquifer locations beneath the Earth's surface and/or an aeromagnetic survey; at least one oil or gas production well; and a plurality of horizontal and vertical stabilising columns located around and spaced from the at least one oil or gas well, the location and required number of stabilising columns is determined using the seismic survey results and/or the aeromagnetic survey results.

In accordance with a still further aspect, the present invention provides an oil or gas well and field integrity system which passes through at least one subterranean formation containing pressurised formation fluids, said system comprising: at least one oil or gas production well; a geographic survey to produce detailed images of the at least one subterranean formation including rock formation and aquifer locations beneath the Earth's surface; at least one monitoring well located a pre-determined distance from the at least one oil or gas well, wherein the monitoring well is drilled and a core sample is taken from the monitoring well for analysis and for determining a detailed structure of the at least one subterranean formation in conjunction with the geographical survey; and a plurality of horizontal and vertical stabilising columns located around and spaced from the at least one monitoring well and/or the at least one oil or gas production well, the location and required number of stabilising columns is determined using the geographical survey and/or the core sample taken from the monitoring well.

Preferably, the plurality of horizontal and vertical stabilising columns may form a perimeter bund wall around an oil or gas field or a section of an oil or gas field. Alternatively, the plurality of horizontal and vertical stabilising columns may form at least one horizontal bund wall located within or externally of the perimeter bund wall. Preferably, the vertical and horizontal stabilising columns may be first drilled using a directional drill bit or rig and the drilled bore holes are flushed with water and a commercial additive, the bore holes are then fracked and proppants inserted within the cracks opened up by the fracking, and finally the bore holes are pressured filled with a structural compound and a reinforcing material.

In accordance with a still further aspect, the present invention provides an oil or gas well and field integrity system which passes through at least one subterranean formation containing pressurised formation fluids, said system comprising: at least one oil or gas production well; at least one monitoring well; a plurality of horizontal and vertical stabilising columns forming a bund around a perimeter or section of an oil or gas field and within a target oil or gas seam, the bund located around and forming and spaced from the at least one monitoring well and/or the at least one oil or gas production well, the location and required number of stabilising columns is determined using the geographical survey and/or the core sample taken from the monitoring well; and at least one injection well located externally of the bund wall to maintain hydrostatic fluid pressure of a surrounding coal seam to prevent dewatering and avoid subsidence due to compaction around the oil or gas field.

In accordance with a further aspect, the invention may broadly be said to consist of an oil or gas well and field integrity system which passes through at least one subterranean formation containing pressurised formation fluids, said system comprising:

at least one oil or gas well located within a designated oil or gas field; and at least one bund wall formed within a target zone of the at least one subterranean formation, each bund extending along at least a portion of a perimeter surrounding the oil or gas field or along at least a portion of a section surrounding one or more oil or gas wells within the oil or gas field to assist in maintaining hydrostatic pressure on at least one side of the bund wall within the target zone thereby reducing the possibility of subsidence within the oil or gas field.

Preferably each bund wall assists in maintaining a relatively higher hydrostatic pressure on a side of the bund wall most distal from the associated oil or gas field and/or from the associated oil or gas well(s).

Preferably the at least one of the bund walls extends around the oil or gas field to thereby substantially enclose the oil or gas field along the target zone and assist in maintaining hydrostatic pressure in a region external to the bund wall and enclosed oil or gas field.

Preferably at least one of the bund walls extends about a section of the oil or gas field to thereby substantially enclose one or more oil or gas wells within the oil or gas field and assist in maintaining hydrostatic pressure in a region external to the bund wall and enclosed section.

Preferably at least one of the bund walls is a bund wall open at either end and extending adjacent one or more oil or gas wells within the oil or gas field to reinforce and reduce the possibility of collapse of the oil or gas field or a section of the oil or gas field and to enhance cap rock support to minimise subsidence.

Preferably the at least one open ended bund wall is formed in a location at or adjacent a fault zone of the at least one subterranean formation.

Preferably at least one bund wall extending about the perimeter of the oil or gas field and a plurality of open ended bund walls located intermittently throughout the oil or gas field within and/or outside the at least one bund wall extending about the perimeter.

Preferably the system further comprises at least one substantially vertical bore hole and at least one substantially horizontal bore hole associated therewith and extending through the target zone, and wherein each bund is formed using an associated substantially horizontal bore hole by fracturing the target zone along at least a section of the horizontal bore hole and filling the fractured regions of the oil or gas seam with a structural compound.

Preferably at least a plurality of substantially vertical bore holes are distributed about at least a portion of a perimeter surrounding the oil or gas field or along at least a portion of a section surrounding one or more oil or gas wells within the oil or gas field, and have extending therebetween one or more substantially horizontal bore holes.

In one embodiment one or more of the at least one substantially vertical bore hole is filled with a structural compound to form a substantially vertical stabilisation column to reinforce the at least one oil or gas well and reduce the possibility of subsidence within and/or around the oil or gas field.

In the same or in an alternative embodiment one or more of the at least one substantially vertical bore holes is utilised to form a monitoring well for monitoring and/or analysing the state and/or composition of the at least one aquifer of the at least one subterranean formation at locations adjacent the monitoring well.

Preferably the system further comprises at least one injection well located externally of one of the at least one bund wall or on an opposing side to an adjacent oil or gas well of the at least one bund wall, the injection well enabling the injection of fluid into the oil or gas field to aid in maintaining hydrostatic pressure of the associated target zone and thereby assist in preventing dewatering and/or subsidence due to compaction around the oil or gas field.

Preferably the target zone is an oil, gas or coal seam of the at least one subterranean formation.

In accordance with a further aspect, the invention may broadly be said to consist of a method of protecting the integrity of a designated oil or gas field comprising at least one oil or gas well which passes through at least one subterranean formation containing pressurized formation fluids, said method comprising the steps of forming at least one bund wall within a target zone of the at least one subterranean formation, each bund extending along at least a portion of a perimeter surrounding the oil or gas field or along at least a portion of a section surrounding one or more oil or gas wells within the oil or gas field to assist in maintaining hydrostatic pressure on at least one side of the bund wall within the target zone thereby reducing the possibility of subsidence within the oil or gas field.

Preferably each bund wall assists in maintaining a relatively higher hydrostatic pressure on a side of the bund wall most distal from the associated oil or gas field and/or from the associated oil or gas well(s).

Preferably the step of forming the at least one bund wall comprises:

forming at least one substantially vertical bore hole extending through the at least one subterranean formation and into the target zone;

forming at least one substantially horizontal bore hole extending from at least one of the substantially vertical bore holes within and along the target zone;

fracturing the target zone at or about the at least one substantially horizontal bore hole by injecting a fracturing fluid through the at least one substantially vertical bore hole and the at least one substantially horizontal bore hole; and filling the at least one horizontal bore hole and the fractured region with a structural compound to thereby form a bund wall along said region.

Preferably the step of fracturing the target zone comprises fracturing the target zone across a substantial or entire portion of a depth of the target zone along the at least one horizontal bore hole.

In one embodiment the method further comprises the step of filling one or more of the at least one substantially vertical bore holes with a structural compound to form at least one substantially vertical stabilisation column within and/or about the oil or gas field.

In the same or in an alternative embodiment the method further comprises the step of forming at least one monitoring well using one or more of the at least one substantially vertical bore holes after fracturing and filling the target zone for monitoring and/or analysing the state and/or composition of the at least one aquifer of the at least one subterranean formation at locations adjacent the monitoring well.

Preferably the step of forming at least one bund wall comprises forming at least one bund wall extending around the oil or gas field to thereby substantially enclose the oil or gas field along the target zone and assist in maintaining hydrostatic pressure in a region external to the bund wall and enclosed oil or gas field.

Preferably the step of forming at least one bund wall comprises forming at least one bund wall extending about a section of the oil or gas field to thereby substantially enclose one or more oil or gas wells within the oil or gas field and assist in maintaining hydrostatic pressure in a region external to the bund wall and enclosed section.

Preferably the step of forming at least one bund wall comprises forming at least one bund wall bund wall open at either end and extending adjacent one or more oil or gas wells within the oil or gas field to reinforce and reduce the possibility of collapse of the oil or gas field or a section of the oil or gas field and to enhance cap rock support to minimise subsidence, and wherein the at least one open ended bund wall is formed in a location at or adjacent a fault zone of the at least one subterranean formation.

In accordance with a further aspect, the invention may broadly be said to consist of an oil or gas well and field integrity system which passes through at least one subterranean formation containing pressurised formation fluids, said system comprising:

at least one oil or gas well located within the oil or gas field; and at least one stabilising column located around and/or spaced from the oil or gas well, the location and required number of stabilising columns being determined using a geographic survey of the at least one subterranean formation, wherein the stabilising columns are utilised to reinforce the at least one oil or gas well and reduce the possibility of subsidence within and around the oil or gas field, and wherein each stabilising column is formed by drilling a bore hole through the at least one subterranean formation and filling the bore hole with a structural compound.

Preferably each stabilising column comprises a region of increased diameter within at least one target zone of the at least on subterranean formation, to thereby increase the effective support strength of the stabilising column in the target zone.

Preferably each stabilising column is formed by increasing the diameter of the bore hole in the at least one target zone using an undercutting drilling technique.

In one embodiment one or more stabilising columns are located adjacent to the at least one oil or gas well and the bore holes associated with the stabilising columns are formed to branch from the borehole of the associated oil or gas well. Preferably the stabilising columns are formed at the same time as the respective well is constructed.

Preferably the bore hole of each stabilising column is formed using a directional drill bit or rig to branch out from the associated oil or gas well bore.

Preferably one or more stabilising columns are located in any one or more of the following locations:

a) adjacent to the at least one oil or gas well;
b) at a corner of a polygonal shaped figure spaced around and a predetermined distance from the at least one oil or gas well;
c) about a boundary surrounding the oil or gas field; and
d) about a boundary surrounding a section of the oil or gas field.

Preferably a plurality of stabilising columns are distributed about and adjacent at least one oil or gas well, a plurality of stabilising columns are distributed about a boundary surrounding the oil or gas field; and/or a plurality of stabilising columns are distributed about a boundary surrounding a section of the oil or gas field enclosing one or more oil or gas wells.

Preferably the system further comprises at least one monitoring well located a pre-determined distance from the at least one oil or gas well, wherein the monitoring well is drilled and a core sample is taken from the monitoring well for analysis and for determining a layout and placement of the at least one stabilising column in conjunction with the geographic survey.

In one embodiment at least one stabilising column is located adjacent to the at least one monitoring well and the bore hole associated with each stabilising column is formed to branch from the bore hole used to form the associated monitoring well. Preferably the stabilising columns are formed at the same time as the respective monitoring well is constructed.

Preferably the system further comprises a monitoring system located within the at least one monitoring well to determine ground water contaminant characteristics which are caused by leaking gas, oil or other chemicals from and around the at least one oil or gas well, the monitoring system comprising:

a well module with at least one probe and at least one sensor that senses ground water or aquifers and gas contaminant characteristics, a transmitter for transmitting signals concerning ground water, aquifer and gas contaminant characteristics to a remote monitoring station; and a global positioning system that enables an accurate determination of a location of the well in the oil or gas field.

Preferably each one of the stabilising columns is located around the at least one oil or gas well in the associated bore hole by using any one of coil tubing, fast tube drilling and/or a steerable drill bit.

Preferably each structural compound is Portland cement or a reinforced Portland cement.

Preferably the structural compound comprises reinforced concrete containing nanoparticles and/or carbon nanotubes; and/or the structural compound comprises a latex additive for enhancing flexibility; and/or the structural compound is reinforced using a fibrous material.

Preferably each stabilising column further comprises at least one high tensile reinforcing cable installed and running coaxially along the stabilising column.

Preferably the stabilising column bore holes are drilled through the target oil or gas zone and into the underlying base cap rock of the target oil or gas zone so as to reinforce the base and anchor the stabilising column.

Preferably the hole bored in the underlying base cap rock is drilled or keyed into the base cap rock to provide for underpinning of the stabilising column.

Preferably the drilled bore holes associated with one or more stabilising columns are fractured with water and proppants before being filled with the structural compound to increase effective diameter and enhance the column strength.

Preferably the stabilising column further comprises a locating calibrated resistance wire installed inside the stabilising column to establish where a future break or fracture of the stabilising column has occurred due to target zone subsidence.

Preferably the stabilising columns further comprise a hollow tube inserted into and running coaxially along the length of the column or well for accommodating a radioactive tracer logging system.

Preferably at least one stabilising column is formed to comprise a substantially vertical stabilising column section and a substantially horizontal stabilising column section.

Preferably the substantially horizontal stabilisation column section extends along and within a target zone.

Preferably a bore hole formed in association with the horizontal stabilising column section is used to fracture the target zone along at least a section of the horizontal stabilising column section to open up any cracks in the oil or gas zone prior to filing the bore hole with the structural compound.

Preferably a plurality of stabilising columns comprising substantially vertical and horizontal sections are installed around a boundary surrounding the oil or gas field and/or a boundary surrounding a section of the oil or gas field.

Preferably the columns installed form a bund within the target zone around the associated boundary.

Preferably the system further comprises at least one injection well located externally of the bund to maintain hydrostatic pressure of a surrounding target zone to assist in preventing dewatering and avoiding subsidence due to compaction around the oil or gas field.

Preferably at least one stabilising column comprises: at least one substantially vertical stabilising column section; and at least two substantially horizontal stabilising column sections separated by an angle of approximately 90 degrees; or two substantially horizontal stabilising column sections separated by an angle of approximately 180 degrees.

The target zone may be an oil, gas or coal seam of the at least one subterranean formation.

In accordance with a further aspect, the invention may broadly be said to consist of a method of protecting the integrity of an oil or gas well and field which passes through at least one subterranean formation containing pressurized formation fluids, said method comprising the steps of:

utilizing a geographic survey of the underlying subterranean formation to determine the placement of at least one stabilisation column;

drilling at least one bore hole for the at least one stabilising column in accordance with the determination of placement of the at least one stabilisation column; and filling each bore hole with a structural compound to form the at least one stabilising column.

Preferably the step of drilling each bore hole comprises using an undercutting drilling technique to increase the diameter of the bore hole in at least one target zone to thereby increase the diameter of the associated stabilising column in the at least one target zone.

Preferably the step of drilling each bore hole comprises drilling at least one bore hole using a bore or wellbore of an oil or gas well of the oil or gas field by causing the bore hole to branch from the oil or gas well bore.

Preferably the bore hole of each stabilising column is formed using a directional drill bit or rig to branch from the associated oil or gas well bore.

Preferably at least one bore hole is drilled to have a substantially vertical section and a substantially horizontal section such that the associated stabilising column formed comprises a substantially vertical stabilising column section and a substantially horizontal stabilising column section.

Preferably the substantially horizontal stabilisation column section extends along and within the target zone.

Preferably the method further comprises the step of utilising the bore hole to fracture the target zone along at least the substantially horizontal section of the bore hole to open up any cracks in the target zone prior to filing the bore hole with the structural compound.

Preferably the method further comprises the step of cleaning each drilled bore hole by flushing with water to remove any contaminated drilling mud and salts from the walls and crevices in the walls of the bore hole before filling the borehole with the structural compound.

Preferably the method further comprises the step of fracturing the at least one subterranean formation using each drilled bore holes via a fracturing fluid prior to filling the drilled bore hole with the structural compound to enhance the stabilising column strength by opening up any fractures that radiate out from the drilled diameter of the bore, thus effectively increasing the final column strength and effective support radius when the bore hole is filled with the structural compound.

Any one or more of the above embodiments or preferred features can be combined with any one or more of the above aspects.

As used herein the term “and/or” means “and” or “or”, or both.

As used herein “(s)” following a noun means the plural and/or singular forms of the noun.

As used herein the term "bund" or the phrase "bund wall" is/are intended to mean a wall formed along at least one subterranean zone to thereby separate two fluidic regions within the zone and assist in the prevention of fluid migration from one region to the other due to fluid pressure differentials and/or to thereby provide physical strengthening and/or support against force(s) acting toward the associated zone.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are exemplary for the purposes of explanation and understanding only.

DETAILED DESCRIPTION OF THE INVENTION

Figure 1:
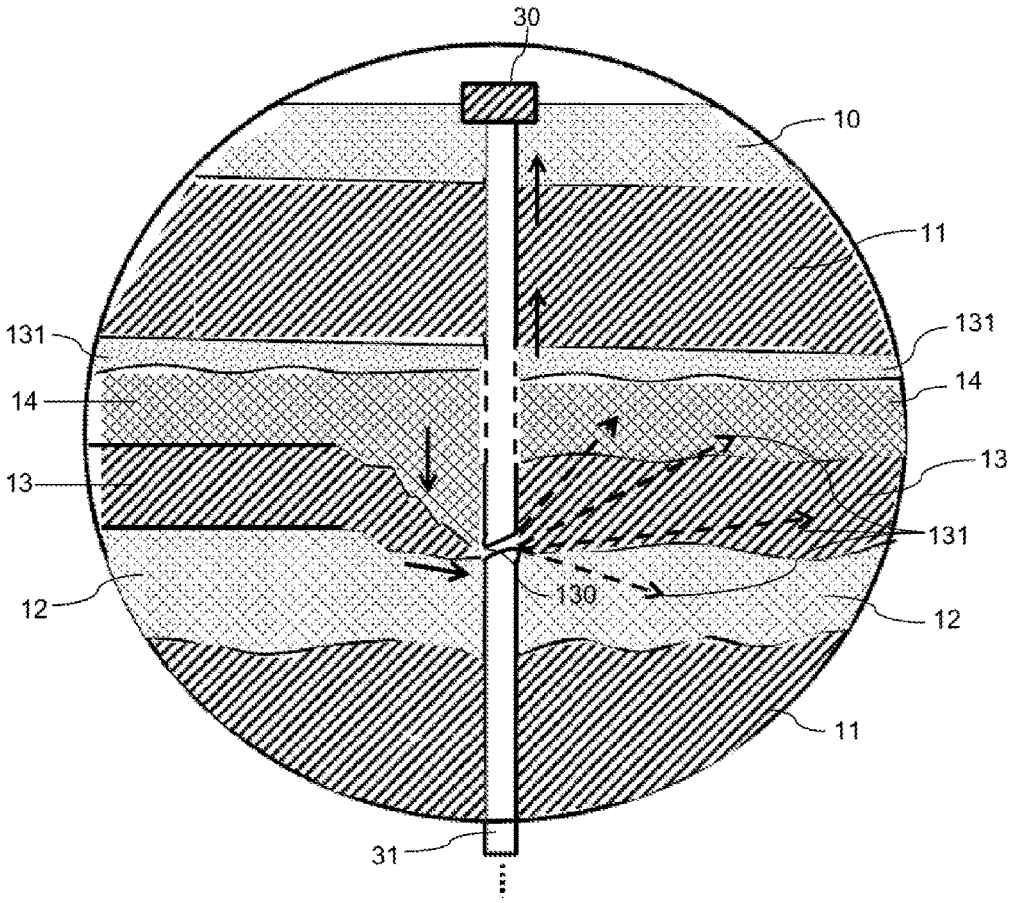
FIG. 1 (PRIOR ART)
FIG. 1 illustrates a prior art CSG well in which subsidence has occurred and the integrity of the well stem has been compromised.

The following description, given by way of example only, is described in order to provide a more precise understanding of the subject matter of a preferred embodiment or embodiments. Also, hereby incorporated by reference is the applicant's Australian Patent Application No 2013224747 filed 9 Sep. 2013 and entitled "Detection and Collection System for Fugitive Gases and Effluent Liquids Leaking from Around Drilled Wellheads". Further, also hereby incorporated by reference is the applicant's International Patent Application No PCT/AU2014/000336 filed 31 Mar. 2014 and entitled "Detection and Collection System for Fugitive Gases and Effluent Liquids Leaking from Around Drilled Wellheads".

The invention will be described with reference to an oil or gas field with both production and non-production wells. However the present invention is equally relevant for any type of well which passes through at least one subterranean formation containing pressurised formation fluids. Therefore the scope of the invention should not be restricted to only oil or gas fields. Oil and gas wells may be several thousand feet deep and may pass through several different hydrocarbon producing formations. Additionally, fresh water formations may be traversed by the wellbore. It is important in the completion of such a well that each producing formation be isolated from all other producing formations and from fresh water formations and the surface. The need for zonal isolation also arises in other types of wells such as, for example, water source wells, storage wells, geothermal wells and injection wells. Typically, this isolation is accomplished by installing metallic tubulars in the wellbore which are joined by threaded connections and cemented in place. These metallic tubulars are typically referred to as "a casing". The term "liner" is also used to refer to a string of casings whose top is located below the surface of the well. All such metallic tubulars will be referred to herein as "a casing". Typically an oil or gas field will consist of many oil or gas production wells located within an area which has been identified through exploration as an oil or gas plentiful area.

The process for primary cementing of a metallic casing is well known. During drilling operations the wellbore is filled with a drilling fluid. The hydrostatic pressure exerted by the drilling fluid on the walls of the wellbore prevents flow of formation fluids into the wellbore. After the well has been drilled to the desired depth the casing is inserted into the wellbore and a cement slurry is pumped down the casing and up the annular space between the casing and the wall of the wellbore thereby displacing the drilling fluid. If the cement extends to the surface all of the drilling fluid is normally displaced, except any which may be by-passed in a filter cake on the wall of the wellbore. Alternatively, if the cement does not extend to the surface some drilling fluid will remain in the annulus above the cement. Upon completion of the displacement process the combined hydrostatic fluid pressure exerted by the drilling fluid, if any, and the cement slurry prevents formation fluids from entering the wellbore. When the cement cures, each producing formation should be permanently isolated thereby preventing fluid communication from one formation to another. The cemented casing may then be selectively perforated so as to produce fluids from a particular formation.

Unfortunately, a large percentage of well completions are unsuccessful or, at best, only partially successful in achieving total zonal isolation of the various producing formations penetrated by the well. This is especially true in deep well completions across relatively high pressure gas producing formations where gas flow to the surface through the cemented annulus is often observed soon after completion of the cementing. This phenomenon, known as annular fluid flow, is a major problem requiring expensive and technically difficult remedial measures. The term "annular gas flow" is also used to describe this problem. However, since the problem may occur with liquids as well as gases, the term "annular fluid flow" is more accurate.

Cracking of the outer cement casing or corrosion of inner steel casing tubing creates pressure differentials which causes pressure to increase between the outer cement casing and bore casing or between the outer cement casing and the rock interface. This pressure propagates upwards until it reaches the surface or, conversely, downwards into the underlying aquifers or, alternatively, migrates outwards and is ultimately released to the surface environment. Some of the dynamics that can lead to an incomplete sheath around the bore steel casing, have previously been identified above. In particular, some of the more important factors that occur are due to a non-centralised pipe, complex well paths, poor mud properties, slow displacement rates from a tight mud weight causing cementing problems, stresses due to temperature and pressure cycling occurring throughout the completion and production process, and continuously changing variables which occur from the moment a well comes on line. All of these factors including formation changes, pressures change, and wells which get shut in and then put back on line, all of which affects the sheath integrity.

"De-watering" of the coal cleat system is the first stage of an unconventional gas extraction process. A large volume of water is usually extracted to reduce the water pressure until the methane is released from the coal matrix. One of the most common activities causing subsidence is related to the withdrawal of ground fluids such as geothermal water or steam, ground water, and oil and gas. Each of these may cause a maximum subsidence of the same order or magnitude. Generally, subsidence occurs as a result of two mechanisms during ground fluid withdrawal. Firstly, due to local compaction of the target zone, such as a coal seam, due to the reduction of the pore pressure that increases the effective stress according to consolidation theory, and secondly due to lateral shrinkage of strata where the water table was lowered. In this specification, reference to a target zone is intended to mean a zone within at least one subterranean formation that is utilised for the extraction an underground natural resource, such as for example an oil, gas or coal seam. FIG. 1 illustrates the layers of the subterranean formation including aquifers 10 and 12, layers of rock 11 and 13 and coal seam 14 with methane gas 131. The well stem casing 31 is perforated in the area around the coal seam 14 and the gas layer 131 to allow the methane gas 131 to pass into the well stem 30. A subsidence event has occurred around the layer of rock 13 as shown by the arrows and has created a crack 130 in the casing 31 of the well 30. Subsequently methane gas 131 from within the well casing 31 has leaked into the surrounding aquifer 12 and the layer of rock 13 and subsequently contaminates the water within the aquifer 12.

Coal is a multi-phase porous media in which hydraulic and mechanical processes interact and may cause the compaction of the coal seam during CSG extraction and to some degree affect the entire geological profile. The subsidence bowl tends to be approximately symmetric, even if the compacted volume is not. Due to the complex geological profiles found in nature, the withdrawal of ground fluids does not only affect the specific strata under consideration, but also layers located above and below. Thus, the subsidence bowl is a result of the superposition of subsidence from each compacted strata. Although compaction and subsidence are related, it is not easy to observe compaction of an underground reservoir. Surface subsidence, however, may be detected easily. In fact, subsidence has been recognised as the first indicator of compaction over hydrocarbon fields since the first case studies were published.

The prediction of the potential long-term subsidence from CSG production and the severity of its impacts is a difficult task, due to the potential superposition of region-specific impacts of multiple developments. In general terms, subsidence caused by CSG production may have two main types of impact. Firstly impacts on infrastructure including the well itself, access roads, houses, buildings, pipelines, bridges, water supply, sewerage systems, dams, connection to nearby underground workings; and secondly impacts on natural resources such as aquifers, streams, rivers, lakes, cliff lines, rock formations, archaeological sites and microtremors in fault systems. CSG production is typically located in the region between 200 m-1,000 m depth below ground level. Well integrity over such range of depth is vulnerable to the impacts of subsidence at any point along the length of the well stem (depending upon where the subsidence occurs). That is, subsidence can create damage to the well stem at any point from the surface to 200-1,000 meters down. The damage attributable to subsidence can result in shear fracturing of the well stem.

Subsidence may occur if the ground contains voids or cavities from old mine workings, chemical dissolution of carbonate rocks, or suffusion in sandstone. Collapse failure occurs when the material (rock or soil) loses strength and support. Uncontrolled hydraulic fracturing, at high fluid pressures, enhances existing fractures/joints and may also induce new fractures in the coal seam as well as in the underlying and overlying strata (thus degrading their strength). An analogous example of subsidence is if you had a multi-story or multi-level carpark and the basement support structure was removed, this would result in the collapse of the parking structure.

Fractures and joints may also lead to new connections between existing voids or cavities. The hydraulic connectivity between different strata may speed up the formation of a collapse mechanism. In all cases, the likelihood of problems during CSG production will depend on many factors. Detailed geophysical, geological and geotechnical characterisation of the site has to be carried out. A careful control of hydraulic fracturing practice as well as a continuous monitoring of the extraction process will be needed to minimise any dangerous consequences.

Seismic surveys are the result of reflection seismology (or seismic reflection) which is a method of exploration geophysics that uses the principles of seismology to estimate the properties of the Earth's subterranean subsurface from reflected seismic waves. Sound waves are bounced off underground rock formations and the waves that reflect back to the surface are captured by recording sensors. Analysing the time the waves take to return provides valuable information about rock types and possible gases or fluids in rock formations. The method requires a controlled seismic source of energy, such as Tovex (a water-gel explosive composed of ammonium nitrate and methylammonium nitrate), a specialized air gun or a seismic vibrator, commonly known by the trademark name Vibroseis. Reflection seismology is similar to sonar and echolocation. Oil and gas explorers use seismic surveys to produce detailed images of the various rock types and their location beneath the Earth's surface and they use this information to determine the location and size of oil and gas reservoirs. Alternatively, an aeromagnetic survey can also be used to produce a geophysical survey and is carried out using a magnetometer aboard or towed behind an aircraft. The principle is similar to a magnetic survey carried out with a hand-held magnetometer, but allows much larger areas of the Earth's surface to be covered quickly for regional reconnaissance. The aircraft typically flies in a grid-like pattern with height and line spacing determining the resolution of the data.

It is recognised that by coal seam gas operators that subsidence does occur around CSG wells. It is worth noting that CSG wells are being constructed within the Surat Basin, Queensland, Australia, between about 200-750 meters apart. The adoption of multiple wells, in both vertical and horizontal configurations, will enlarge the volume of soil prone to rapid settlement (that is, subsidence). Thus, the impacts on natural resources, such as aquifers and rivers, as well as infrastructure (including the wells) will increase. A complex and possibly non-symmetrical subsidence bowl could be expected if multiple wells are involved. The magnitude of the subsidence caused by multiple wells and impact on natural resources and infrastructure will depend on their configuration, including the possible overlapping (separation) between subsidence bowls. Of course, the rate of expansion of the subsidence bowl will depend on the rate of gas extraction. There is a direct relationship between commercial requirements for high production rates (intense fracturing and increasing the compressibility) and subsidence issues. By way of example, dewatering can result in thousands of square meters ($m^2$) of cap rock being unsupported by the target coal zone.

Figure 2:
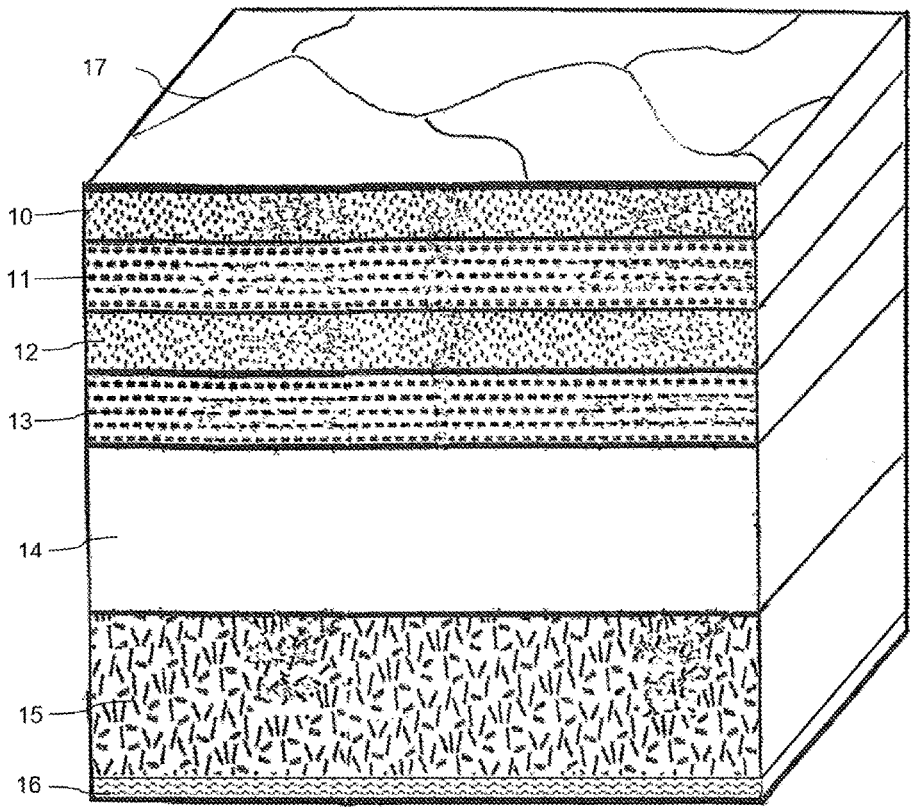
FIG. 2 (PRIOR ART)
FIG. 2 shows a schematic section of a typical site for a CSG well showing the different layers below the ground level.

The present system provides for monitoring data from the surface to the target coal seam and in broad areas around the production well stems and the oil or gas field. The monitoring data can be gathered and utilised for the implementation of appropriate mitigation techniques. As illustrated in FIG. 2 a typical subterranean formation containing pressurised formation fluids is shown. The layers have been confirmed by the use of the seismic survey or aeromagnetic survey to produce the detailed image of the underlying subterranean structure. Starting at the top of the structure is the river or stream 17 which is a natural flowing watercourse, usually freshwater, flowing towards an ocean, a lake, a sea, or another river. The layers beneath the ground contain a number of different layers including groundwater. Groundwater is the water located beneath the earth's surface in soil pore spaces and in the fractures of rock formations. A unit of rock or an unconsolidated deposit is called an aquifer 10, 12, 16 when it can yield a usable quantity of water. The depth at which soil pore spaces or fractures and voids in rock become completely saturated with water is called the water table. Groundwater is recharged from, and eventually flows to, the surface naturally; natural discharge often occurs at springs and seeps. Groundwater is also often withdrawn for agricultural, municipal, and industrial use by constructing and operating extraction wells. Typically in between the different aquifers are layers of rock 11, 13, 15. Located in between the layers of rock and aquifers is the target zone, in this instance a target coal seam 14. It will be appreciated that depending on the application, the target zone may alternatively be a target oil or gas seam for example.

Aquifers 10, 12, 16 may occur at various depths. Those closer to the surface are not only more likely to be used for water supply and irrigation, but are also more likely to be topped up by the local rainfall. There are basically two types of aquifers, unconfined 10 and confined aquifers 12, 16. Unconfined aquifers 10 are those into which water seeps from the ground surface directly above the aquifer 10. Confined aquifers 12, 16 are those in which an impermeable dirt/rock layer 11, 13, 15 exists that prevents water from seeping into the aquifer 12, 16 from the ground surface located directly above. Instead, water seeps into confined aquifers 12, 16 from farther away where the impermeable layer 11, 13, 15 doesn't exist. Coalbed methane (CBM or coal-bed methane), coalbed gas, coal seam gas (CSG), or coal-mine methane (CMM) is a form of natural gas extracted from coal beds 14. In recent decades it has become an important source of energy in a number of countries including the United States, Canada, Australia, and other countries.

Figure 3:
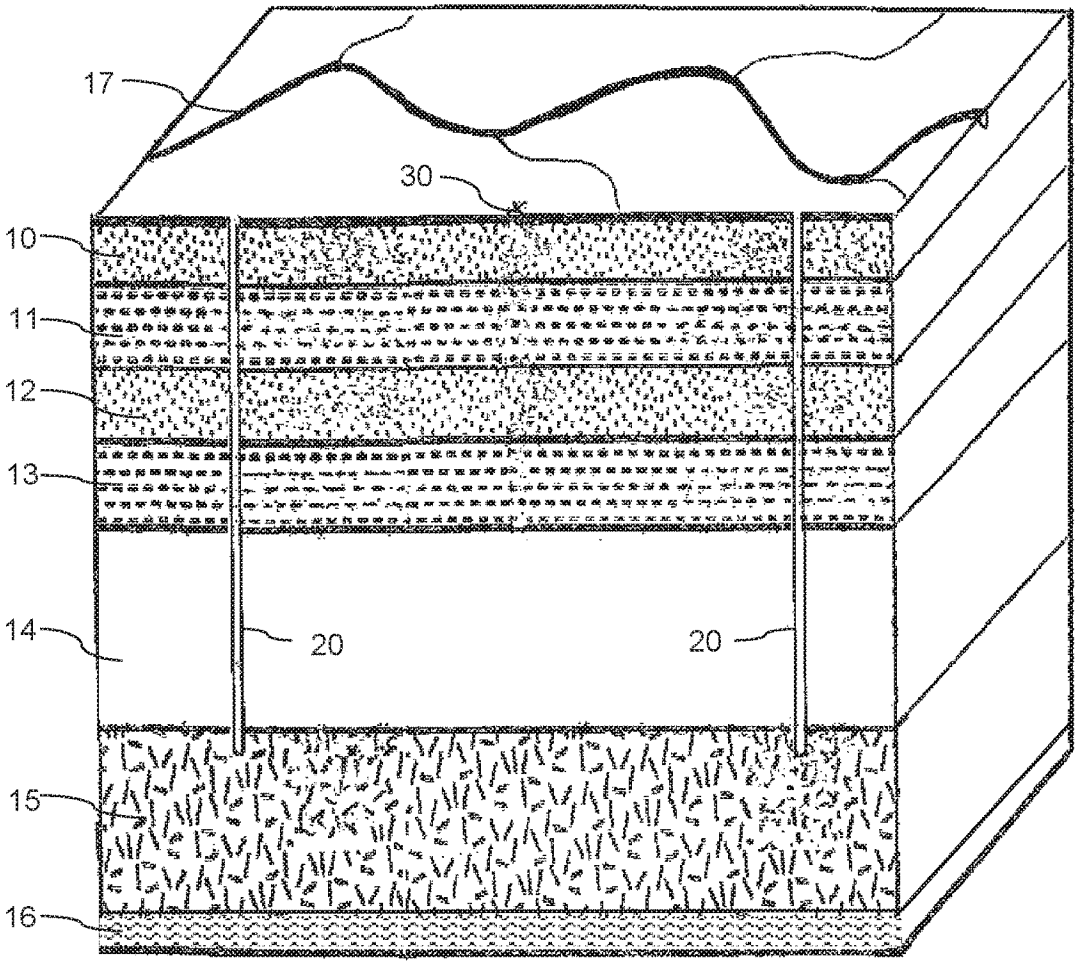
FIG. 3 shows the schematic section of FIG. 2 with two monitoring wells drilled through the layers and into the rock below the coal seam in accordance with an embodiment of the present invention.

Illustrated in FIG. 3 is the drilling of monitoring wells 20 located around the future potential gas well 30. The first stage in any coal seam gas production operation is exploration and development. This takes place to locate and determine the most appropriate methodology to extract the gas. Typically a geologist is responsible for defining the shape, size and quality of the coal seam reserves and for producing a computer model. This model is used by the mining engineers to plan and manage the mining process. The future gas well 30 is identified and a global position marker is used to identify the gas well prior to drilling. This also assists in the positioning of the monitoring wells 20.

The present system includes the construction and operation of one or more monitoring wells 20 drilled five meters or more (subject to geophysics analysis) from the surveyed site of the CSG production well 30. Typically the monitoring wells are drilled about 20 to 30 meters from the surveyed site of the CSG production well 30. The positioning and location of the monitoring well(s) 20 is critical to the overall safe future operation of the production well 30. The ideal location will be on the low side of the intended production well 30, so that monitoring of any well leakage of gases or fluid pollutants into the surrounding aquifers, may be detected. While positioning the monitoring well 20 on the low side of the gas well 30 is preferred there is no limit to the number of monitoring wells 20 used. Likewise the positioning of the monitoring wells 20 will largely be determined by the geographical analysis of the surrounding subterranean structure. In FIG. 3 monitoring wells 20 are located on both the high and low sides of the gas well 30. While the monitoring wells are typically used to monitor the respective well 30, they can also be used to determine if a nearby well 30 is leaking.

When drilling the monitoring well 20 a core sample is taken from the drilling process and analysed. A core sample is a cylindrical section of the structures beneath the ground which the monitoring well 20 is located. Most core samples are obtained by drilling with special drills into the substance, for example sediment or rock, with a hollow steel tube called a core drill. The hole made for the core sample is called the "core hole". A variety of core samplers exist to sample different media under different conditions. In the coring process, the sample is pushed more or less intact into the tube. Removed from the tube in the laboratory, it is inspected and analysed by different techniques and equipment depending on the type of data desired. Base line testing data of the monitoring bore is taken prior to the production gas or oil well being drilled. Monitoring wells 20 are therefore configured to monitor, determine and/or analyse the state and/or composition of at least one aquifer at locations adjacent the monitoring well. It will be appreciated that any alternative and well known methodology for determining and/or analysing the state and/or composition of an aquifer can be implemented and utilised using the monitoring well without departing from the scope of the invention.

The monitoring well(s) 20 borehole can also be drilled by conventional means using a rotary drill (for instance, using the Weatherford core rotary-steerable system) or by tube coil drilling with a hydraulic powered drilling bit attached. The drilled monitoring well bore can be analysed via wire line testing before casing and developing the test points for monitoring the potential pollution contamination. The monitoring well bore comprises a casing with a cement seal in the target gas zones 14 along with any intermediate gas zones 14 detected. The monitoring target aquifers 10, 12 are accessible via perforations (screening if required) into the walls of the well casing. The monitoring well bore casing can be made of various materials including plastic, fibreglass, steel, stainless steel or any other material deemed to be suitable. A sampling pump (not shown) is movable from each aquifer zone 10, 12 with an inflatable sealing collar extending above and below the intake of the sampling pump, so that sampling will occur at each aquifer zone 10, 12 before being moved to the next aquifer zone 10, 12. Alternatively, the monitoring well 20 can consist of a number of fixed sampling pumps located at each aquifer zone 10, 12 within the monitoring well 20. That is each aquifer zone 10, 12 will have a fixed sampling pump to take individual samples from that aquifer zone 10, 12. Like the movable pump above, the fixed sampling pumps have an inflatable sealing collar extending above and below the intake of each sampling pump.

A down bore wire logging system is also readily available to detect gas infusion into the aquifers 10, 12 along with well water contamination water from the dewatering of the target gas zone 14. The well water may contain brines, and other compounds (including radionuclides (particularly radium which has decayed from uranium). The oil and gas industry uses down bore wire logging or wireline logging to obtain a continuous record of a formation's rock properties. Wireline logging can be defined as being "The acquisition and analysis of geophysical data performed as a function of well bore depth, together with the provision of related services." The measurements are made referenced to True Along Hole (TAH) depth: these and the associated analysis can then be used to infer further properties, such as hydrocarbon saturation and formation pressure, and to make further drilling and production decisions. Wireline logging is performed by lowering a 'logging tool'—or a string of one or more instruments—on the end of a wireline into an oil or gas well (or borehole) and recording petrophysical properties using a variety of sensors. Logging tools developed over the years measure the natural gamma ray, electrical, acoustic, stimulated radioactive responses, electromagnetic, nuclear magnetic resonance, pressure and other properties of the rocks and their contained fluids. The data itself is recorded either at surface (real-time mode), or in the hole (memory mode) to an electronic data format and then either a printed record or electronic presentation called a "well log" is provided. The data can be transmitted to a remote or central location for analysis of the particular well or oil or gas field.

Real-time data is recorded directly against measured cable depth. Memory data is recorded against time, and then depth data is simultaneously measured against time. The two data sets are then merged using the common time base to create an instrument response versus depth log. Memory recorded depth can also be corrected in exactly the same way as real-time corrections are made, so there should be no difference in the attainable TAH accuracy. Alternatively, the testing for polluted water out of a particular aquifer or aquifers can be carried out by continuously extracting and testing the water from the well. This is particularly useful when overcoming the problem of the slow movement of subterranean water which occurs naturally. Marker dyes can also be used to locate potential well leaks into aquifers. Marker dyes have been readily used to identify polluted water. For example water extracted from a well may be coloured when the water extracted has been contaminated by gas. The colour is formed due to the reaction of the water in the aquifer with the gas.

As such, the present invention allows the "finger print" analysis of each water sample extracted from the aquifer zones 10, 12 of the monitoring bore 20 and will provide a true sampling for the detection of any induced pollution from the production well 30 at a specific aquifer zone 10, 12. The Gas Company can then make the decision to shut down the production well and repair the damage to the production well by grouting or replacing the well bore casing. The chemical finger printing is used for the identification of each aquifer 10, 12 through which the monitoring well 20 is drilled. Monitoring bores are ideally located before and/or after the anticipated aquifer 10, 12 flow direction on either side of the site of the production well bore 30 (20-30 meters subject to geophysics analysis). The ability to extract samples of water from an individual aquifer 10, 12 and the consequent "chemical finger printing" of the aquifer is of vital importance. Each sample of water obtained from each aquifer 10, 12 provides specific data (that is, an allergist to "chemical finger printing") which can provide evidence, subject to analysis, of well stem leakage or inter-aquifer connectivity due to the effect of fracking and/or subsidence.

If the production well was deemed un-repairable then the well will have to be totally sealed from top to bottom with a structural compound, preferably a high strength Portland cement ideally reinforced with nanoparticles, fibre reinforcement or at least one reinforcement cable. Before the un-repairable well is sealed with concrete the well is typically highly perforated along its entire depth and then fracked to open up any further cracks before being filled and sealed by pressure cementing.

As indicated earlier, there is an environmental need for CSG operators to employ methodology to monitor what is happening to the soil and aquifers 10, 12 underlying and overlying any point along the well stem 30 where buckling, shearing, bending or cracking of the outer cement casing or shearing off of the well stem 30 has occurred or in the target gas zones 14 where fracturing has occurred. In the event of contamination occurring at and around these areas, CSG operators can then implement appropriate mitigation techniques to discharge their overriding obligation not to cause environmental harm.

An ongoing control system including the monitoring wells 20 is provided to continuously monitor the quality of the soil and aquifers 10, 12 surrounding the well stems 30. The system permits early collection and processing of data so that CSG operators can endeavour to carry out remediation/mitigation action. Each monitoring well 20 has a monitoring system located in or near to the monitoring wells 20. The wells 20 being located on either side of the well 30 and drilled a pre-determined distance from the gas well 30. In FIG. 3 the two monitoring wells 20 are positioned one on the low side of the oil or gas well 30 and one on the high side of the oil or gas well 30, so that monitoring of any well leakage of gases or fluid pollutants into the surrounding ground water may be detected. This also includes the monitoring of any other leaking wells within the associated oil or gas well field.

A typical monitoring well 20 comprises a bore well having a casing with a cement seal located in the targeted gas zones 14 along with any intermediate gas zones detected in the well 30. The monitoring well 20 includes a number of perforations located in the walls of the well casing for accessing the targeted aquifers 10, 12. The well bore casing of the monitoring well 20 is constructed from any one of plastic, fibreglass, steel, stainless steel or other material deemed to be suitable. Each monitoring well 20 includes a well module located within or adjacent to the monitoring well 20. The well module comprises at least one probe and at least one sensor that can sense ground water and gas contaminant characteristics. In order to transmit the sensor outputs to a remote monitoring station a transmitter is located typically at the top of each monitoring well 20. Additionally a global positioning system can also be installed to enable the accurate determination of a location of the monitoring well 20 in the monitoring system. The interconnection between monitoring wells 20 located throughout the oil or gas field can be developed and mapped.

Each monitoring well module includes a number of different sensors. The sensors can include an in-situ sensor, vapour sensor, chemical sensor, fibre optics sensor, solid-state sensor, metal oxide sensor, and electrochemical sensor, and any combinations thereof. Alternatively, the at least one monitoring well 20 further comprise a hollow tube inserted into and running coaxially along the length of the well for accommodating a radioactive tracer logging system (not shown). The radioactive tracer logging system includes a tool passing through the hollow tube, the tool is used to fire radioactive Cesium slug tracers into the walls of the monitoring well 20 before cementing the monitoring well 20. Once the slugs are in place a gamma ray detector with circuitry to amplify and transmit the detector counts to the surface is passed up and down the tube. The information can then be recorded and/or can be transmitted to a remote recording station. Likewise the radioactive tracer logging system can also be installed inside stabilising columns 40 that will be described in further detail below.

Figure 4:
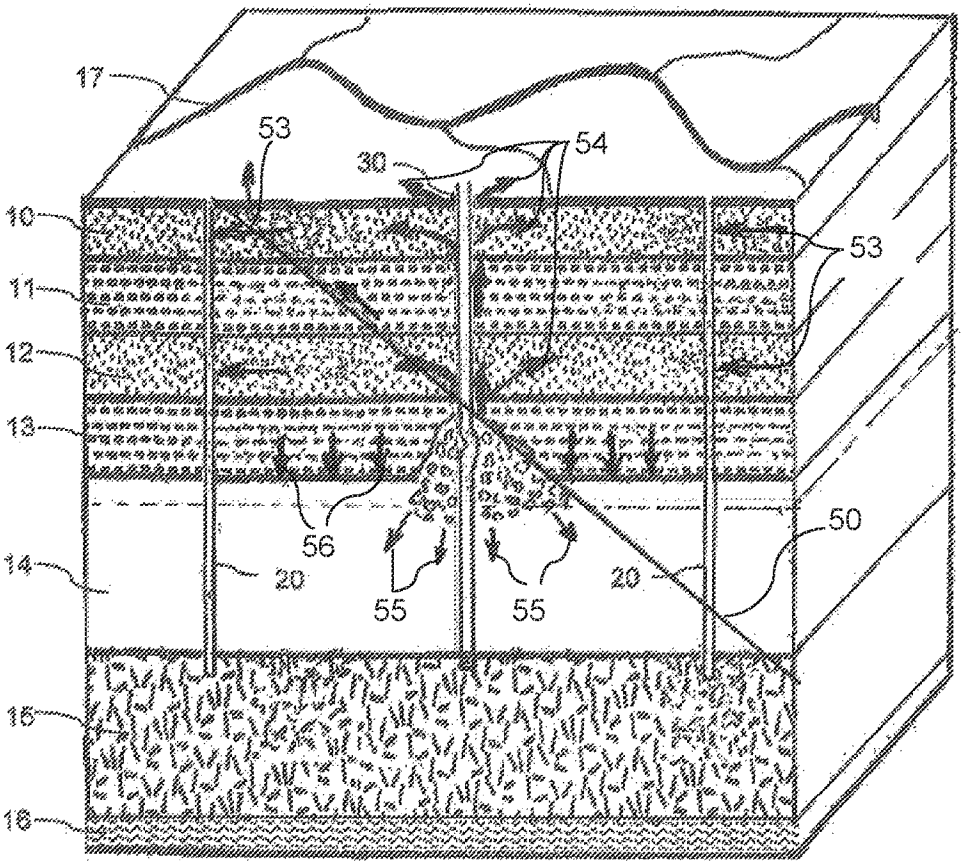
FIG. 4 shows the schematic section of FIG. 3 with an oil or gas production well and no stabilising columns and illustrating the effect of subsidence on the subterranean structures and the production well.

FIG. 4 illustrates the results of subsidence on an oil or gas production well which has two monitoring wells 20 one on the low side and one on the high side of the production well 30. The direction of the flow of the aquifers is shown by arrows 53. Without stabilising columns 40, and when subsidence occurs (illustrated by arrows 56) the effect shows the resultant damage to both the production well 30 and the surrounding layers of the subterranean structure. This includes the leaking of oil or gas (methane) 54 from the production well 30 into the surrounding aquifers 10, 12. A fault zone 50 is shown which due to subsidence causes the integrity of the production well 30 to fracture. The direction of flow of the aquifers 10, 12 is illustrated by the arrows 53 and the leaking methane gas ($CH_3$) is illustrated by arrows 54. The collapsed cap rock 13 is illustrated by arrows 55.

Figure 5:
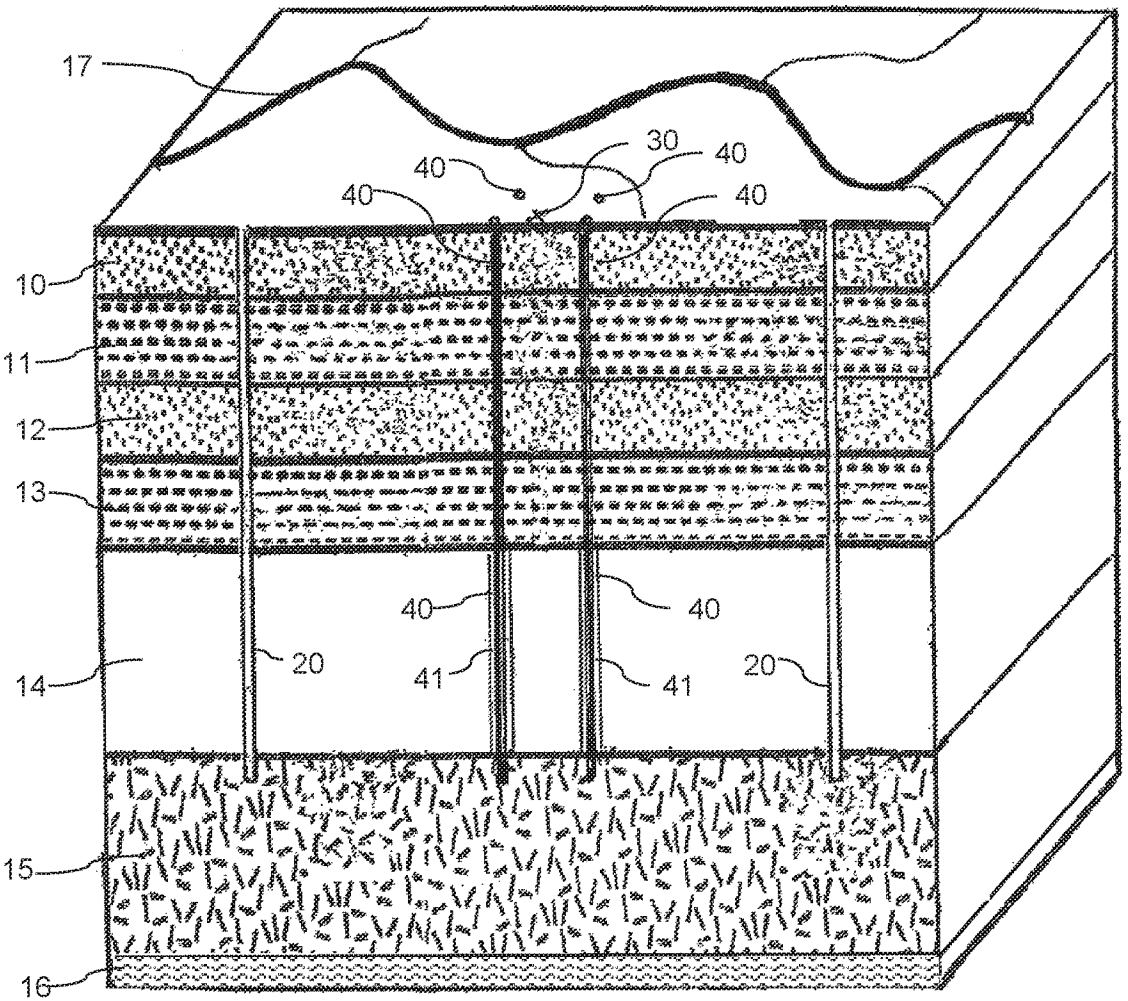
FIG. 5 illustrates the schematic of FIG. 3 with two stabilising columns located on either side of the proposed well bore.

In accordance with a preferred embodiment of the invention, the system and process of well integrity protection comprises the drilling and installation of one or more stabilising columns 40. It will be appreciated that any number of stabilising columns 40 may be installed depending on the application and the numbers given herein are for exemplary purposes only. As illustrated in FIG. 5 four stabilising columns 40 are installed around the oil or gas well 30. As described above, in the preferred embodiment prior to drilling the oil or gas production well 30, the monitoring wells 20 are drilled and a core sample is taken from the surface to the cap rocks 15. The core sample allows for a systemic survey; core drill sampling of target gas zones 14 and cap rocks 15, and any geophysics analysis. If required, a diamond drill core sampling can be undertaken to qualify cap rock strength and the location and extent of any faults 50. The drilled core well can be utilised as a monitoring well 20. It will be appreciated that the stabilising columns 40 may be drilled based on any other geographic survey and/or analysis in alternative embodiments.

Stabilisation of each CSG well 30 providing protection against the adverse effects of subsidence or some other event (e.g. an earthquake) and is achieved by the installation of stabilising columns 40 around the oil or gas well 30. The first stage is to drill a 90-150 mm (or larger) diameter stabilising bore holes at sites around the intended production well bore site utilising the operation of a coil tube. The site of the stabilising bore holes can be at the corners of the surface Detection and Collection System previously mentioned above, which is installed around the well head 30. For example, the bore holes for the stabilising columns 40 may be located at corners which are approximately 5 or more meters in distance apart. This is dependent upon the geophysics analysis for each individual well site.

Additional stabilising columns 40 may be required to be drilled in a pattern around the intended production well bore site, the location of these to be determined by analysis of the seismic survey, the aeromagnetic survey and/or the core test from the monitoring well hole having been drilled down into and below the target coal seam zone 14. Analysis of the stability of the under lying and over laying cap rocks 13, 15 aid in the design pressures of any fracking that is intended in the target coal zone 14 (This also applies to shale gas rock structures). The location and number of stabilising columns 40 is dependent upon the structural analysis of the subterranean structure. Therefore the number and placement of the stabilising columns 40 is determined for each well 30 as the subterranean structure can differ significantly from site to site.

Each stabilising column bore hole is drilled using standard or conventional drilling methods such as the use of fast tube drilling rigs. Alternatively the use of steerable drill bits or rigs will make for accurate vertical drilling of the column bore hole. Drilling mud or water with density additive potassium chloride (KCl) is recommended having been designed from the results of the drilled monitoring bore hole. Drilling mud or fluid is used to aid the drilling of the boreholes into the subterranean structure. The stabilising bore holes do not require casing to be installed as they are filled with a structural compound. The structural compound can include any useful material known in the art, most typically concrete/cement and in the preferred embodiment the concrete/cement is reinforced with suitable additives and/or other materials to increase its strength and suitability to the application. For example, a special reinforced Portland cement with nanoparticle, carbon nanotubes (additional fibre reinforcement may be deemed required for maximum strength of the column) and/or at least one reinforcing cable. Preferred compound materials and additives will be described in further detail below, however, as it will be appreciated to those skilled in the art the invention is not intended to be limited to any one or particular combination of these materials/additives.

The stabilising bore holes are drilled through the target zone 14 and into the underlying base cap rock 15 of the target gas zone 14 so as to anchor the stabilising column 40. As shown in FIG. 5 the bore in the target zone 14 comprises a region of increased diameter to thereby increase the effective support strength of the stabilising column in the target zone. In the preferred embodiment, the bore is increased in diameter by utilising an undercutting drilling technique, however other techniques may be employed in alternative embodiments. The increased diameter is shown at reference number 41. This increased diameter in the target zone 14 will increase the support strength when the stabilising column 40 is filled with concrete between the target zone base and the roof cap rock 13, thus reducing the possibility of roof collapse near the production well 30 due to compaction of the oil or gas zone 14 due to the effects of dewatering or oil or gas removal. The increase in diameter is preferably in the range of 150%-600% larger than the remaining bore hole diameter, however other diameters falling outside this range are also envisaged and not intended to be excluded from the scope of protection. In the preferred embodiment, the region of increased diameter is substantially cylindrical and stepped from the preceding region of the stabilising bore hole.

Cleaning of drilled stabilisation bore holes by flushing with water to remove any contaminated drilling mud and salts (KCl) from the walls and crevices in the walls of the bore hole is important as these compounds can reduce the strength of the filling concrete. The drilled bore holes can also be fracked using a fracturing fluid, for example a fluid containing water and proppants, to enhance the stabilising column 40 strength by opening up any fractures that will radiate out from the drilled diameter of the bore, thus effectively increasing the final column strength and effective support radius when pressure back filled with the structural compound, e.g. concrete.

Concrete stabilisation of the stabilising columns 40 is achieved by filling the columns 40 from the bottom using a sacrificial polypipe so as to remove any water accumulated from the opened aquifers 10, 12 by pushing out the water whilst the concrete is poured cumulatively from the base of the bore hole. The additional column pressurisation of the filled concrete before setting can increase the structure strength of the stabilising columns 40 by reducing air entrapment and the positive filling of voids in the concrete stabilising column 40 and filling any fissures caused by fracking of the stabilising column 40.

The concrete composition used in the stabilising columns 40 is a mix of Portland cement with reinforcing additives incorporated to maximise strength. Additional flexibility can be achieved with the addition of latex additives. The reinforcing compounds used are nanoparticles and carbon nanotubes. Further additional structural strength can be achieved with the addition of conventional or unconventional fibres comprising steel, titanium or fibreglass or any other suitable material. For example, any reinforced concrete containing fibrous material which increases its structural integrity. Typically the fibres are short discrete fibres that are uniformly distributed and randomly oriented. The character of fibre-reinforced concrete changes with varying concretes fibre materials, geometries, distribution, orientation, and densities.

Figure 15:
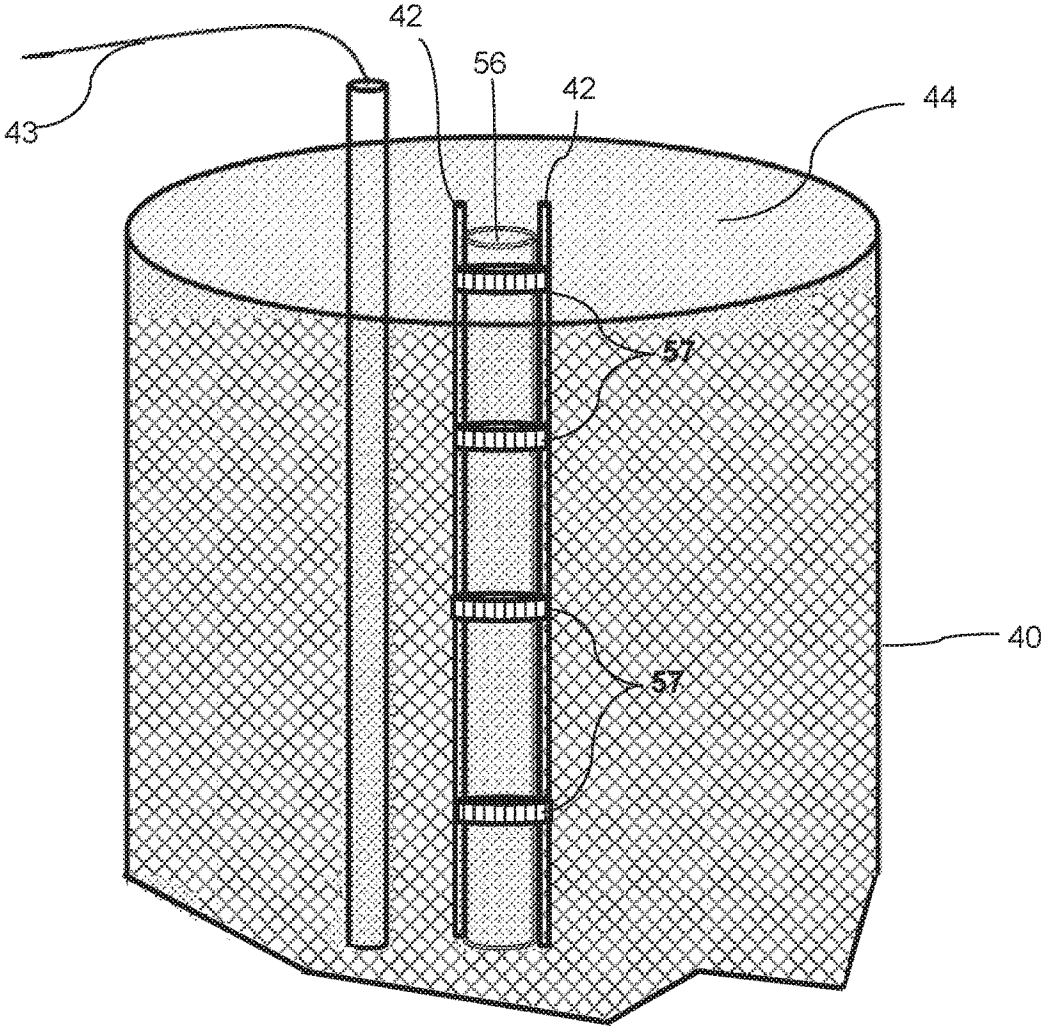
FIG. 15 shows a section of a stabilising column in accordance with an embodiment of the present invention.

A locating calibrated resistance wire 43 can be installed in the stabilising columns 40 before being filled with concrete as shown in FIG. 15. This will help establish where a future break or fracture of the stabilising column 40 has occurred due to target zone 14 subsidence (or some other event, e.g. earthquake). The location of the fracture can be determined electronically from the change in wire resistance. A number of other sensors can be installed to monitor any future breaks or fractures in the stabilising columns 40. For example the use of a radioactive tracer logging system as described above for the monitoring wells 20.

The stabilising columns 40 are filled with cement to the top of the bore hole. The applicant's "Detection and Collection System for Fugitive Gases and Effluent Liquids Leaking from Around Drilled Wellheads" (Australian Patent No. 2013224747) can then be installed and operated to detect, contain, monitor and recover, amongst other things fugitive gas and wellbore fluids which would otherwise escape to the surface environment.

Alternatively the stabilising columns 40 include a high tensile reinforcing cable 42 installed and running coaxially along the stabilising column 40 as shown in FIG. 15. For example, a high tensile galvanised steel reinforcing cable can be used. The stabilising column 40 can also have any number of reinforcing cables 42 installed inside the column prior to cementing the column 40. Typically the cables are equally spaced around the column 40 and running parallel and coaxially along the longitudinal length of the stabilising column 40. The reinforcing cable 42 can be installed using a sacrificial polypipe 56 with the high tensile cable 42 mounted on the outside of the polypipe 56. The high tensile cable 42 can be mounted and supported on the polypipe 56 using cable ties 57 or any similar device which will hold the reinforcing cable 42 in place while the stabilising column 40 is cemented in place.

Figure 6:
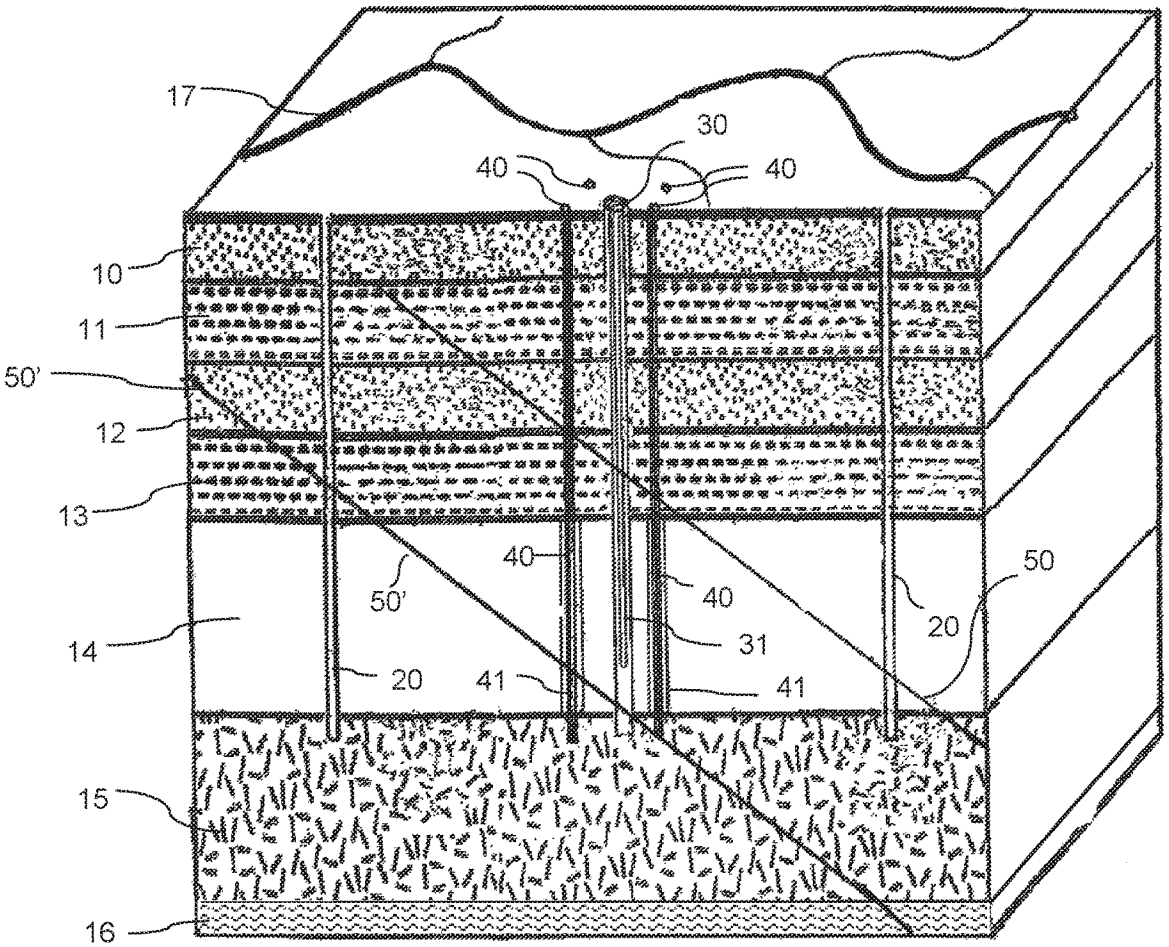
FIG. 6 illustrates the schematic of FIG. 5 and further showing the oil or gas production well drilled inside the two stabilising columns and showing two pre-existing fault lines.

The next step in the process is the drilling and positioning of the oil or gas production well 30 as illustrated in FIG. 6. The process used is a standard process used in most oil or gas wells 30. A production well is drilled using a series of rigs that descend through the different layers of earth below ground. The drilling rigs penetrate into the soil and rock below, creating a hole—or wellbore—from which eventually the CSG contractor can extract the gas from hundreds of meters under the surface. Built in multiple stages, each section of the well will be lined with steel casing and cemented before the next stage in drilling continues. The cement is similar to that used in buildings but is of a higher quality grade. This ensures that the different geological formations drilled through are isolated from the well and one another. A long section of pipe known as casing 31, through which the gas will be extracted, is then run into the wellbore from the surface. The cement is pumped into the well to form a barrier between the coal seams 14 and aquifers 10, 12 above or below the seam 14. This allows for the isolation of the flow of water and gas from the target coal seam 14.

Figure 7:
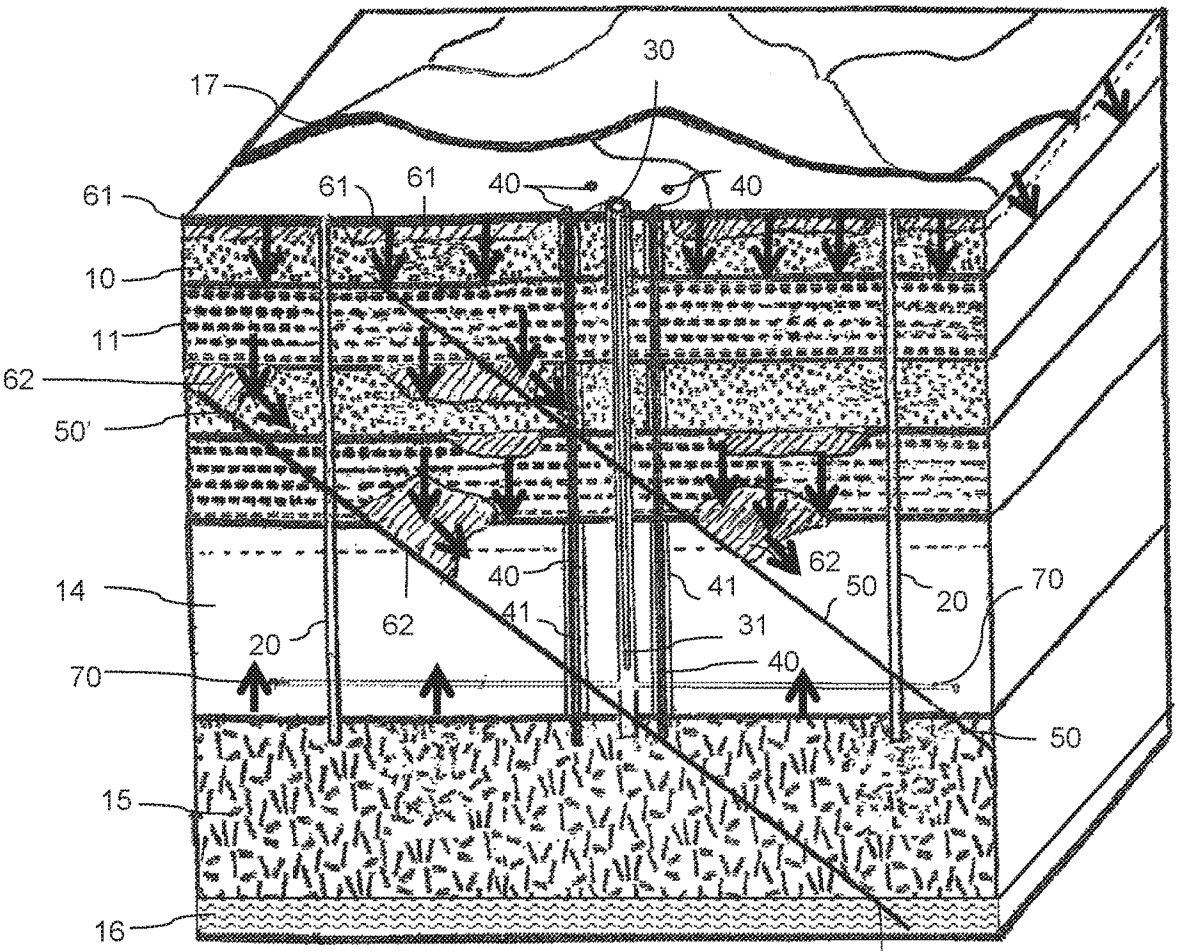
FIG. 7 illustrates the effect that the two fault lines have on the surrounding ground structures.

In order to gain better access the coal seam gas within the target coal seam 14, horizontal piping 70 is drilled using directional drilling tools and rigs as illustrated in FIG. 7. The nature of the gas bearing formation and to reduce the need for fracking horizontal piping is directed to the coal seam gas within the target coal seam 14. Directional drilling (or slant drilling) is the practice of drilling non-vertical wells. Directional drilling or directional boring, uses a steerable method of installing underground pipes, conduits and cables in a shallow arc along a prescribed bore path using a surface-launched drilling rig, with minimal impact on the surrounding area.

As shown in FIGS. 6 and 7 fault lines 50, 50' can cause subsidence and in particular compaction of the surrounding aquifers 10 and 12. The fault lines 50, 50' can cause the movement of the underlying ground formations 62 as illustrated in FIG. 7. This is even more relevant when the oil or gas well 30 is fracked to improve the flow or pressure of the gas or oil from the well 30. Due to the nature of the aquifers 10, 12 and the dewatering process the aquifers are compressed as shown by reference number 61.

As an optional method the present system also provides for the further strengthening of the oil or gas production well 30. Strengthening the well bore 30 can be effected either by using particulate-based or chemical-based lost circulation material (LCM). Typically the wellbore strengthening treatment incorporates particulate or chemical-based lost-circulation material (LCM) and comprehensive pre-drill planning to assist with the problems associated with hole instability. Particulate-based solutions include large, granular, and tough materials such as sized marble and carbon-based products. Chemical-based solutions include some new experimental systems using resins and cross-linked polymers. In contrast to permeable formations, impermeable rocks do not permit leak-off, so there is significant risk that anything placed in the fracture will be pushed out again by the trapped fluid pressure as the fracture closes after treatment pressure is removed. Consequently, chemical-based treatments have been developed that set or cure in situ to form immobile, impermeable fracture plugs.

A major concern about CSG production is the potential impact on natural resources. By conventional mining, the withdrawal of pore fluid and gas extraction causes changes in the natural water regime. CSG production is typically located at between about 200-1000 m depth, so that shallow aquifers 10, 12 and natural hydraulic structures can be affected. Subsidence may change the natural connection between aquifers 10, 12, but it may also induce new connections between geological structures as a consequence of an uncontrolled fracturing process. Changes in the ground water table may cause additional and unexpected compaction, or even collapse, if old underground workings or natural sinkholes are present in the area of influence. As ground fluid is pumped out, the pore fluid pressure decreases and leads to the compaction of the coal seam 14. The compaction is due to the release of the methane from the micro-pores and the associated drainage of water from the cleat system (macro-porosity).

Figure 8:
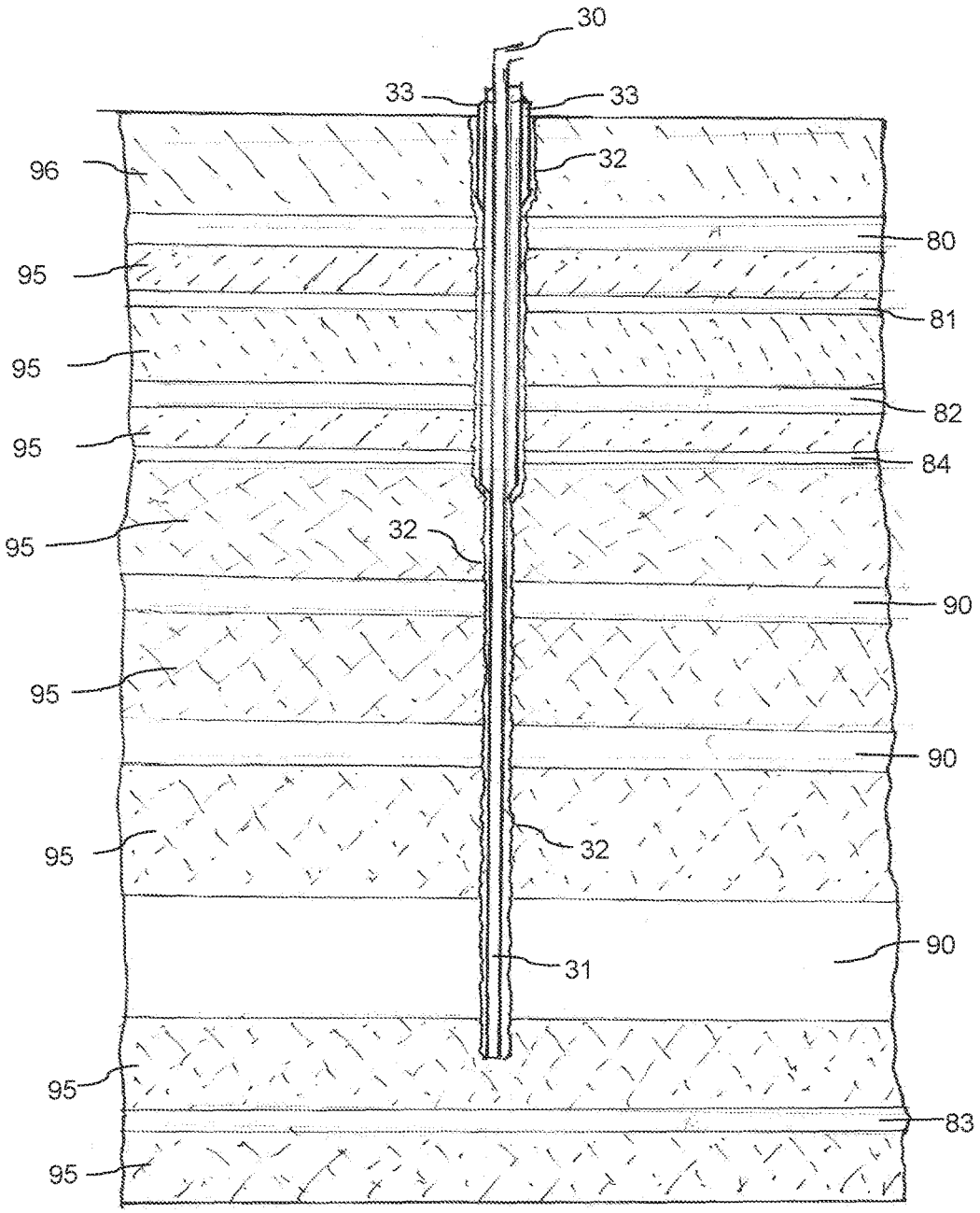
FIG. 8 shows a typical gas well and the geological layout of the different layers located around the well bore beneath the ground surface.
Figure 9:
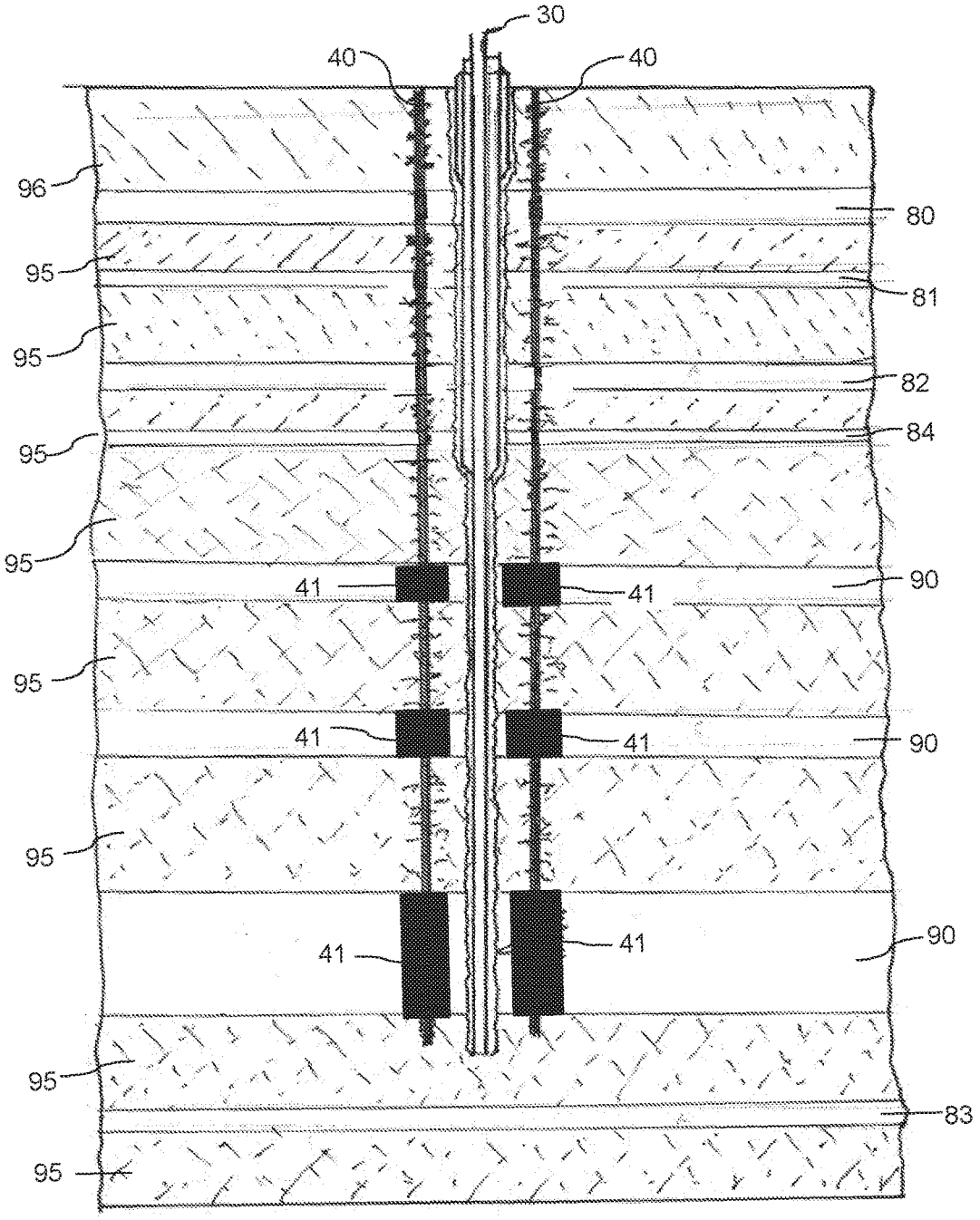
FIG. 9 illustrates the gas well of FIG. 8 with two stabilising columns located around the well bore in accordance with an embodiment of the present invention.
Figure 10:
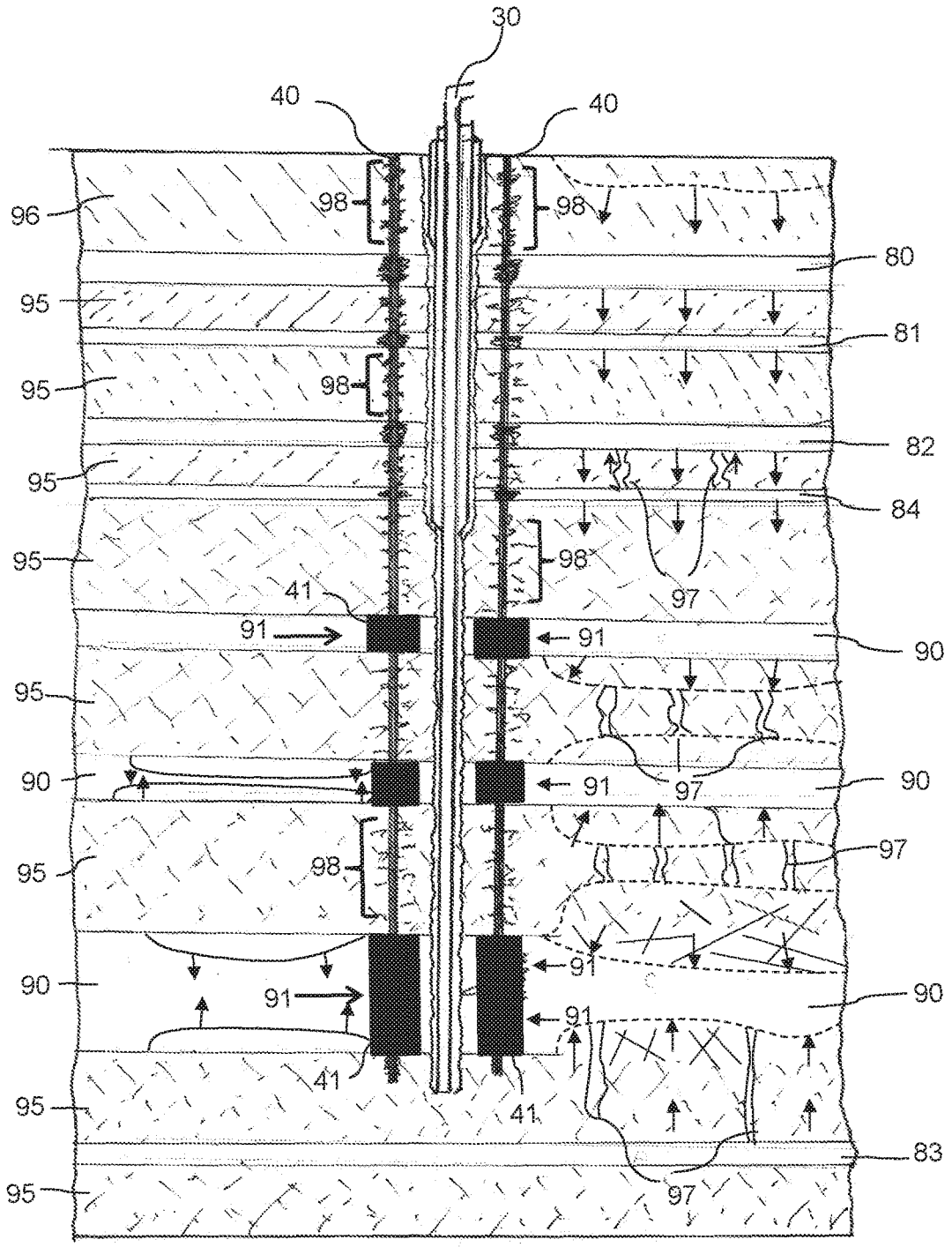
FIG. 10 illustrates the gas well and integrity protection system of FIG. 9 further showing the forces present on the different layers surrounding the gas well.

FIGS. 8 to 10 illustrate a different subterranean structure with an oil or gas well 30 and surrounding stabilising columns 40. While not shown the monitoring wells 20 are also utilised as described above with reference to FIGS. 3 to 7. The well 30 is drilled through the subterranean formations down to the target gas zones 90 and into the underlying cap rock 95 below the target gas zone 90. The well 30 comprises a steel production casing 31 through which the oil or gas will be extracted. The production casing 31 is surrounded by a cement fill 32 and surface concrete casing 33. The subterranean structure includes a shallow aquifer 80, aquifers 81, 82, a salty aquifer 84 and a deep aquifer 83. Compact coal seams 90 are identified which contain coal seam gas. The coal seam gas is made up primarily of methane gas and is found in the coal seams 90 at depths of 200 m-1000 m underground. Surrounding the coal seams 90 and the aquifers 80, 81, 82, 83 and 84 and rock formations 95 and soil 96. Typically these formations include an aquiclude (or aquifuge), which is a solid, impermeable area underlying or overlying an aquifer. The aquiclude is usually formed from a solid rock formation or impermeable material.

The stabilising columns 40 are located either side of the oil or gas well 30 as shown in FIGS. 9 and 10. The stabilising columns 40 include undercut sections 41 which increase the diameter of the bore in the target gas zones 90 which increases the support strength when the stabilising column 40 is filled with concrete, thus reducing the possibility of roof collapse near the production well 30 due to compaction of the gas zones 90 and the aquifers due to the effects of dewatering or gas removal. The forces involved under the ground are illustrated in FIG. 10 along with the flow of the gas 91. When the dewatering or gas removal occurs fracturing 97 between aquifers and rock formations occur thus producing cross contamination of aquifers with methane gas or even other materials such as radon which could make their way to the surface. Also illustrated are the cracks 98 in the formations surrounding the stabilising columns 40 which occur when the stabilising column bores are fracked prior to being filled with concrete. This provides further strength to the stabilising column 40.

Figure 11:
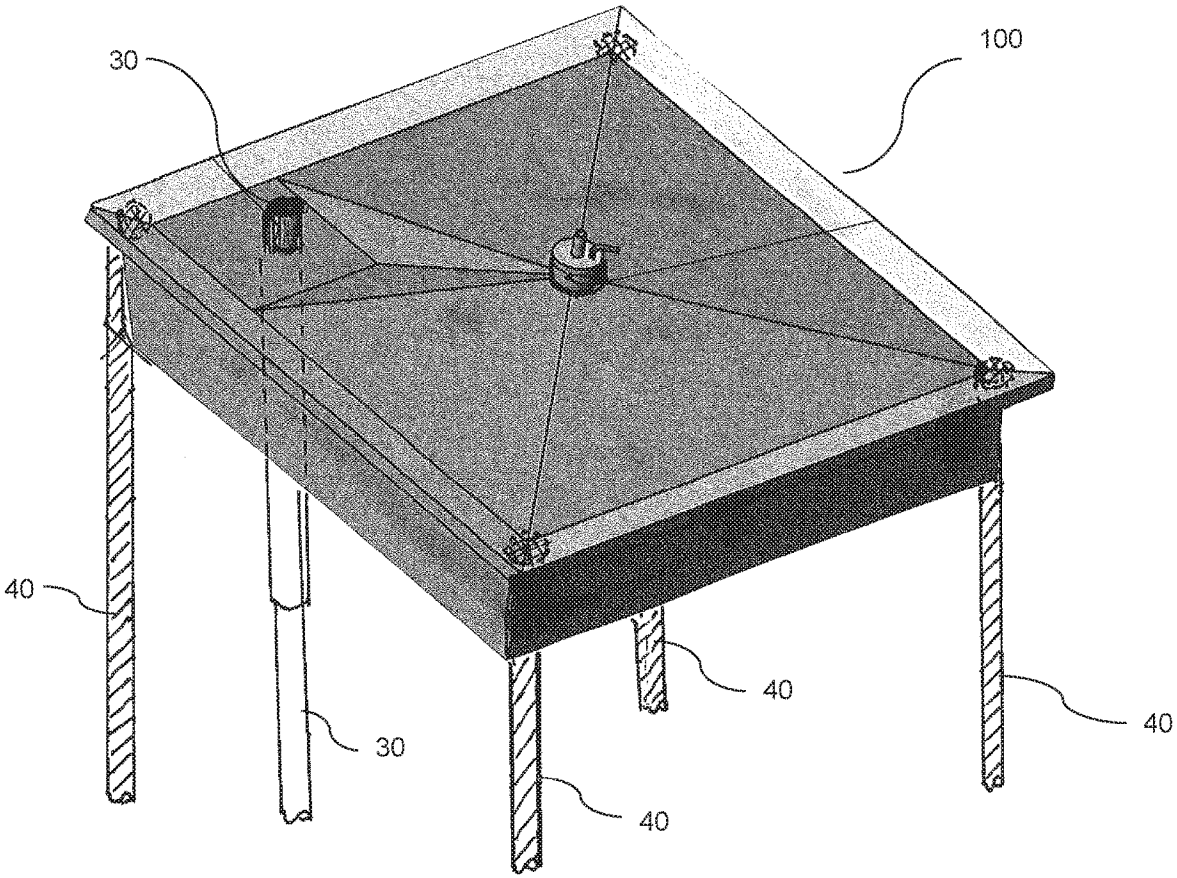
FIG. 11 illustrates a schematic of an oil or gas well with stabilising columns located at each corner of a surface detection and collection system in accordance with an embodiment of the present invention.
Figure 12:
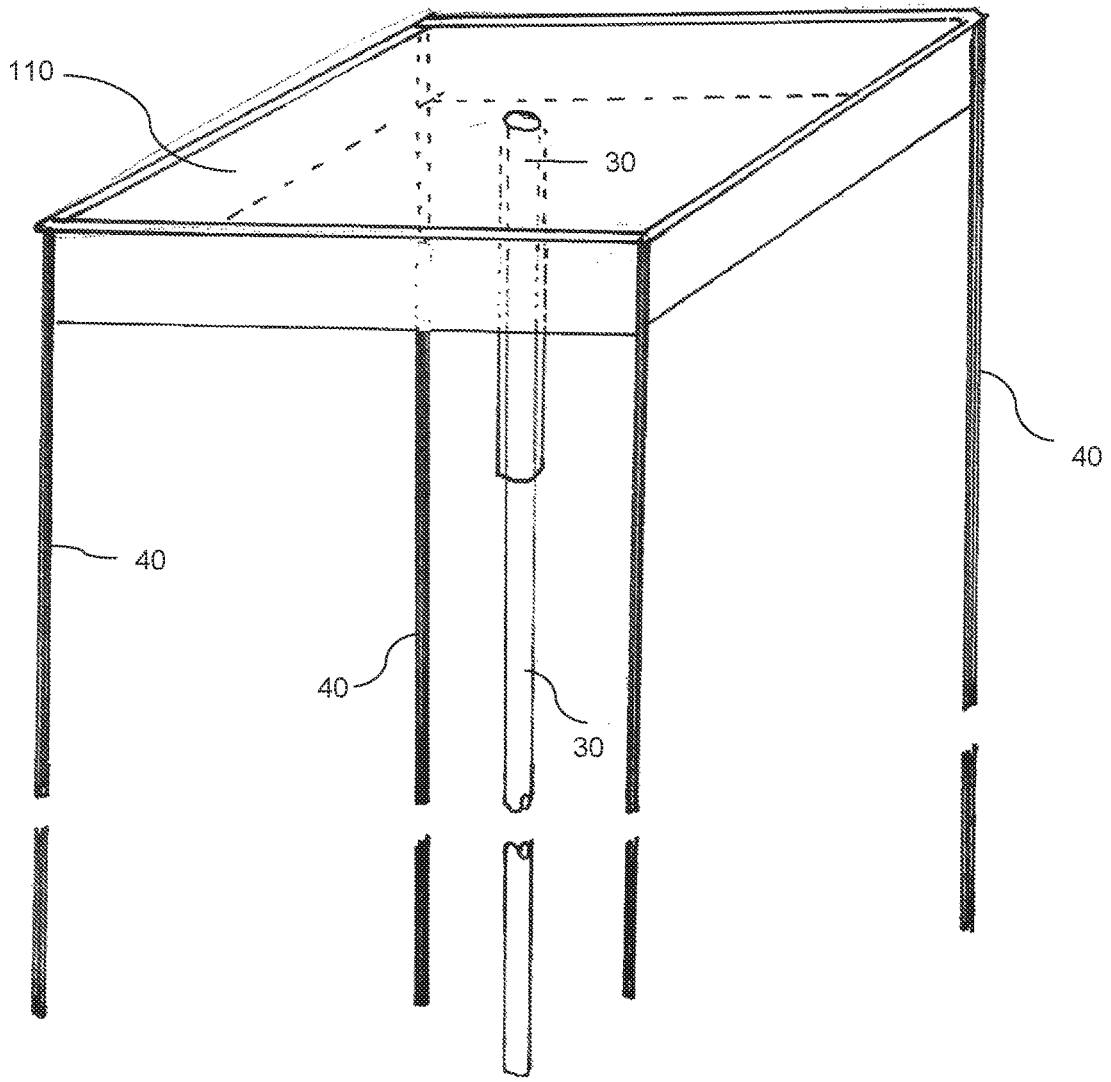
FIG. 12 illustrates a schematic view of an integrity system with four stabilising columns spaced equally around a gas or oil well located within the surface detection and collection system in accordance with an embodiment of the present invention.
Figure 13:
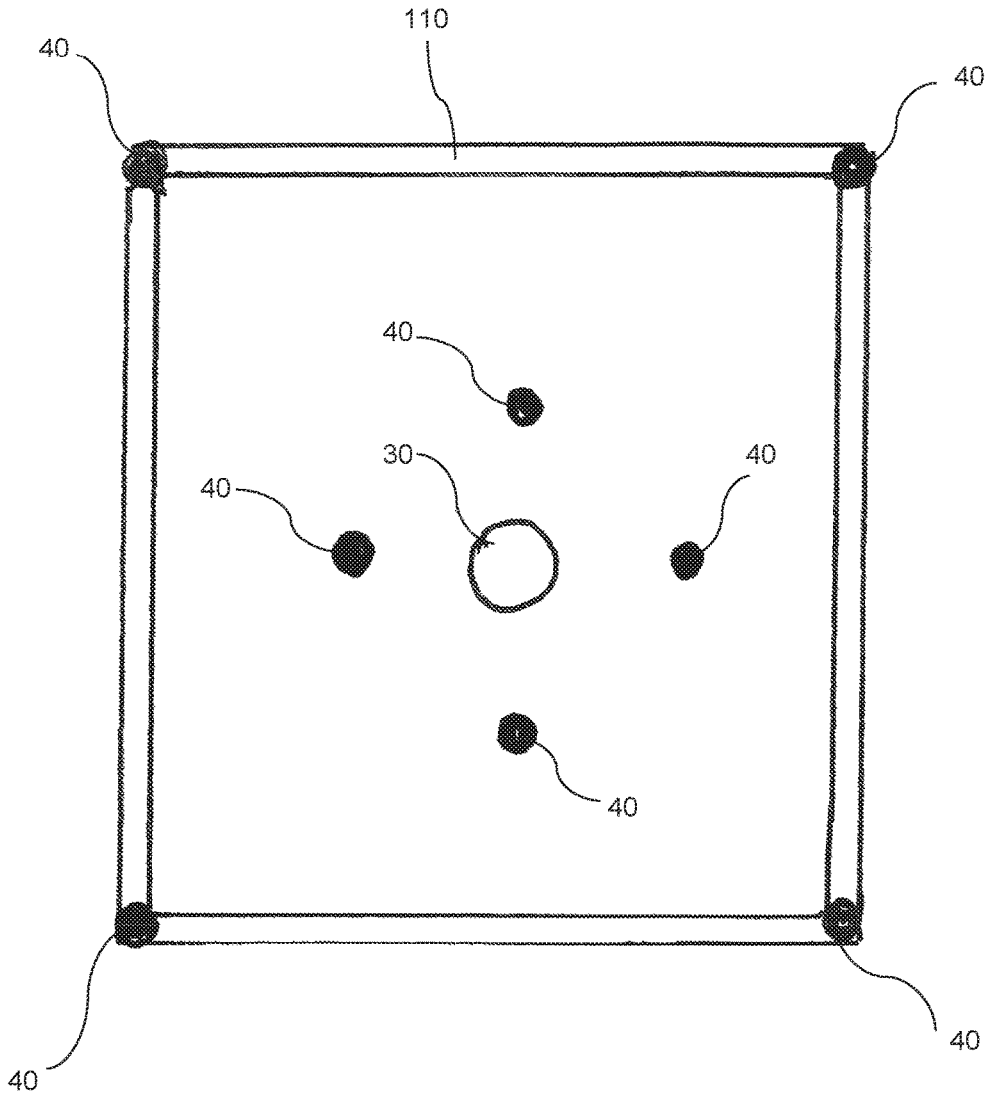
FIG. 13 shows a top view of the integrity system of FIG. 12 with additional stabilising columns shown around the production well.
Figure 14:
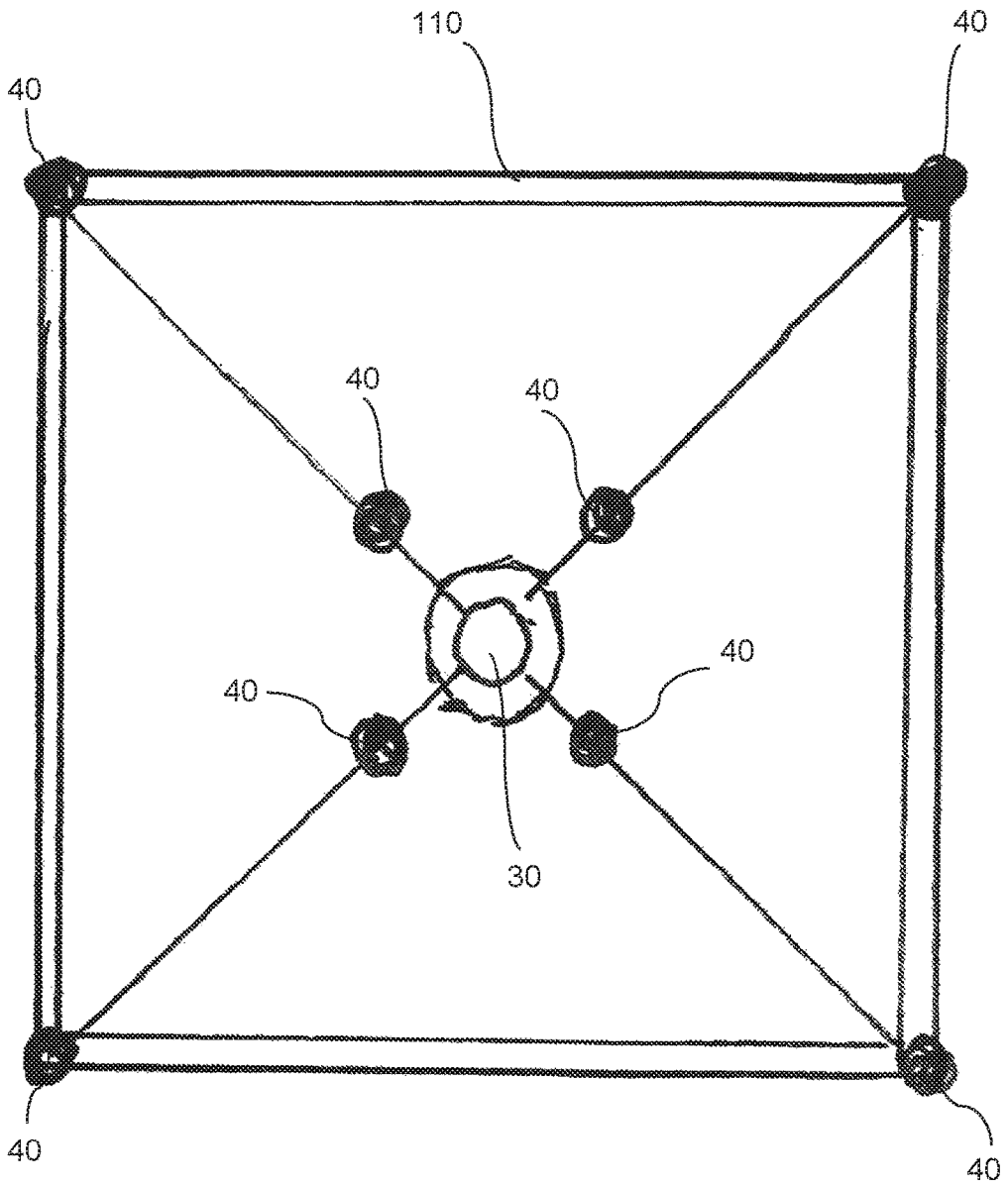
FIG. 14 shows another top view of the well and integrity protection system of FIG. 13.

FIGS. 11 to 14 show the stabilising columns 40 installed at the corners of the surface Detection and Collection System 100 for detecting and collecting fugitive gases and effluent liquids leaking from around oil or gas well 30. As shown in FIG. 11 the oil or gas well 30 may be installed offset from the middle of the surface detection and collection system 100 or as shown in FIGS. 12 to 14 the oil or gas well is installed in the centre of the surface detection and collection system 110. FIGS. 13 and 14 also show the additional stabilising columns 40 installed around the oil or gas well 30.

FIG. 15 illustrates an exemplary representation of a section of a stabilising column 40. As described above the stabilising column 40 includes a concrete composition 44 which is a mix of Portland cement with reinforcing additives incorporated to maximise strength. Additional flexibility can be achieved with the addition of latex additives. The reinforcing compounds used are nanoparticles and carbon nanotubes. Further additional structural strength can be achieved with the addition of fibres comprising either steel or fibreglass or any suitable material. To provide even further structural strength high tensile reinforcing cables 42 can be installed and run coaxially along the stabilising column 40. The reinforcing cable 42 is installed using a sacrificial polypipe 56 with the high tensile cable 42 mounted on the outside of the polypipe 56. The high tensile cable 42 can be mounted and supported on the polypipe 56 using cable ties 57 or any similar device which will hold the reinforcing cable 42 in place while the stabilising column 40 is cemented in place. A locating calibrated resistance wire 43 can also be installed in the stabilising columns 40 before being filled with concrete. This will help establish where a future break or fracture of the stabilising column 40 has occurred due to target zone 14 subsidence. A number of other sensors can also be installed to monitor gas or fluid leakage from around the wellhead 30.

When the high strength cable reinforcement is used the stabilising column 40 is constructed as follows. The polypipe 56 fitted with the high tensile reinforcement cables 42 is fitted with a duck bill anchor at the bottom of the hole attached with a "fanner grip". The duck bill is designed to rotate sideways and lock into the base of the column allowing tension to be applied to the polypipe 56 and cable 42 from the ground surface. Filling of the stabilising columns 40 with concrete can be done by the tube drilling hose being withdrawn as the hole is filled with cement. As described above the reinforcement cable 42 is installed using a sacrificial polypipe 56 with the high tensile cable 42 mounted using cable ties 57 on the outside of the polypipe 56. A central locating jig (not shown) may be attached to the cables 42 which does not interfere with the cement filling process. Alternatively an in situ pipe (1½ inch polypipe or similar) can be inserted into the borehole with the cable 42 attached to the pipe. The poly pipe can remain in place following the cementing of the stabilising column 40, this will create additional reinforcement strength.

Concrete is a brittle material with a cement paste binder having a pore structure that contains micro particles (<2 nm in diameter) and fine mesoporosity (2-50 nm). Depending on its constituents, it can be very strong in compression (>200 MPa ultimate strength), but is generally weak in tension and flexure. It also has relatively low fracture toughness. A pure mixture of Portland cement has been used as a slurry sealant and well bore strengtheners between the drilled rock surface and the bore casing. The pure Portland cement has been limited both in terms of preventing local cracking in the concrete matrix and in allowing the design of structures capable of dealing with high flexural loadings.

Fibre reinforcements have been used in concrete to try to overcome the limitation of tensional strength of the concrete. With typical lengths in the range of 1-10 centimeters and diameters from 0.1 to 1 mm, commercially available fibres increase flexural strength. They also interrupt crack propagation much more quickly than do standard reinforcing methods, which should improve the fracture toughness of the material. The use of carbon nanotubes (CNT) as a reinforcing material is intended to move the reinforcing behaviour from the macroscopic to the nanoscopic level. In addition to the well-known advantages of these materials as reinforcements, which include extremely high strengths and Young's moduli, elastic behaviour in the mesoporous environment of concrete, nanoscale reinforcements hold the potential to act as fillers, producing denser materials, inhibit crack growth at very early times, preventing propagation, and enhance quality of the paste-aggregate interface. As a result, much stronger and tougher concretes may be possible when made as a CNT composite.

Figure 16:
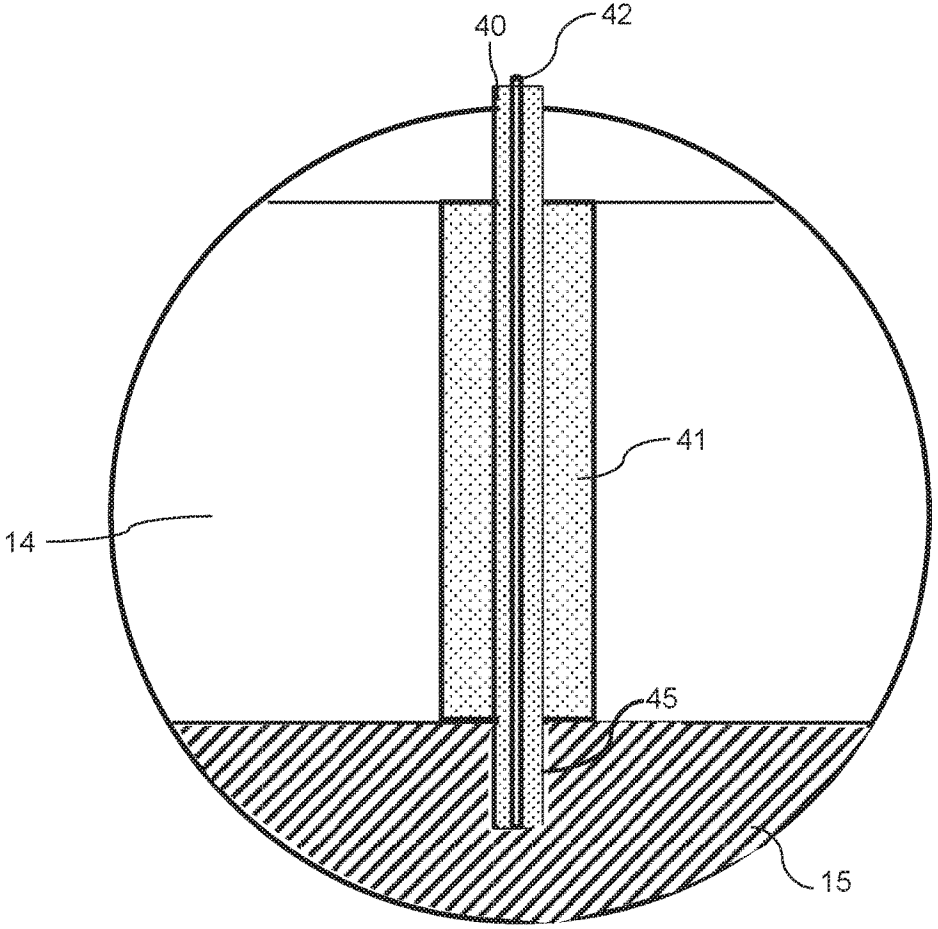
FIG. 16 illustrates the reinforcing of a stabilizing column into the cap rock below a target oil or gas zone in accordance with the present invention.

FIG. 16 illustrates the underpinning 45 of a stabilising column 40 into the base cap rock 15 below a target oil or gas zone 14. In FIG. 16 the underpinning 45 is achieved by either drilling or keying a hole in the base cap rock 15. However, any shape can be achieved dependent upon the drilling or keying bit used. Once drilled the underpinning section is filled with a structural compound, such as Portland cement or reinforced Portland cement to further stabilise the stabilising column 40. Likewise the underpinned section 45 can be further reinforced in a similar manner as previously described.

The use of substantially vertical or horizontal wells has associated advantages and drawbacks. A direct comparison is sometimes difficult because the volumes of coal affected are not equivalent in both cases. Differences would not be exclusively due to different geometries between vertical and horizontal wells, but also due to the different perforation and stimulation techniques. The following three scenarios are analysed here by assuming the same volume of coal:

(a) Effectiveness of the stimulation procedure;

(b) Single vertical vs horizontal well; and (c) Multiple wells.

In the first case, the subsidence potential is highly dependent on how effective the stimulation of the coal seam is controlled. As discussed above, the performance of hydraulic fracturing and multi-directional drilling processes in coal seams is site-dependent, so that a general quantification of their effectiveness is not possible. For the same volume of coal to be "affected", horizontal drilling seems to give, at least in theory, more satisfactory results if no issues are encountered during the drilling of the horizontal wells. In both vertical and horizontal wells the subsidence bowl is expected to be aligned according to the direction of the cleat system which controls the permeability of the coal seam. A detailed geophysical characterisation should be employed to define the direction of the "stimulation" technique and, in this way, to predict the preferential alignment of the subsidence bowl.

In the second case, a proper comparison of the potential subsidence between a single vertical and a horizontal well should be made based on the assumption of a constant pumping rate in both wells. A horizontal well allows higher rates of production due to its large surface area in contact with the coal seam (assuming the same volume of coal in both cases). Therefore, a horizontal well will tend to reach the maximum settlement and compaction early. There are differences between the effects of short-term and long-term subsidence on infrastructure. In the short-term, larger horizontal displacements (leading to cracking) may be developed in infrastructure located near the inflexion point of the subsidence bowl. In the long-term the rate of horizontal displacement at the same location will be lower due to the expansion of the subsidence bowl. Of course, the rate of expansion of the subsidence bowl will depend upon the rate of gas extraction. High rates of dewatering will result in accelerated rates of settlement and compaction resulting in enhanced subsidence around the target coal seam.

In the third case, the adoption of multiple wells, in both vertical and horizontal configurations, will enlarge the volume or soil prone to settlement. Thus, the impacts on natural resources, such as aquifers and rivers, as well as infrastructure (such as CSG wells) will increase. A complex and possibly non-symmetrical subsidence bowl could be expected if multiple wells are involved. The magnitude of the subsidence caused by multiple wells and their impact on natural resources and infrastructure will depend on their configuration, including the possible overlapping (separation) between subsidence bowls. Despite the economic benefit of multiple wells, careful design is required to maximise gas production while at the same time minimising the subsidence which may affect other economic activities. Finally, given the typical life of any oil or gas well can be in advance of 30+ years all of the above issues need to be taken into context of not only at the time of preparing and drilling but over the entire life span of the oil or gas well.

Figure 17:
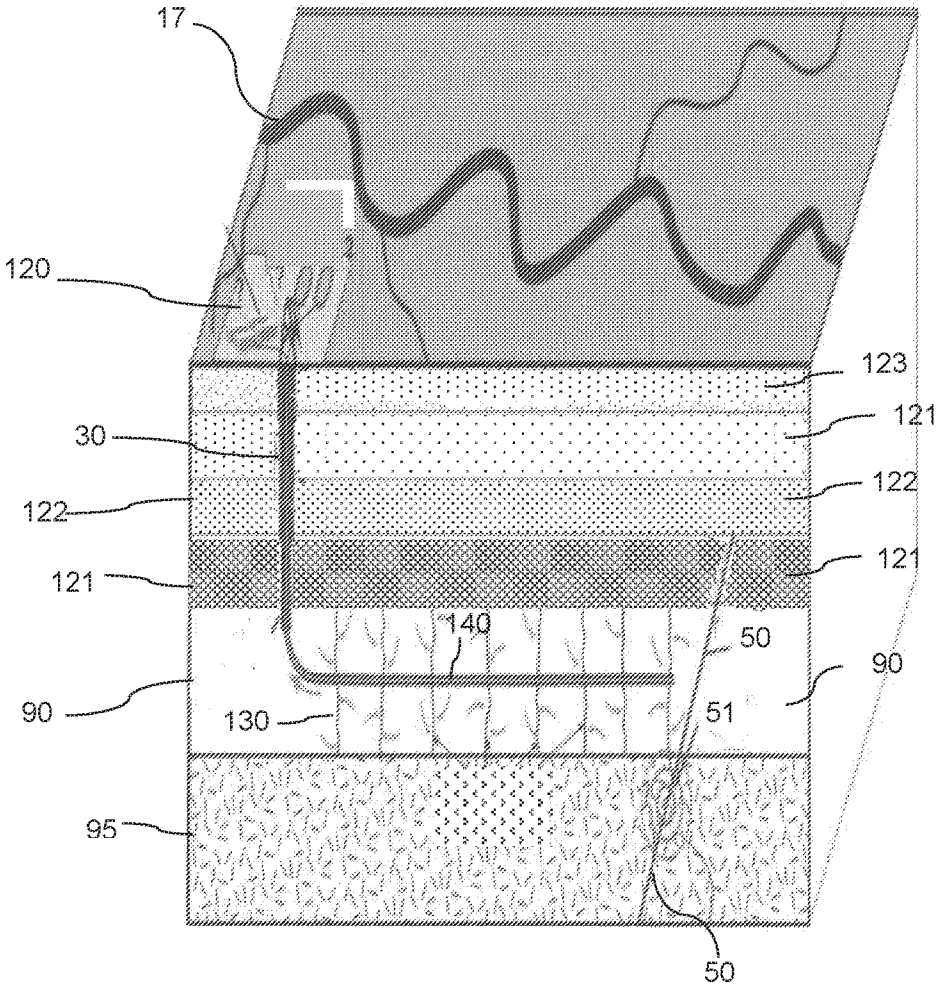
FIG. 17 illustrates a vertical and horizontal bore well showing a pre-existing fault, induced seismicity and the process of fracking and the potential for methane release to the atmosphere.
Figure 18:
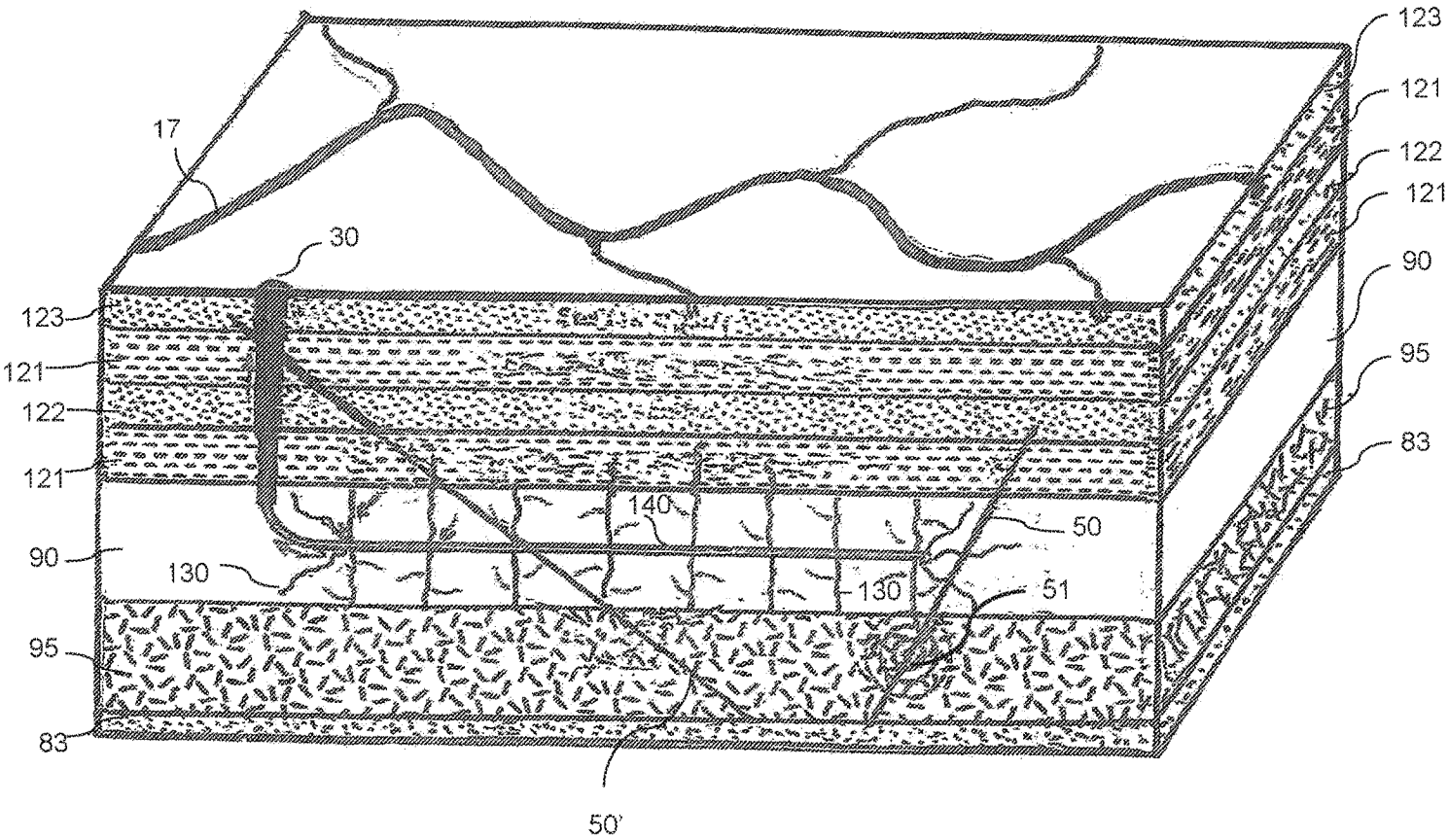
FIG. 18 illustrates a fault induced due to fracking in the well of FIG. 17.
Figure 19:
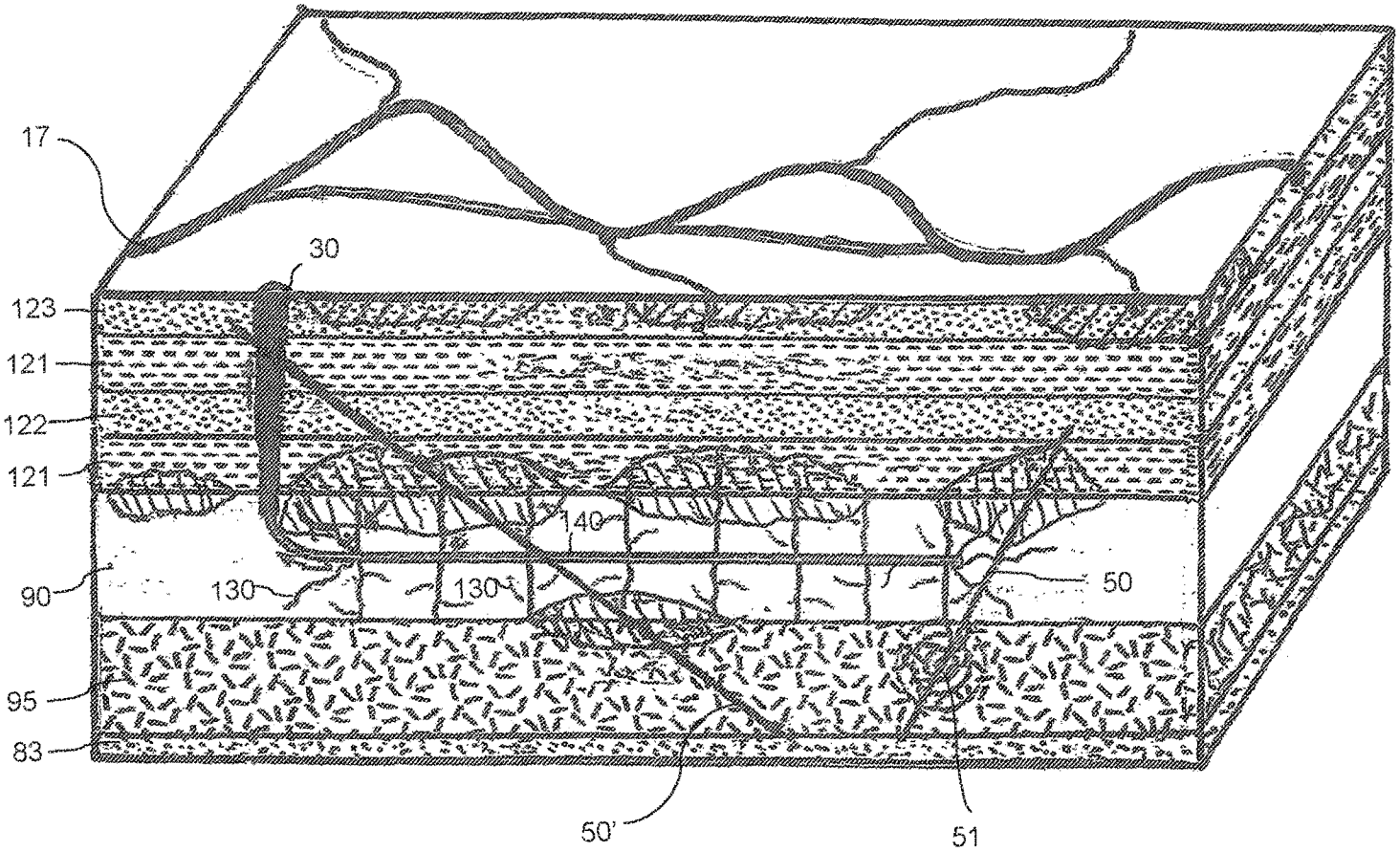
FIG. 19 shows the resultant effect on the underground structures and the forces present on the different layers of the subterranean formation.

FIGS. 17 to 19 show a third subterranean structure in which both substantially vertical and substantially horizontal well bores are utilised. As for all other structure the river or stream 17 is located at the surface along with the above ground structures 120 including fracking fluid and waste water ponds. The vertical well 30 is drilled through a shallow aquifer 123 and a deep aquifer 122 and aquicludes (impermeable layers) 121. The target gas zone or gas bearing formation 90 is located above a cap rock 95. A horizontal wellbore is drilled using a directional drilling rig and the horizontal well 140 is installed. Also illustrated in FIGS. 16 and 17 are a pre-exiting fault 50 and an induced seismicity 51.

Hydraulic fracturing is a well-stimulation technique in which rock is fractured by a hydraulically pressurised liquid. Some hydraulic fractures form naturally certain veins or dikes are examples. A high-pressure fluid (usually chemicals and sand suspended in water) is injected into a wellbore 30, 140 to create cracks 130 in the deep-rock formations through which natural gas, petroleum, and brine will flow more freely. When the hydraulic pressure is removed from the well 30, 140, small grains of hydraulic fracturing proppants (either sand or aluminium oxide) hold the fractures 130 open once the deep rock achieves geologic equilibrium. The hydraulic fracturing technique is commonly applied to wells for oil and coal seam gas to provide more flow paths to allow the methane gas or oil to expel from the coal seam or release oil or hydrocarbons from below the ground.

FIGS. 18 and 19 illustrate the subsidence that is induced by the dewatering or fracking of oil or gas wells 30. The original or pre-existing fault line 50 now includes the new fault line 50' which passes through both the vertical well 30 and the horizontal well 140 causing fractures in the well bores. Also the dewatering of the oil and gas wells causes the compaction of the aquifers as illustrated at the aquifer 123 in FIG. 19. The fracking of the oil or gas well causes the fracturing of the aquiclude layer 121 which can lead to the migration of methane gas from the target gas zone 90 into the surrounding layers including the aquifers 122, 123 and the salty aquifer 83.

The seismicity 51 or induced seismicity 51 refers to typically minor earthquakes and tremors that are caused by human activity that alters the stresses and strains on the Earth's crust. Most induced seismicity is of a low magnitude. Mining leaves voids that generally alter the balance of forces in the rock, many times causing rock bursts. These voids may collapse producing seismic waves and in some cases reactivate existing faults causing minor earthquakes. The changes in crustal stress patterns caused by the large scale extraction and reinjection of groundwater in oil or gas mining have been shown to trigger earthquakes or seismicity events 51. Re-injection requires treatment of injectant to be compatible with the aquifer so as not to clog injection wells and to prevent adverse changes in water quality in the aquifer.

Figure 20A:
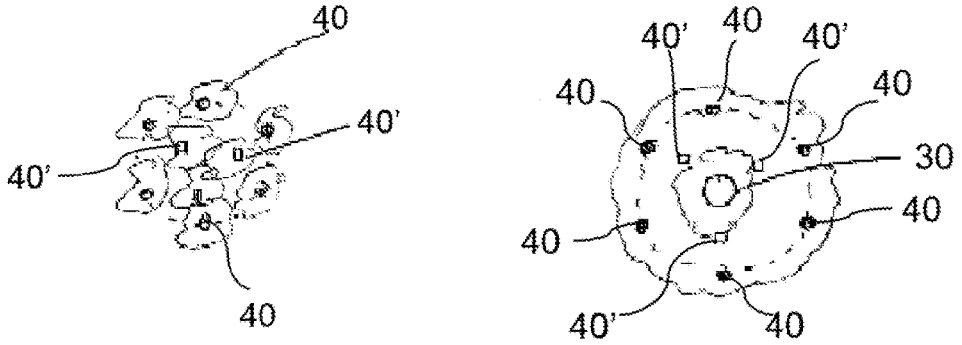
FIG. 20A shows a top view of a well with the integrity protection system installed around a gas or oil well.
Figure 20B:
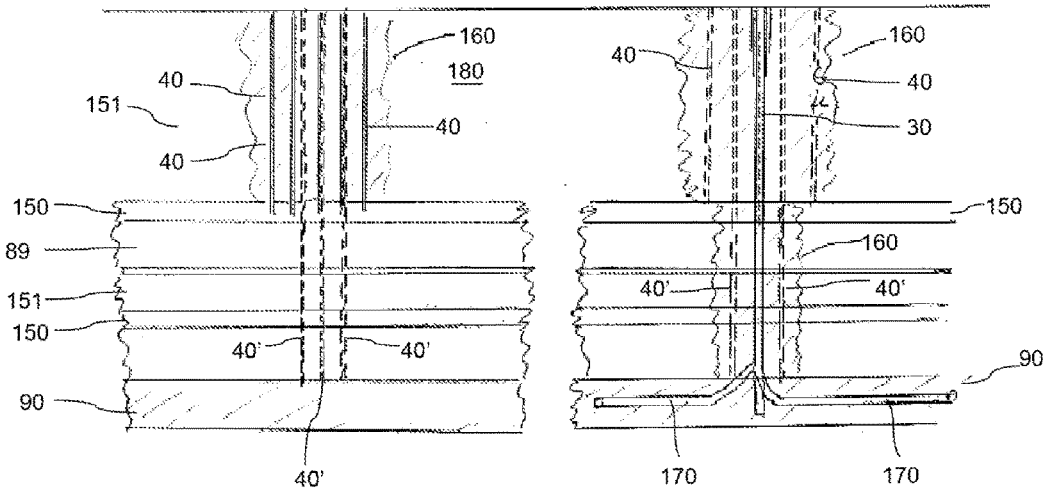
FIG. 20B shows an underground section view of the well with the integrity protection system of FIG. 20A installed and showing both vertical and horizontal boring.

FIGS. 20A and 20B shows a further embodiment of the present invention in which two types of stabilizing columns 40, 40' are used to stabilise the alluvial formations 180 and aquifers 89, 151 in an underground subterranean structure of an oil or gas well 30. A first column 40' which extends into the target gas zone 90, and a second column 40 which extends into an overlying cap rock 150. The structure of the subterranean layers includes sandstone layers 150, aquifers 89, 151, alluvials 180 and coal seam 90. Surrounding both columns 40, 40' is latex added Portland cement 160 which provides both flexibility and strengthening to stabilize the underground subterranean gas well. Also as mentioned above a horizontal drilling for lateral bores 170 is utilised in the coal seam 90 to better locate and remove the methane from the coal seam 90.

Figure 21:
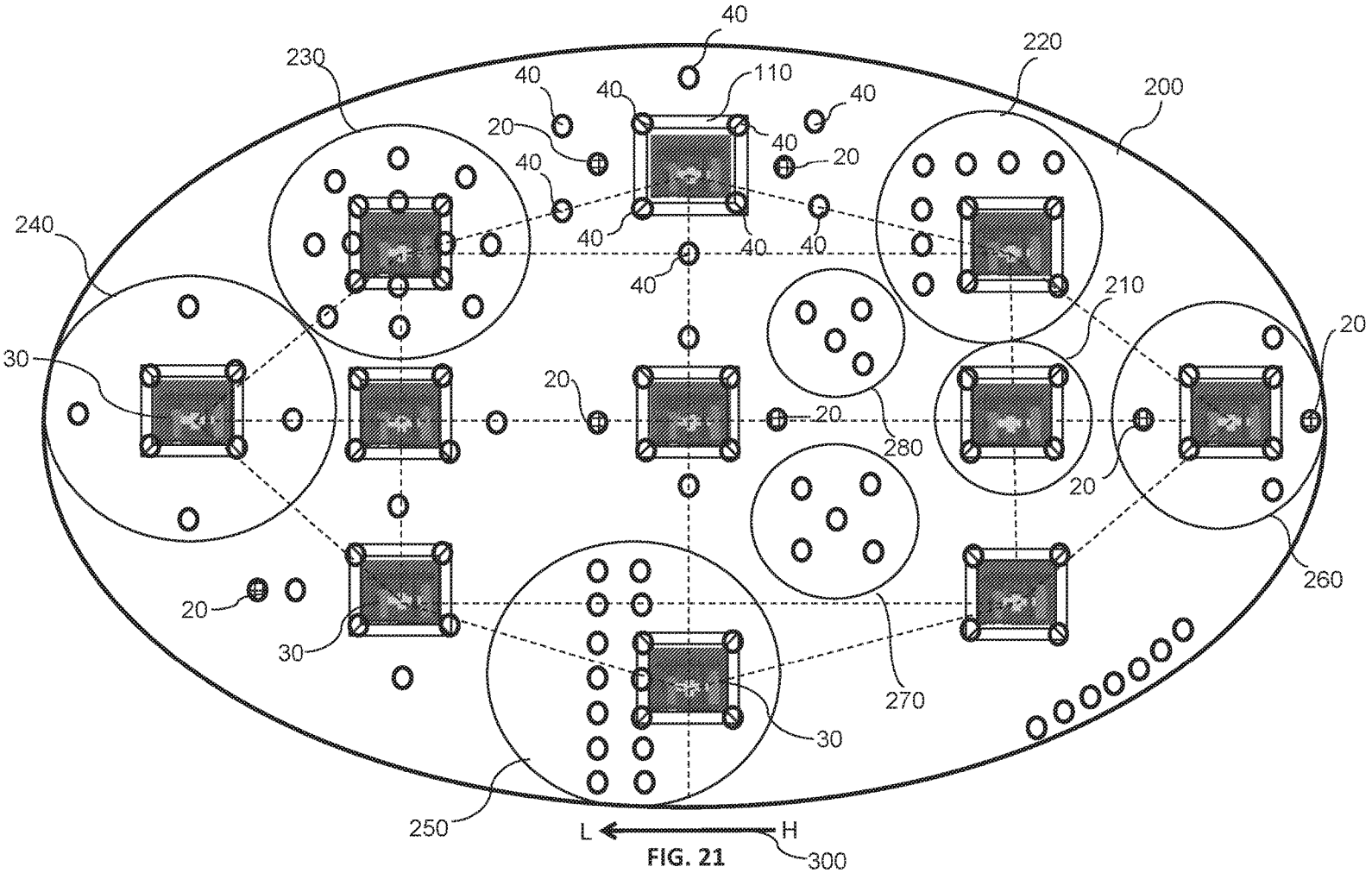
FIG. 21 illustrates an gas or oil field comprising multiple oil or gas wells and multiple stabilising columns in accordance with the present invention.

FIG. 21 illustrates a gas or oil field 200 with multiple oil or gas wells 30, monitoring wells 20 and multiple stabilising columns 40. As shown in FIG. 21 a number of configurations exist for the installation of stabilising columns 40, both around the production wellheads 30 and in-between adjacent production wellheads 30. Each wellhead can be located within a surface detection and collection system 110. The placement of stabilising columns 40 is determined by the seismic survey, the aeromagnetic survey and/or the core sample taken from the drilling of the monitoring wells 20. The placement of the stabilising columns 40 are designed to substantially mitigate the damage to the wellheads 30 by preventing cracking and fracturing caused by subsidence around the wellhead 30.

By way of example only the configuration of stabilising columns 40 are shown with reference to items 210 to 260 for locations situated around the wellheads 30. Also shown is the location of stabilising columns 40 between adjacent wellheads at items 270 and 280. The placement of the stabilizing columns 40 in between adjacent wellheads 30 will provide the effect of stabilising the general area of the gas field 200. The configuration and number of stabilising columns 40 is not limited to any particular shape or number. As discussed above the location and number of stabilising columns will largely be determined by the seismic survey, the aeromagnetic survey and/or the core sample taken from the drilling of the monitoring well(s) 20. Also illustrated at item 300 is the direction of flow of the aquifers from the high side to the low side. The likelihood that subsidence will occur in an oil or gas field 200 with stabilising columns 40 installed will be substantially mitigated. Therefore providing continued supply of oil or gas to the oil or gas operators for the expected life of the well and substantially overcoming the increased concerns for environmental factors.

Figure 22:
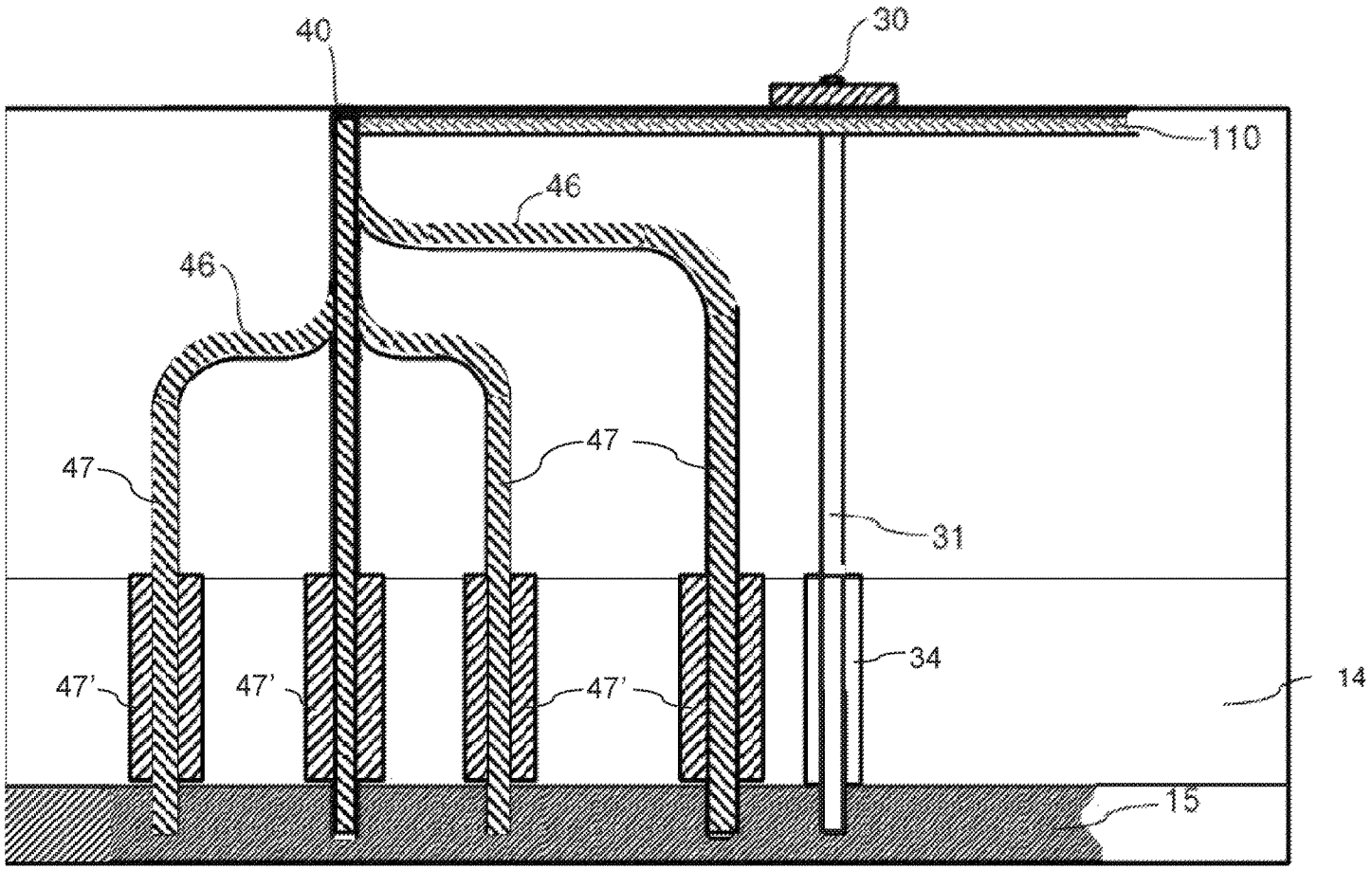
FIG. 22 shows an oil or gas well and field integrity system which includes both vertical and horizontal stabilising columns in accordance with an embodiment of the present invention.

FIG. 22 illustrates a further embodiment of an oil or gas well 30 with a well stem 31, an oil or gas chamber 34 and both vertical columns 40 with a combination of horizontal and vertical stabilising columns 46, 47. The stabilising columns 40 are inserted in the corners of the surface detection and collection system 110. A combination of substantially horizontal columns 46 with substantially vertical columns 47 are drilled and extend from the vertical stabilising column 40. Both the vertical column 40 and the vertical column 47 are underpinned into the cap rock 15 to provide additional stabilisation of the columns 40, 47. Typically the horizontal and vertical columns 46, 47 can be drilled using a direction drill bit. The vertical columns 40, 47 are undercut 47' in the target gas zone 14 to increase the diameter the column within the target gas zone 14. This effectively increases the support strength when the stabilising column is filled with reinforced Portland concrete, thus reducing the possibility of roof collapse near the oil or gas well due to compaction of the gas zone due to the effects of dewatering or gas removal.

Figure 23:
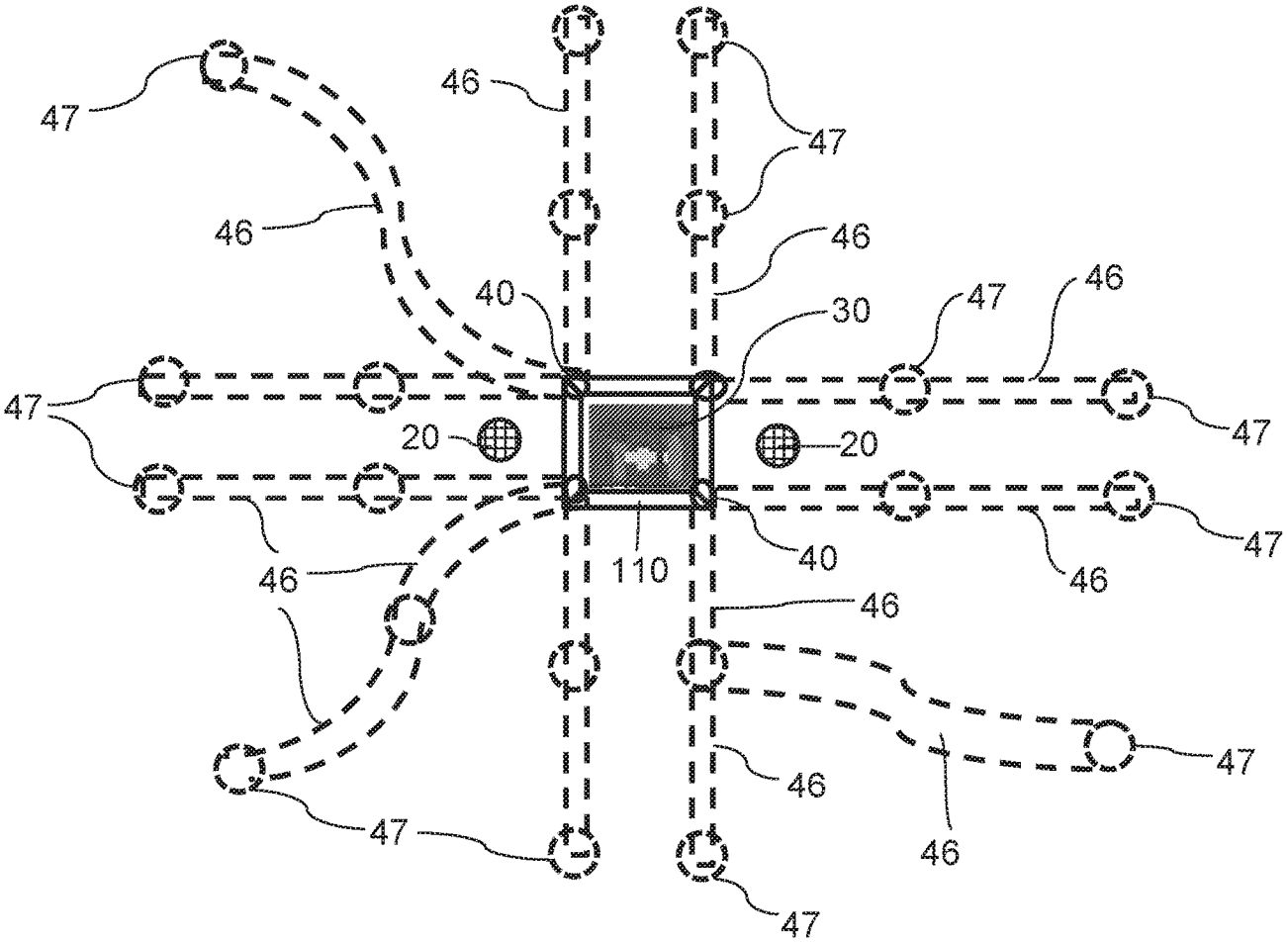
FIG. 23 illustrates a top view of an oil or gas well with a combination of both vertical and horizontal stabilising columns in accordance with an embodiment of the present invention.

FIG. 23 illustrates a plan view of an oil or gas field in which combinations of both substantially vertical and substantially horizontal stabilising columns 40, 46, 47 have been used to stabilise the subterranean structure beneath the ground to protect the oil or gas well 30. As above the placement of the stabilising columns 40, 46, 47 will be determined by a seismic survey, an aeromagnetic survey and/or a core sample taken from the monitoring well(s) 20. Subsidence will be largely mitigated by the inclusion of both vertical and horizontal columns to underpin the various subterranean formations below the Earth's surface.

Figure 24:
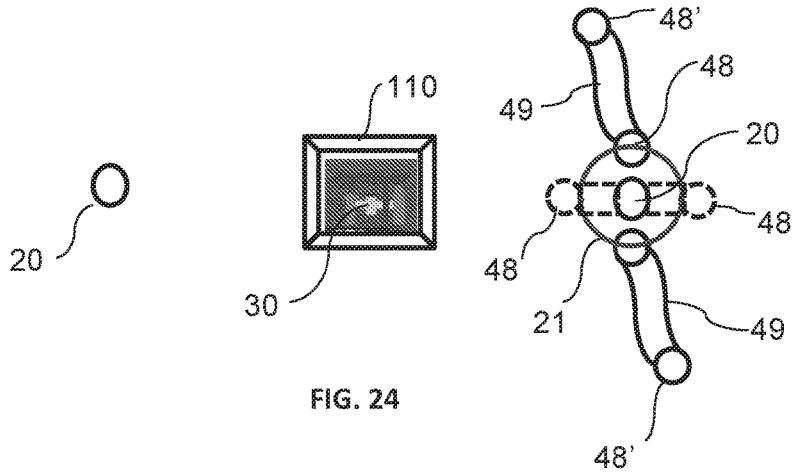
FIGS. 24 and 25 show top and side views of an oil or gas well and field integrity system which incorporates both vertical and horizontal stabilising columns with the monitoring well in accordance with an embodiment of the present invention.
Figure 25:
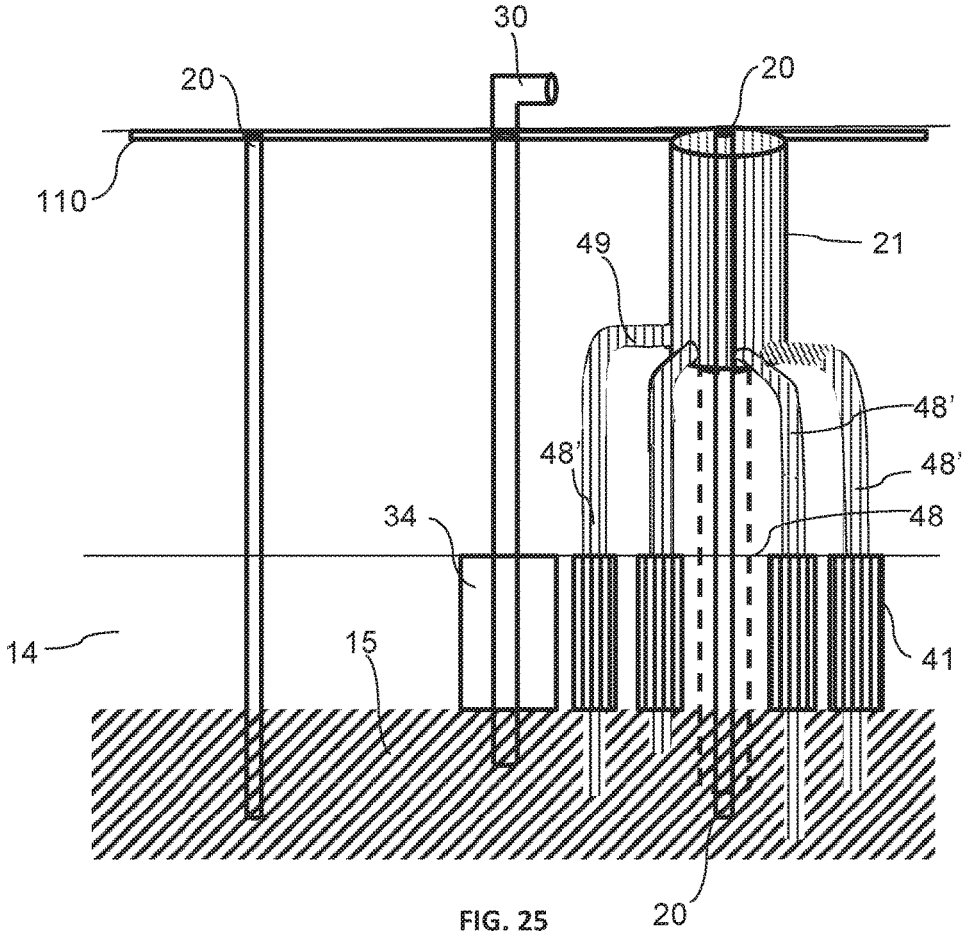

FIGS. 24 and 25 show a further embodiment of the present invention in which the stabilising columns 48, 48' are part of and branch or extend from the monitoring well and system 20 such that each stabilising column comprises a substantially vertical section 48, 48' that extends substantially parallel and spaced from the associated monitoring well 20. In this embodiment the monitoring well 20 is drilled at a larger diameter 21 to allow the directional drilling and placement of substantially vertical columns 48, 48' and substantially horizontal columns 49. This provides the stabilisation with only the requirement to drill and fill substantially one bore. Like all of the above embodiments the bores are filled with a structural compound or material, such as the combination of Portland cement and with nanoparticle, carbon nanotubes (additional fibre reinforcement may be deemed required for maximum strength of the column) and/or a reinforcing cable. The vertical columns 48 and 48' are undercut 41 in the target gas zone 14 for further reinforcement.

Figure 26:
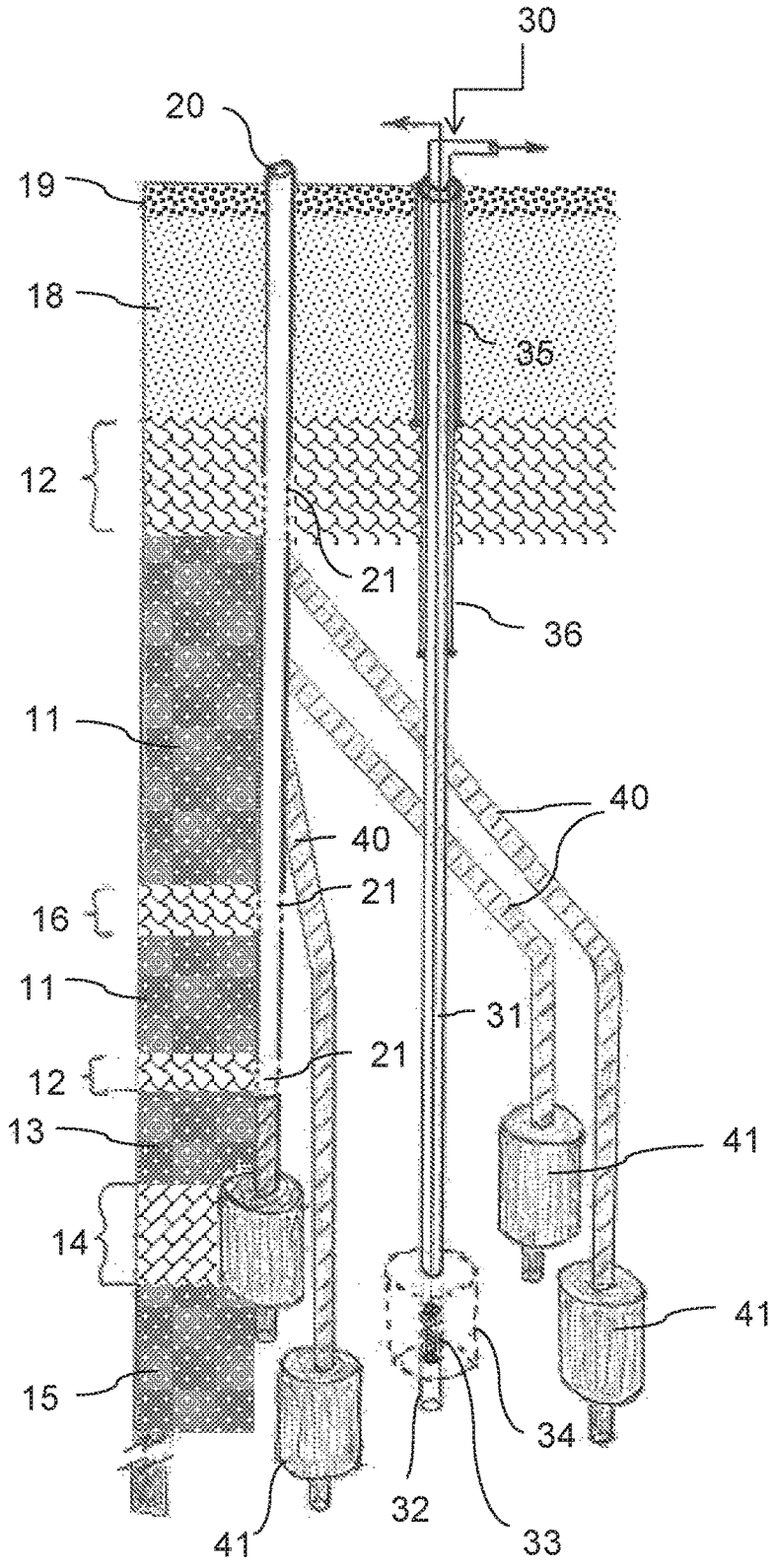
FIG. 26 illustrates a variation of the oil or gas well and field integrity system of FIGS. 24 and 25 which incorporates both vertical and horizontal stabilising columns with the monitoring well in accordance with an embodiment of the present invention.

FIG. 26 shows a further embodiment of the present invention similar to that as illustrated in FIGS. 24 and 25 in which the stabilising columns 40 are located in the subterranean structure and branch out from the same bore hole drilled for the monitoring well 20. The stabilising columns 40 are drilled using a directional drill and cemented in place in the same way as previously described. The stabilising columns 40 also show the undercut portion 41 of the columns 40 in the target gas zone 14 to effectively enhance the diameter of the stabilising column 40.

The monitoring well 20 drilled through the different strata formations including a top soil 19, sub soil 18 aquifers 12 and 16 and layers of cap rock 11, 13 and 15. In order to sample and detect contamination the monitoring well 20 is perforated 21 at each aquifer 12 and 16. The oil or gas well 30 includes a dewatering pump 33, an oil or gas chamber 34 and an oil or gas sump 32 located within the target oil or gas zone 14. Also illustrated in FIG. 26 is the production casing 31 or borehole casing which is typically a casing pipe that is assembled and inserted into a recently drilled section of a borehole and typically is held into place with cement and a surface casing 36. A conductor casing 35 is located around the top of the oil or gas well 30. The conductor casing 35 serves as a support during drilling operations, to flow back returns during drilling and cementing of the surface casing 36, and to prevent collapse of the loose soil near the surface. The purpose of surface casing 36 is to isolate freshwater zones or aquifer 12 so that they are not contaminated during drilling and completion. Surface casing 36 is the most strictly regulated due to these environmental concerns, which can include regulation of casing depth and cement quality. In this embodiment the stabilising columns may be formed at the same time as the respective monitoring well 20 is constructed.

Figure 27:
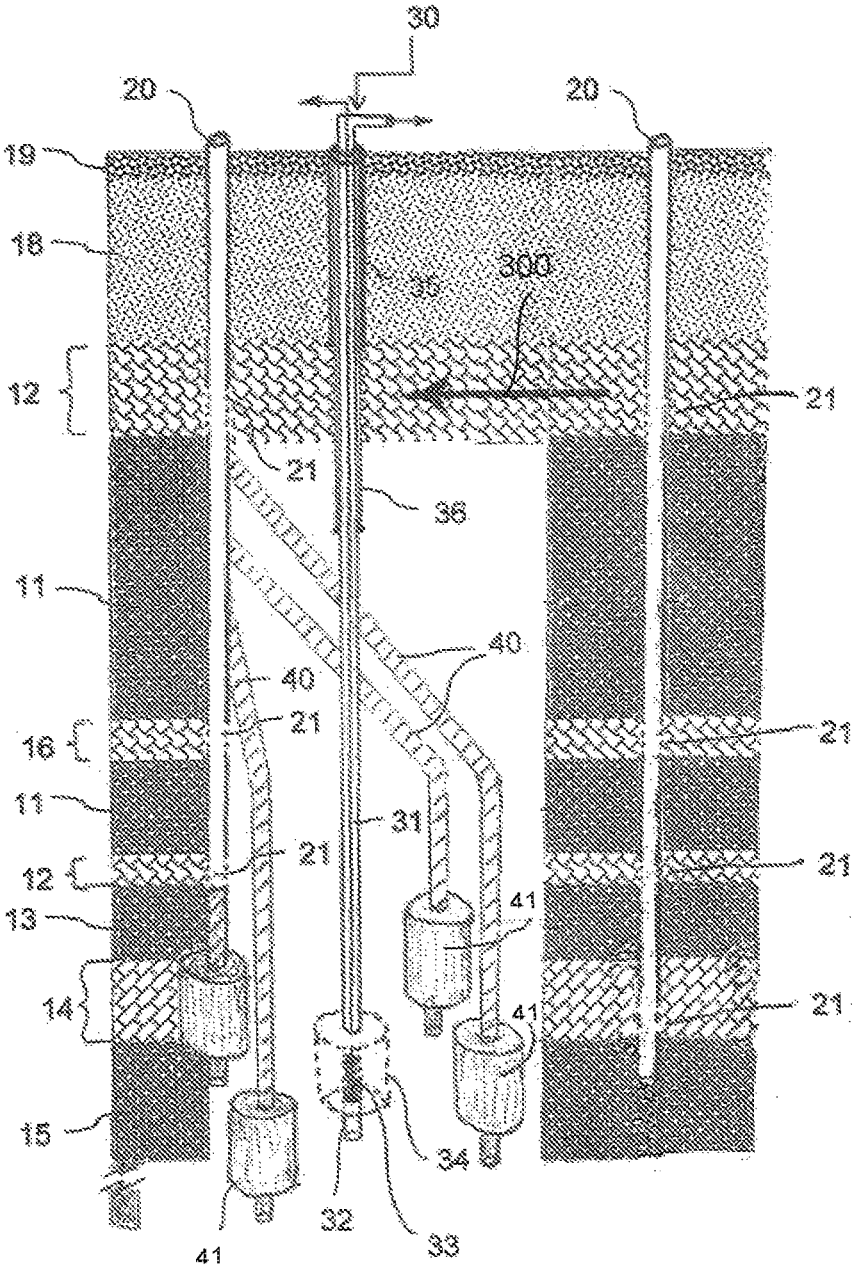
FIG. 27 illustrates a further variation of FIGS. 24 and 25 which incorporates both vertical and horizontal stabilising columns with a low side monitoring well and a further high side monitoring well in accordance with an embodiment of the present invention.

FIG. 27 is substantially the same as FIG. 26 however two monitoring wells 20 are shown on either side of the oil or gas well 30. The monitoring wells 20 are located on the high and low sides of the oil or gas well 30 and can be utilised to determine leaks in the gas well 30 or leaks from other oil or gas wells 30 located in close proximity to the present well 30. The direction of flow of the aquifers is shown by the arrow 300 going form the high to the low side of the well 30.

Figure 28:
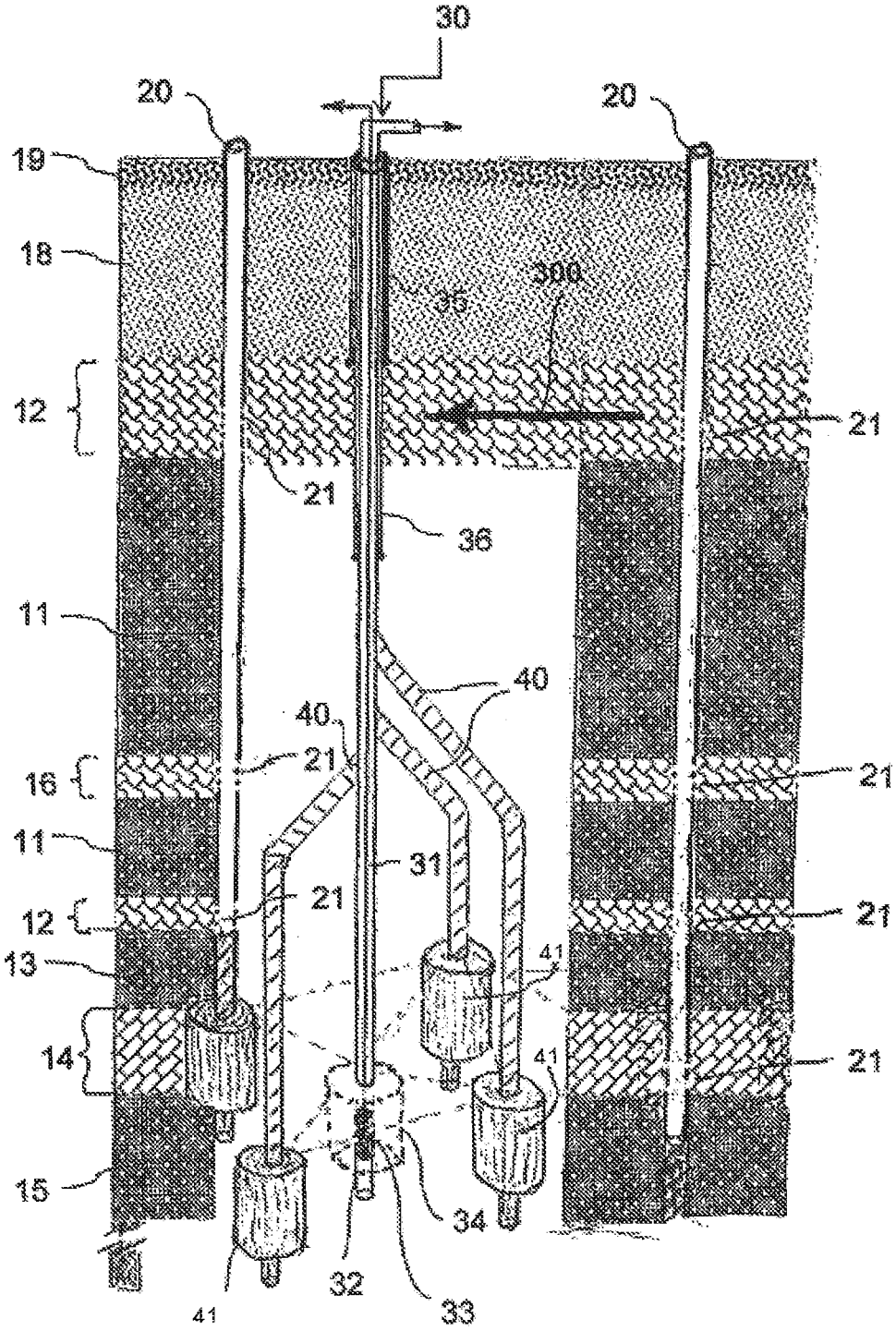
FIG. 28 illustrates a further variation of the present invention incorporating both vertical and horizontal stabilising columns with the production well, and low and high side monitoring wells on either side of the production well in accordance with an embodiment of the present invention.

FIG. 28 shows a further embodiment of the present invention similar to that as described above with reference to FIGS. 24, 25 and 26. FIG. 28 shows the stabilising columns 40 located in the subterranean structure adjacent a production well 30 and branching out or extending from the bore hole drilled for the production well 30 such that each stabilising column comprises a substantially vertical section that extends substantially parallel and spaced from the associated production well 30. The bore holes for the stabilising columns 40 are drilled using a directional drill and cemented in place at the same time as the production well 30 is drilled and constructed. The production well 30 and stabilising columns 40 are drilled and positioned as determined by the geographic survey in the form of either a seismic or aeromagnetic survey. Typically the process used is a standard process used in most oil or gas production wells 30. A production well 30 is drilled using a series of rigs that descend through the different layers of earth below ground. The drilling rigs penetrate into the soil and rock below, creating a hole—or wellbore—from which eventually the CSG contractor can extract the gas from hundreds of meters under the surface. Built in multiple stages, each section of the well 30 will be lined with steel casing and cemented before the next stage in drilling continues. A conductor casing 35 is located around the top of the oil or gas well 30. The conductor casing 35 serves as a support during drilling operations, to flow back returns during drilling and cementing of the surface casing 36, and to prevent collapse of the loose soil near the surface. The purpose of surface casing 36 is to isolate freshwater zones or aquifer 12 so that they are not contaminated during drilling and completion.

In order to place the stabilising columns 40 at positions identified around the production well 30 a directional drill bit is inserted into the wellbore for directional drilling. The use of drilling sensors and global positioning technology has made vast improvements in directional drilling technology. The angle of the drill bit is controlled with great accuracy through real-time technologies, providing the ability to produce wellbores at different angles to the production well 30. A directional drilling rig includes such tools as whipstocks, bottom hole assembly (BHA) configurations, three-dimensional measuring devices, mud motors and specialised drill bits. The drilling of the stabilising columns 40 also includes the undercutting 41 in the target coal zone 14 to increase the diameter of the column within the target coal zone 14. This effectively increases the support strength when the stabilising column 40 is filled with reinforced Portland concrete, thus reducing the possibility of roof collapse near the oil or gas well 30 due to compaction of the gas zone due to the effects of dewatering or gas removal. The stabilising column 40 is also underpinned 45 into the base cap rock 15 below a target coal zone 14. The underpinning 45 is achieved by either drilling or keying a hole in the base cap rock 15. However, any shape can be achieved dependent upon the drilling or keying bit used. Once drilled the underpinned section is filled with a structural compound, such as Portland cement or reinforced Portland cement to further stabilise the stabilising column 40. Likewise the underpinned section 45 can be further reinforced in a similar manner as previously described.

Once the stabilising columns 40 have been completed the production well 30 can then also be finalised in preparation for the supply of oil or gas. A long section of pipe known as casing 31 or production casing 31, through which the gas will be extracted, is then run into the wellbore from the surface. The cement is pumped into the well to form a barrier between the oil or coal seams 14 and aquifers 10, 12 above or below the seam 14. This allows for the isolation of the flow of water and oil or gas from the target oil or coal seam 14. The oil or gas well 30 includes a dewatering pump 33, oil or gas chamber 34 and an oil or gas sump 32 located within the target coal zone 14. In this embodiment the stabilising columns 40 may be formed at the same time as the respective production well 30 is constructed.

Figure 29:
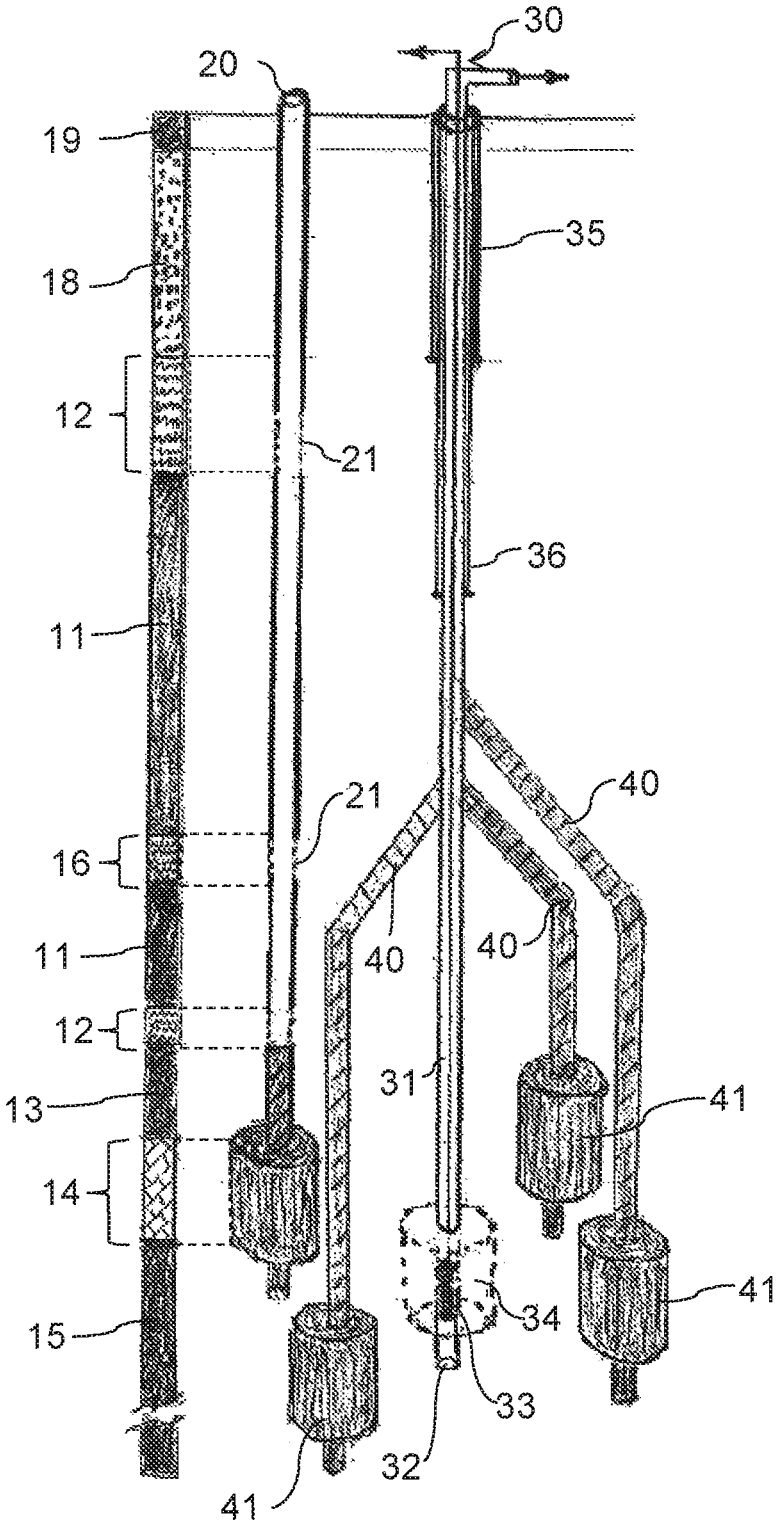
FIG. 29 shows a simplified FIG. 28 illustrating only the production well with stabilising columns and the low side monitoring well.

As previously described the monitoring wells 20 and production well 30 are drilled through the different strata formations including a top soil 19, sub soil 18 aquifers 12 and 16 and layers of cap rock 11, 13 and 15. In order to sample and detect contamination the monitoring well 20 is perforated 21 at each aquifer 12 and 16. FIG. 29 simply shows the production well 30 and the low side monitoring well 20 with the subterranean structures removed for clarity. FIG. 29 shows a clearer picture of the components of the stabilising columns 40 utilised to reduce the possibility of roof collapse near the oil or gas well 30 due to compaction of the gas zone due to the effects of dewatering or gas removal.

Figure 30A:
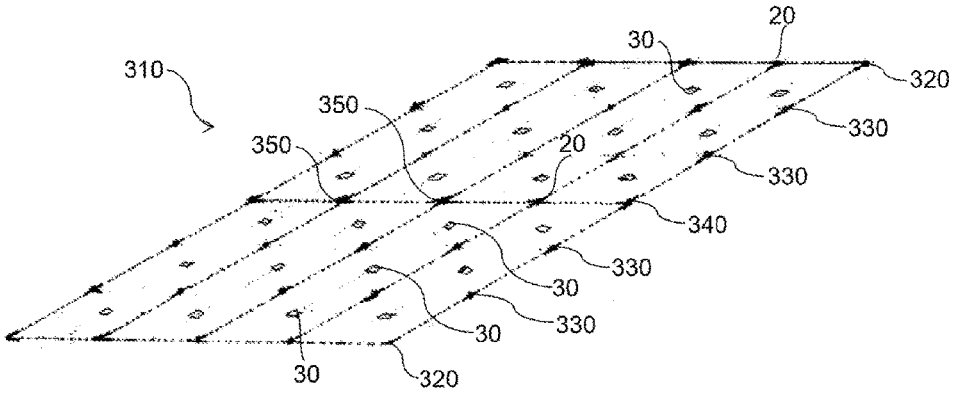
FIG. 30A illustrates the top view of an oil or gas field showing the location of production wells, monitoring wells and long wall fracking wells all with or without stabilizing columns both vertical and horizontal and a typical underground structure around the production wells.
Figure 30B:
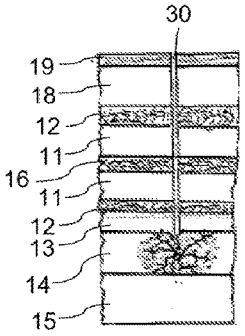
FIG. 30B shows an underground section view of a section of the oil or gas field of FIG. 30A surrounding a production well.

FIG. 30A shows a further embodiment of the present invention in which stabilising columns 320, 330, 340 and 350 can be utilised to reinforce and reduce the possibility of collapse of an oil or gas field 310 or a section of an oil or gas field 310. In this embodiment the stabilising columns 320, 330, 340, 350 provide structural support for the oil or gas field 310. As shown in FIGS. 30A and 30B, the oil or gas field 310 comprises a number of production wells 30 with monitoring wells 20. The subterranean structure below the ground is also shown with a production well 30 and is the same as previously described in relation to FIGS. 26 to 29. As is illustrated in FIGS. 30C-30F, the stabilising columns 320, 330, 340 and 350 have been designed in four distinct shapes, for four separate purposes. While the drilling and construction of each stabilizing column 320, 330, 330 and 340 is the same as previously described, in this embodiment they have been designed to reinforce an area which contains multiple production wells 30. A typical size of the oil or gas field 310 is in the range of 1 square kilometer with anywhere up to 10 production wells 30 located within the oil or gas field 310.

Figure 30C:
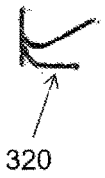
FIG. 30C shows a schematic of a first form stabilising column of the oil or gas field of FIG. 30A.
Figure 30D:
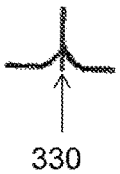
FIG. 30D shows a schematic of a second form stabilizing column of the oil or gas field of FIG. 30A.
Figure 30E:
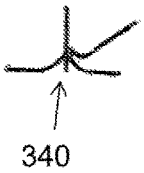
FIG. 30E shows a schematic of a third form stabilizing column of the oil or gas field of FIG. 30A.
Figure 30F:
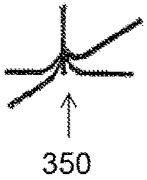
FIG. 30F shows a schematic of a fourth form stabilizing column of the oil or gas field of FIG. 30A.

Referring to FIG. 30C, stabilizing column 320 has been designed to be placed at each corner of the oil or gas field 310. The stabilizing column 320 has a central substantially vertical section which is formed by drilling into the subterranean structure below the ground of the oil or gas field 310 of FIG. 30A. Extending a distance away from the central section and located substantially within the target coal seam/zone 14 is two substantially horizontal arms/sections formed at right angles to each other and extending to form the corner reinforcing element. Referring to FIG. 30D, stabilizing column 330 like column 320 has a central substantially vertical section but with two substantially horizontal arms/sections extending away from the central section and at an angle of approximately 180 degrees apart and located substantially within the target coal seam/zone 14 shown in FIG. 30B. The two substantially horizontal arms extend a distance along the target coal seam/zone 14 to form side elements of the oil or gas field 310 of FIG. 30A. Referring to FIG. 30E, stabilizing column 340 has a central section with three substantially horizontal arms/sections extending away from the central section separated by angles of approximately 90 degrees from each vertical section. As shown in FIG. 30A the stabilizing columns 340 are located at positions along each side and substantially in a line located at the centre of the oil or gas field 310 so that one horizontal arm extends along the line located at around the centre of the field 310 and the other two horizontal arms extend along a side or perimeter of the field 310. Finally, referring to FIG. 30F, the stabilizing column 350 has a substantially vertical section with four substantially horizontal arms extending a distance away from the central section along the target coal seam/zone 14. Each horizontal arm is separated by an angle of approximately 90 degrees. As shown in FIG. 30A, these columns 350 are located along within the oil or gas field, for instance along a central line of the oil or gas field 310, so that the horizontal arms extend along both axes (length and breadth) of the oil or gas filed 310.

The embodiment illustrated in FIG. 30 has been designed to place a perimeter of stabilising columns 320, 330, 340 and 350 around the oil or gas field 310. The design of the columns to extend along the target coal seam/zone 14 substantially encompasses the perimeter of the oil or gas field 310 and reduces the possibility of roof collapse near and around the oil or gas well 30 due to compaction of the gas zone due to the effects of dewatering or gas removal. It will therefore be apparent and appreciated by those skilled in the art that the stabilising columns can take on any one of a number of desired forms and be located in any one or more of the following locations:

a) adjacent to at least one oil or gas well;
b) at a corner of a polygonal shaped figure spaced around and a predetermined distance from the at least one oil or gas well;
c) about a boundary surrounding the oil or gas field; and
d) about a boundary surrounding a section of the oil or gas field.

In the preferred embodiment a plurality of stabilising columns are distributed about and adjacent at least one oil or gas well, a plurality of stabilising columns are distributed about a boundary surrounding the oil or gas field; and/or a plurality of stabilising columns are distributed about a boundary surrounding a section of the oil or gas field enclosing one or more oil or gas wells. During the installation process of the stabilising columns 320, 330, 340, 350 the vertical sections extending long the target coal seam 14 can be fracked to allow the opening up of the target coal seam 14 by proppants. This effectively provides a greater surface area which can be filled with the structural compound, for example reinforced concrete, to further provide stabilisation of the coal or gas seam around the oil or gas field 310. As will be described in further detail below, this embodiment is substantially like inserting an underground bund around the oil or gas field 310 to prevent the possibility of roof collapse. Likewise another effect of the bund is to reduce the flow of coal water from outside of the production oil or gas field from entering, thus reducing the potential for unwanted subsidence outside of the oil or gas field.

One of the reasons for subsidence is reduced fluid pressure within the oil or gas field. Reduced fluid pressure is caused resource extraction in target production zones. Resource extraction lowers fluid pressure in regions adjacent the extraction zone. This creates a pressure differential with fluids external to this region/zone. Such a pressure differential causes fluid to migrate from the relatively higher pressure regions toward the relatively lower regions adjacent the extraction zone. This results in lowering of fluid pressure in the regions external to the extraction zone which promotes subsidence in those regions.

In accordance with another embodiment, the oil or gas well and field integrity system and method include the formation of one or more bund walls formed within a target zone of the at least one subterranean formation. Each bund wall provides support against the effects of fluid migration by maintaining pressure differentials on either side of the bund and/or by maintaining fluid and/or hydrostatic pressure on a side of the bund wall most distal from an adjacent/associated production region within the target zone. In the preferred embodiment, the bund assists in maintaining a relatively higher fluid and/or hydrostatic pressure within an associated target zone at the side of the wall external and/or most distal from the associated production well and/or field. The bund wall may also assist in maintaining a relatively lower fluid and/or hydrostatic pressure at the side internal and/or most proximal to the associated production well and/or field. The bund wall preferably sufficiently surrounds the associated production region, for instance the associated production well(s) and or production field, to thereby increase the effectiveness of the bund wall in maintaining such pressure differentials. In such embodiments, the bund wall assists in maintaining fluid and/or hydrostatic pressure in a region external to the bund wall and associated enclosed oil or gas field, and/or associated enclosed section of the oil or gas field. Furthermore, the ability to assist in maintaining pressure and mitigating fluid migration prevents the flow of contaminants from one region to the other.

Each bund is a region of increased support along the target zone and can be formed by fracturing a region along the target zone and filling that fractured region with a structural compound. In a preferred method, forming each bund wall comprises forming a substantially vertical bore hole extending through the at least one subterranean formation and into the target zone and forming at least one substantially horizontal bore hole extending from at least one of the substantially vertical bore holes within and along the target zone. Then, the target zone is fractured at or about the at least one substantially horizontal bore hole by injecting a fracturing fluid through the at least one substantially vertical bore hole and the at least one substantially horizontal bore hole. The fracturing fluid may be any suitable fluid known in the art or as previously described, including for example water and proppants optionally including nanoparticles. Finally, the at least one horizontal bore hole and the fractured region are filled with a structural compound to thereby form a bund wall along the associated region. The structural compound may include any material and/or additives as previously described for the stabilising columns.

As described above, in some embodiments the bore holes associated with the substantially horizontal sections of one or more of the stabilising columns extending through target zones can be utilised in some embodiments to fracture the target zone and fill the fractured region with a structural compound, thus forming the desired bund wall. Alternatively the bore holes associated with monitoring and/or production wells may also be utilised to form bund walls throughout the target zone and the invention is not intended to be limited to a particular end use of a bore hole used in forming a bund wall. It is also envisaged that alternative methods may be used to form the bund walls.

Each bund extends across at least a portion of the depth of the target zone, but in the preferred embodiment the bund extends across a substantial portion or the entire depth of the target zone to provide maximum support to the desired region. Furthermore, each bund preferably extends along either at least a portion of a perimeter surrounding the oil or gas field or along at least a portion of a section surrounding one or more oil or gas wells within the oil or gas field. In the preferred embodiment however, at least one bund is formed to extend around a substantial portion or the entirety of the perimeter surrounding the designated oil or gas field. This will provide enhanced support for the entire gas field and assist in maintaining hydrostatic pressure in a region external to the bund and the enclosed field to reduce the possibility of fluid migration to/from other fields which could result in subsidence issues. The preferred embodiment also preferably employs at least one bund formed to extend around a substantial portion or the entirety of a section surrounding one or more production wells. This will provide enhanced support to regions directly adjacent production wells by reducing the possibility of fluid migration to/from other external regions but within the same oil or gas field. Each bund wall formed also has the effect of enhancing support by physically strengthening the associated target zone region and providing resistance to compaction forces acting against the associated target zone, including for example down forces and uplifts created as a result of dewatering or de-pressuring, to thereby reduce the possibility of subsidence.

One or more bunds that are open at either end (not enclosed to surround a particular region) may also be formed adjacent production wells and/or at or adjacent predetermined fault zones to reinforce the region and reduce the possibility of collapse near the oil or gas well/fault zone. Such open ended bund walls may be placed intermittently throughout the oil or gas field and in some cases outside of the bund wall extending about the oil or gas field.

Although a preferred method/structure for forming and distributing bunds has been described above, it also envisaged that other methods/structures may be utilised and the invention is not intended to exclude such alternatives as they form part of the scope of the core idea of enhancing support within a target zone by strengthening a region of the zone with a structural compound, to mitigate the effects of subsidence.

The placement of the bund around the oil or gas field or section of the oil or gas field assists in maintaining the hydrostatic pressure of the surrounding coal seams to prevent dewatering and subsequent subsidence due to compaction. As described above one of the most common activities causing subsidence is related to the withdrawal of ground fluids such as geothermal water or ground water. The bund formed around the oil or gas well field can be used to form a vacuum barrier when vacuum stripping is applied to and around the target oil or gas production well.

In conjunction with the bund formed around an oil or gas well field, injection wells may also be placed around the oil or gas field. The injection wells used in oil or gas production utilise steam, carbon dioxide, water, and other substances which extracted from a production zone and inject this into the surrounding oil or gas producing field in order to maintain reservoir pressure, and in the case of an oil field heat the oil or lower its viscosity, allowing it to flow to a producing well nearby. The maintenance of reservoir pressure or hydrostatic pressure of the surrounding oil or gas seam/target zone is important in reducing the effects of subsidence as explained above.

When the surrounding oil or gas fields are commissioned the injection wells can be re-configured and utilised as monitoring wells in an operational oil or gas well field. Monitoring wells have been described in further detail above but are basically used to monitor the underground water in the aquifers for contamination.

While the bunds have been described above as forming a perimeter around an oil or gas field or around a section of an oil or gas field, incomplete bunds or open ended horizontal bund walls can also be utilised within the target oil or gas seam within an oil or gas field. Open ended support bunds can be installed intermittently throughout and within a perimeter bund. Like the perimeter bund an open ended support bund wall is configured using combinations of horizontal and vertical bore holes, for example from the bore holes used to form stabilising columns 320, 330, 340 and 350. The open ended bund walls can extend from a perimeter bund wall or be formed as a stand-alone horizontal bund wall around the perimeter bund. Likewise the open ended bund walls can be intermittently placed throughout the oil or gas field within the bund perimeter or externally of the bund perimeter. The placement of the open ended bund walls like all other stabilising columns is determined through the detailed geophysical, geological and geotechnical characterisation of the site through the various surveys carried out. The open ended bund walls are utilised to reinforce and reduce the possibility of collapse of an oil or gas field or a section of an oil or gas field and to enhance cap rock support to minimise subsidence. The open ended bund walls formed in combination with the placement of stabilising columns and horizontal drilled bore holes when pressure concrete filled provide structural support for the oil or gas field.

Figure 31:
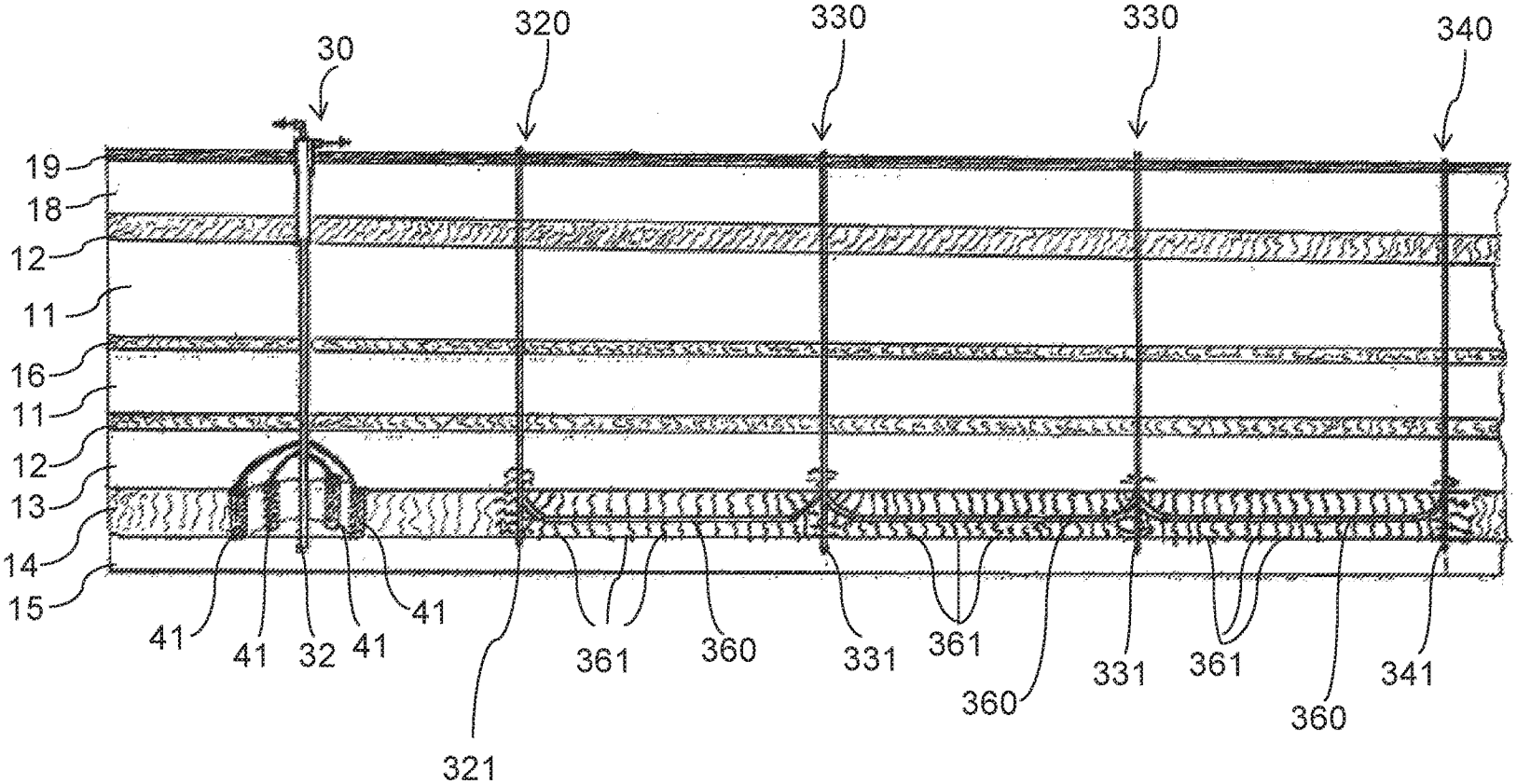
FIG. 31 illustrates a section of the underground structure of the oil or gas field of FIG. 30A.

FIG. 31 illustrates an underground side section of the oil or gas field of FIG. 30A showing a production well 30 and stabilizing columns 320, 330 and 340. As previously described the production well 30 and the stabilizing columns 320, 330 340 are drilled through the different strata formations including a top soil 19, sub soil 18 aquifers 12 and 16 and layers of cap rock 11, 13 and 15 to reach the target coal seam 14. As described above the stabilizing columns 320, 330, 340 are fracked to open up the target coal seam 14 to produce cracks 361. The horizontal arms 360 of the stabilizing columns 320, 330, 340 allow the fracking and the subsequent reinforced concrete which is pumped into the area surrounding a target coal seam 14. Each stabilizing column 320, 330, 340 is underpinned into the respective cap rock 15 as referenced by items 321, 331, 341 and as previously described.

Figure 32:
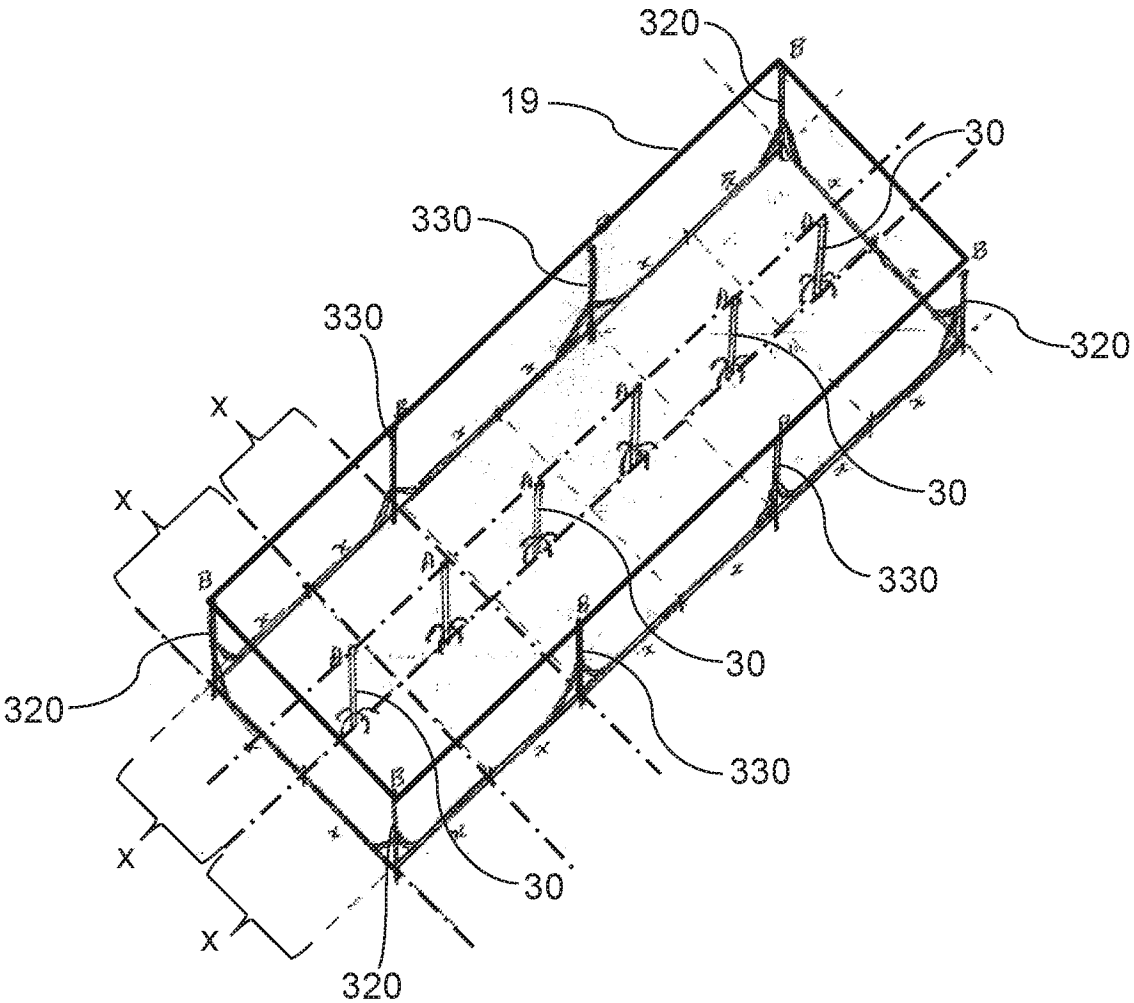
FIG. 32 shows a further example of a section of an oil or gas field with production wells and long wall fracking wells both with stabilising columns in accordance with an embodiment of the present invention.

FIG. 32 further illustrates a three dimensional view of a section of the layout of the oil or gas field 310 described above in FIGS. 30 and 31. By way of example only the dimension x is typically around 300 meters which shows that the long side is approximately 1.8 kilometers in length and the short side is 600 meters wide. A number of production wells 30 with stabilising column legs extend along the centre of the section. Located around the perimeter of the field are stabilising columns 320 (at each corner) and 330 (along each side). The location of the stabilising columns 320 and 330 substantially encloses the field and the boreholes associated therewith have been utilised to form the bund around the production wells 30.

Figure 33:
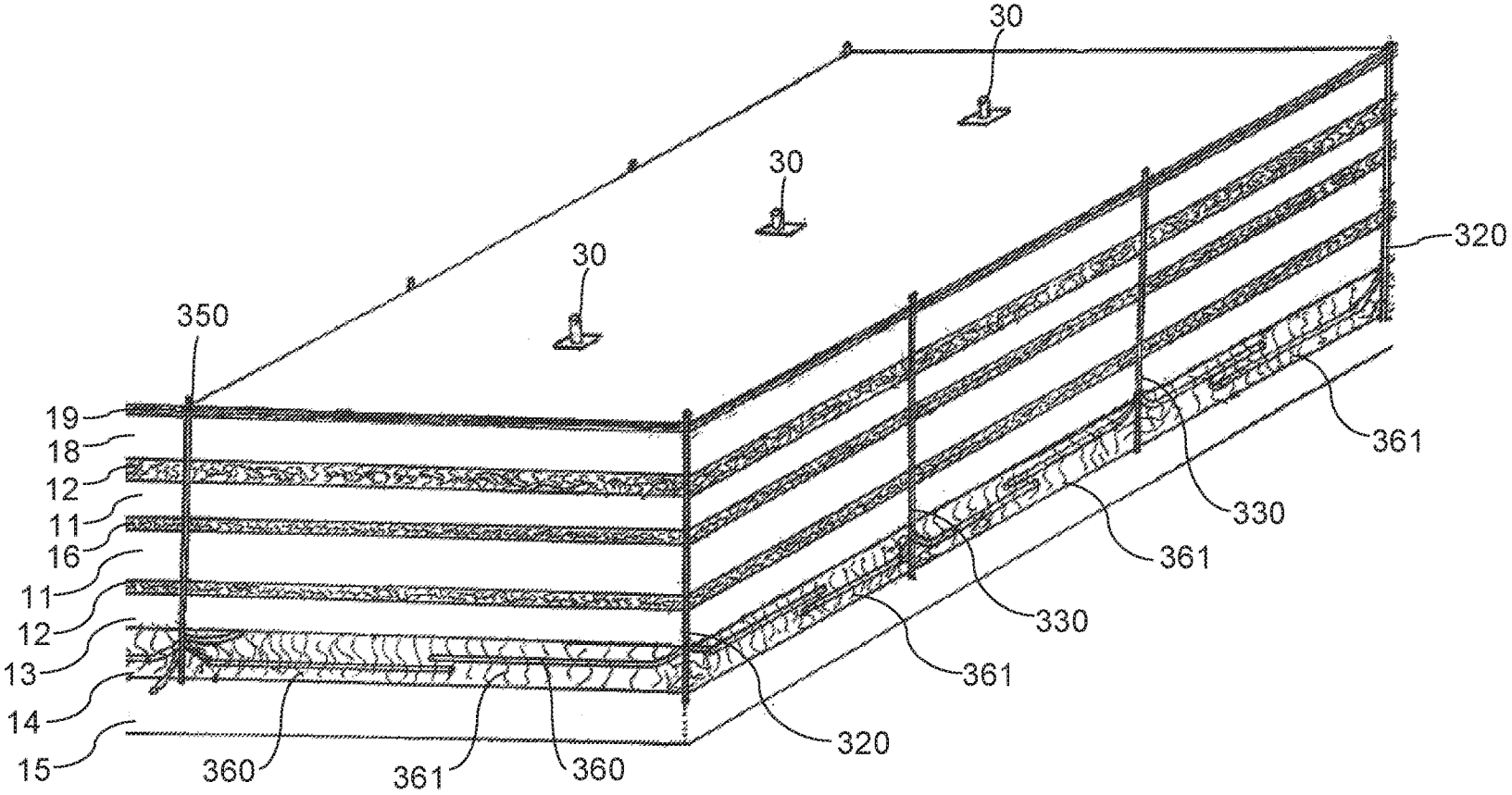
FIG. 33 illustrates a 3 dimensional view of a section of the oil or gas field of FIG. 32.

FIG. 33 shows a further three dimensional section view of an oil or gas field with a number of production wells 30 with stabilising column legs extend along the centre of the section. Located around the perimeter of the field are stabilising columns 320 (at each corner), 330 (along each side) and 350 (at the end). The location of the stabilising columns 320, 330 and 350 substantially encloses the field and the boreholes associated therewith have been utilised to form the bund around the production wells 30. Also illustrated in FIG. 33 are the fracked cracks 361 and the horizontal arms 360 of the stabilising columns 320, 330, 350.

Figure 34A:
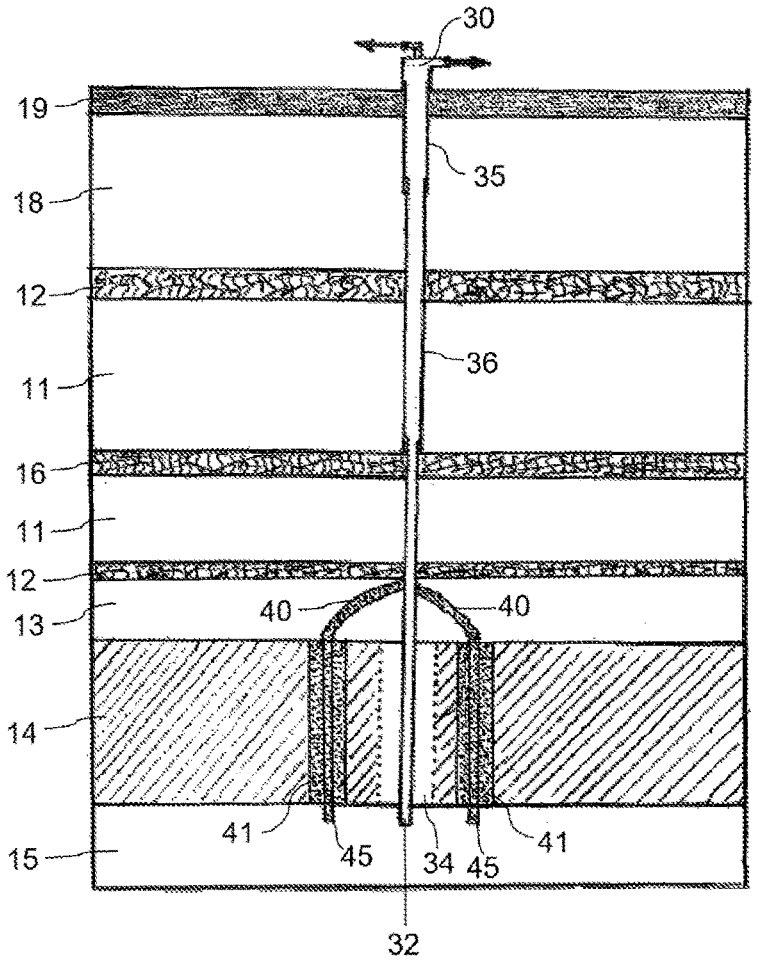
FIG. 34A shows an underground section view and a top plan view of a production well with stabilising stabilizing columns in accordance with an embodiment of the present invention.
Figure 34B:
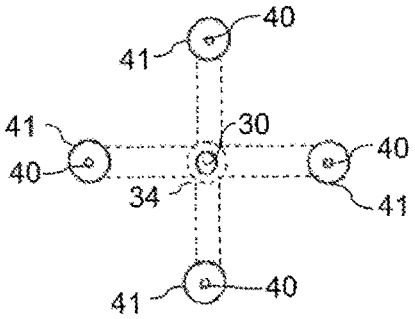
FIG. 34B shows a top view of the production well of the embodiment of FIG. 34A.

FIG. 34A shows an underground section view and FIG. 34B shows a top plan view of a production well 30 with stabilizing columns 40. As described above the stabilizing columns 40 are undercut 41 in the target coal zone or seam 14 and underpinned 45 into the cap rock 15 located below the target coal seam 14. The production well 30 is also undercut in the target coal seam 14 to house the oil or gas chamber 34 and underpinned into the cap rock 15 to house the sump 32.

Target coal seams 14 can vary in depth from between 1 m to 6 m. In the case of the deeper target coal seams 14 additional horizontal piping 360 is inserted into the target coal seam 14 to provide fracking over the substantial depth of the target coal seam 14. This ensures that the bund which is either placed around the perimeter of an oil or gas filed or a section of oil or gas filed substantially encloses the field over the depth of the target oil or coal seam 14.

Figures 35, 36, 37, 38, 39:
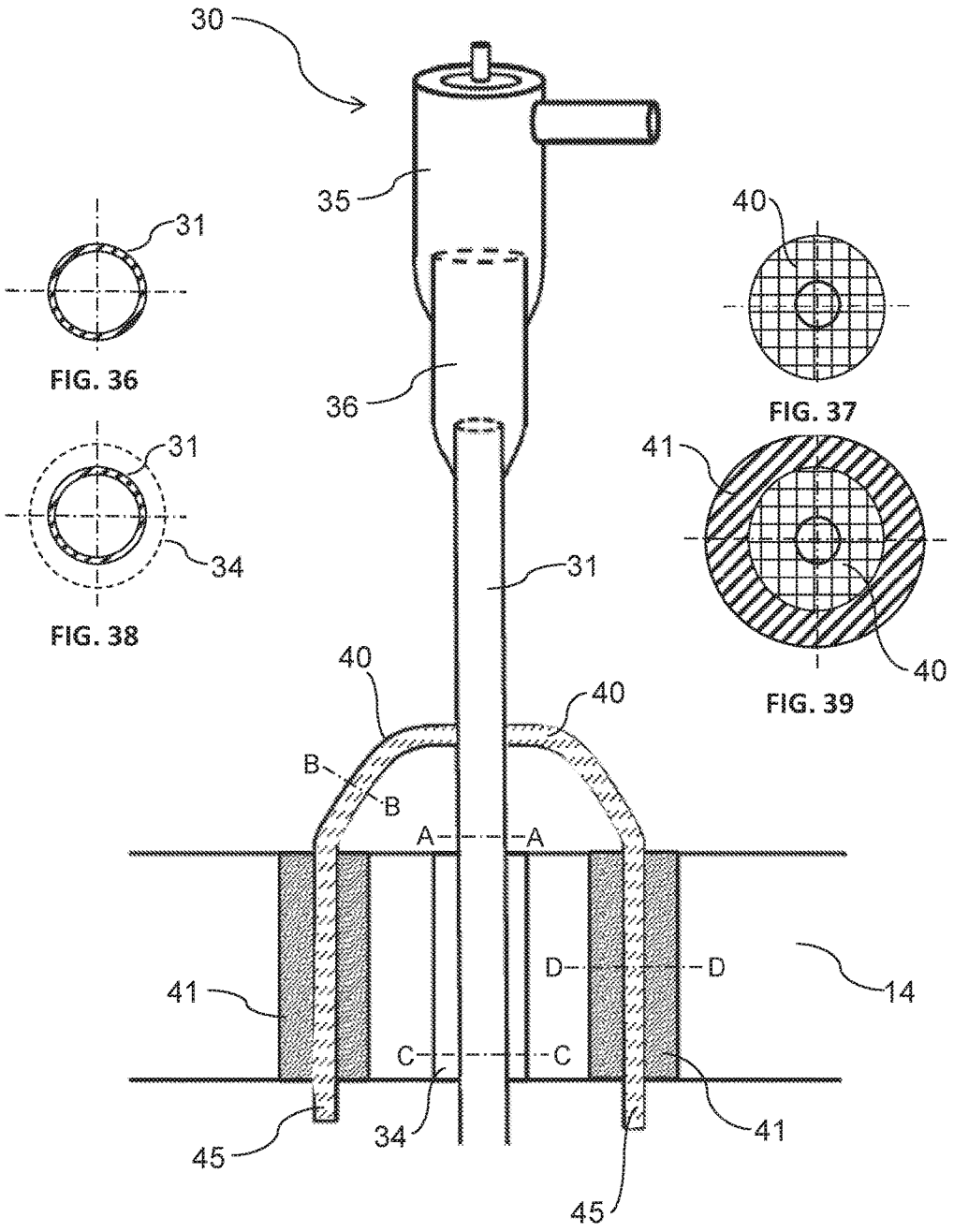
FIG. 35 illustrates in more detail the production well of FIG. 34A.
FIG. 36 shows the sectional view taken along the line A-A of FIG. 35.
FIG. 37 shows the sectional view taken along the line B-B of FIG. 35.
FIG. 38 shows the sectional view taken along the line C-C of FIG. 35.
FIG. 39 shows the sectional view taken along the line D-D of FIG. 35.

FIGS. 35 to 39 show the production well 30 in further detail and also illustrates the different sections along the lines A to D. The different sections also illustrate the different stages involved in the drilling and formation of the productions well 30 and the stabilising columns 40. Stage 1 illustrated in FIG. 36 where the production well is formed to just above the target coal seam 14. FIGS. 37 to 39 are formed using the directional drilling technique described above to drill the stabilising columns 40 to below the target coal seam 14. The stabilising column 40 is undercut 41 in the target coal zone 14 to increase support column diameter and before cementing the stabilising bore is cleaned and pressure fracked with water and proppants which further increases the effective support diameter of the stabilising column 40 and the undercut section 41. The bore is then backfilled with pressurised reinforced Portland cement and strengthening using ferro-strands or cables and/or nano-particles and carbon tubes.

Various systems, devices and/or methods can be readily extracted and understood by the skilled artesian from the above description to aid in protecting the integrity of an oil or gas well and/or an oil or gas production field. Furthermore, the description provides the skilled artesian with an understanding of the design options available to cater the solution to a desired application.

Installation & Operation

As discussed in more detail throughout the description the present invention also extends to a method of protecting the integrity of an oil or gas well and field which passes through at least one subterranean formation containing pressurised formation fluids. As described above, various methods can be readily extracted from the above description depending on the particular application. A particular preferred method comprises the following steps, (however the invention is not intended to be limited to these steps):

(a) Utilising a seismic survey and/or optionally at least one monitoring well on the low side of the oil or gas well, the monitoring well being drilled down into and below a target coal seam zone. Preferably two or more monitoring wells are drilled around the side of the well. The monitoring wells are utilised for testing and developing test points within the monitoring well bore to identify potential pollution contamination. The seismic survey and/or a core sample taken from the monitoring well bores determine the placement of stabilisation columns around the oil or gas well.

(b) Drilling bore holes for the stabilising columns and before cementing locating a calibrated resistance wire within the drilled bore hole. Optionally a high tensile cable can also be added to the stabilising column to further strengthen the column. The stabilising columns bore holes are drilled through the target zone and into the underlying base cap rock of the target gas zone so as to further anchor the stabilising columns.

(i) When the stabilising columns form part of either the monitoring well or production well the same bore hole used for the respective well is also used for the stabilising column, the stabilising columns being constructed at the same time as the respective well. This can include both vertical and horizontal drilling.

(ii) When the stabilising columns are used to reinforce an oil or gas field or section of oil or gas field the horizontal stabilising columns located within the target oil or gas seam form a bund within the target oil or gas seam and therefore form a bund around the target oil or gas seam.

(c) Undercutting the stabilising column bore holes in the target gas zones and aquifer zones to increase the diameter of the bore hole, which will increase the support strength when the support column is filled with reinforced Portland concrete, thus reducing the possibility of roof collapse near the oil or gas well due to compaction of the gas zone due to the effects of dewatering or gas removal.

(d) Cleaning the drilled stabilisation bore holes by flushing with water to remove any contaminated drilling mud and salts from the walls and crevices in the walls of the bore hole. Optionally fracking the drilled bore holes with water and proppants to enhance the column strength by opening up any fractures that radiate out from the drilled diameter of the bore and undercut chamber, thus effectively increasing the final column strength and effective support radius.

(e) Filling the stabilising column bore holes with reinforced Portland cement with nanoparticles and carbon nanotubes for reinforcing the column. Further additional structural strength can be added using fibres comprising steel, titanium or fibreglass and structural flexibility by adding latex additives. Concrete stabilisation of the stabilising columns is achieved by filling the columns from the bottom so as to remove any water accumulated from the opened aquifers by pushing out the water whilst the concrete is poured cumulatively from the base of the bore hole, via the sacrificial polypipe.

(f) Drilling the oil or gas well. Optionally the drilled gas well may further comprise the step of reinforcing the oil or gas well stem with a mixture of reinforced Portland cement with nanoparticles or carbon nanotubes for reinforcement and latex additives for additional flexibility.

Advantages

Maintaining well integrity is much more important in the GAB than anywhere else in the world because failure to maintain well integrity will have dire potential consequences to the GAB aquifers which feed water into the world's largest underground fresh water reservoir. In particular given the expected life span of an oil or gas well can be in excess of 30 years, the economics of the present system provides a financial benefit in less downtime for production and well work-overs. Subsidence is accepted as being a major factor contributing towards well integrity failure. The present invention has been designed to protect the integrity of oil and gas well stems and to mitigate against well bore failure and therefore mitigate against serious pollution of the underground aquifers.

The present system has been developed to protect the whole of the outer casing and inner steel tubing of the well stem from buckling, shearing, bending, cracking or fracturing due to the effects of subsidence, stretching and/or compression which may occur in the area of any point along the well stem. The system serves to reinforce the stability of the area within which the well stem is drilled and thereby reduce the prospect of movement of the well stem due to the effects of subsidence. That is, the system operates to minimise the potential of deformation of the well stem. The system acknowledges that it is not physically possible to prevent subsidence from occurring, but it is feasible to minimise the adverse effects of subsidence and minor earthquakes. Furthermore, the claims of the system are more feasible if fracking is only permitted to be carried out within areas designated, according to prior geophysical investigations, as likely to cause minimum impact upon a well stem. The placement of stabilising columns around the oil or gas field and in between adjacent wellbores has helped to stabilise the subterranean structure of the entire oil or gas field.

The installation of stabilising columns also has the ability to control the degree of compaction of the surrounding aquifers which occurs upon the removal of oil or gas from the field. While subsidence cannot be stopped the degree to which the subsidence effects the surrounding structures both above and below ground can be substantially controlled by the stabilising columns. Furthermore the effect of the stabilising columns is to underpin the various subterranean formations below the Earth's surface. Conversely, the stabilising columns minimise the strata being pulled apart due to the effects of subsidence. By controlling the degree of subsidence we can control the degree of well integrity failure. By installing stabilising columns in locations around an oil or gas well and/or the oil or gas field, the likelihood that surrounding aquifers will be contaminated by methane and the actual loss of gas and oil from wells will be substantially mitigated. By utilising stabilising columns in accordance with the present invention future production oil and gas well sites can be protected from subsidence damage even before the oil or gas well has been drilled.

Forming bunds in and around an oil or gas field or a section of an oil or gas field effectively contains the area of extraction. Likewise when the oil or gas field is decommissioned the oil or gas field can be effectively re-pressurised with water injection. The formation of bunds and/or stabilising columns using methods herein described in a coal seam results in the utilisation of the interface with the coal to increase the support and strength provided by the bund or column to the coal seam zone. This is in contrast to methodologies that burn the coal for example to create the necessary bore holes which leave little to no coal around the interface to assist in increasing support strength.

VARIATIONS

It will be realised that the foregoing has been given by way of illustrative example only and that all other modifications and variations as would be apparent to persons skilled in the art are deemed to fall within the broad scope and ambit of the invention as herein set forth.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the scope of the above described invention.

In the specification the term "fluid" shall be understood to include a substance, as a liquid or gas or a combination of both, that is capable of flowing and that changes its shape at a steady rate when acted upon by a force tending to change its shape. The term "fluid" may also extend to include plasmas and, to some extent, plastic solids.

In the specification the terms fugitive gas and/or liquid, effluent gas and/or liquid, gas and/or liquid are used interchangeably and are taken to mean any gas or liquid from in and around the wellhead which has escaped laterally or in any other direction from the well stem into the subterranean environment.

In the specification an aquifer is an underground layer of water-bearing permeable rock or unconsolidated materials (gravel, sand, or silt) from which groundwater can be extracted using a water well. The study of water flow in aquifers and the characterisation of aquifers is called hydrogeology. Related terms include aquitard, which is a bed of low permeability along an aquifer, and aquiclude (or aquifuge), which is a solid, impermeable area underlying or overlying an aquifer. If the impermeable area overlies the aquifer pressure could cause it to become a confined aquifer.

In the specification the term subsidence is the motion of a surface (usually, the Earth's surface) as it shifts downward relative to a datum such as sea-level.

In the specification a proppant is a solid material, typically treated sand, bauxite or man-made ceramic materials, designed to keep an induced hydraulic fracture open, during or following a fracturing treatment.

In the specification groundwater is the water located beneath the earth's surface in soil pore spaces and in the fractures of rock formations.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The invention claimed is:

1. An oil or gas well and field integrity system which passes through at least one subterranean formation containing pressurized formation fluids, said system comprising:

at least one oil or gas well located within a designated oil or gas field;

at least one substantially vertical bore hole and at least one substantially horizontal bore hole associated therewith and extending through a target zone of the at least one subterranean formation; and at least one bund wall formed within the target zone, each bund wall extending along at least a portion of a perimeter surrounding the oil or gas field or along at least a portion of a section surrounding one or more oil or gas wells of the at least one oil or gas well within the oil or gas field to assist in maintaining hydrostatic pressure on at least one side of the bund wall within the target zone thereby reducing the possibility of subsidence within the oil or gas field, and wherein each bund wall is formed by fracturing the target zone about at least a section of the at least one substantially horizontal bore hole, and fractured regions of the target zone are filled with a structural compound.

2. An oil or gas well and field integrity system as claimed in claim 1 wherein the at least one bund wall is configured to assist in maintaining a relatively higher hydrostatic pressure at a side of the bund wall most distal from the surrounded oil or gas field and/or from the surrounded oil or gas well(s).

3. An oil or gas well and field integrity system as claimed in claim 1 wherein one or more first bund walls of the at least one bund wall extends around the oil or gas field to thereby substantially enclose the oil or gas field along the target zone and assist in maintaining hydrostatic pressure in a region external to the one or more first bund walls and enclosed oil or gas field; and/or wherein one or more second bund walls of the at least one bund wall extends about a section of the oil or gas field to thereby substantially enclose one or more oil or gas wells of the at least one oil or gas well and assist in maintaining hydrostatic pressure in a region of the oil or gas field external to one or more second bund walls and enclosed section of the oil or gas field.

4. An oil or gas well and field integrity system as claimed in claim 1 wherein one or more first bund walls of the at least one bund wall is or are each open at either end and extending adjacent one or more oil or gas wells of the at least one oil or gas well to reinforce and reduce the possibility of collapse of the oil or gas field or a section of the oil or gas field and to enhance cap rock support to minimize subsidence.

5. An oil or gas well and field integrity system as claimed in claim 4 wherein each first open ended bund wall is formed in a location at or adjacent a fault zone of the at least one subterranean formation.

6. An oil or gas well and field integrity system as claimed in claim 4 comprising a second bund wall of the at least one bund wall extending about the perimeter of the oil or gas field and a plurality of first open ended bund walls located intermittently throughout the oil or gas field within and/or outside the-second bund wall extending about the perimeter.

7. An oil or gas well and field integrity system as claimed in claim 1 wherein each bund wall of the at least one bund wall is formed by fracturing the associated substantially vertical bore hole and filling the substantially vertical bore hole and the fractured regions about the substantially vertical bore hole with a structural compound.

8. An oil or gas well and field integrity system as claimed in claim 1 wherein a plurality of substantially vertical bore holes are distributed about at least a portion of a perimeter surrounding the oil or gas field or along at least a portion of a section surrounding one or more oil or gas wells of the at least one oil or gas well, and have extending therebetween one or more substantially horizontal bore holes.

9. An oil or gas well and field integrity system as claimed in claim 1 wherein one or more of the at least one substantially vertical bore hole is filled with a structural compound to form a substantially vertical stabilization column to reinforce the at least one oil or gas well and reduce the possibility of subsidence within and/or around the oil or gas field.

10. An oil or gas well and field integrity system as claimed in claim 1 wherein one or more of the at least one substantially vertical bore holes is utilized to form a monitoring well for monitoring and/or analyzing the state and/or composition of at least one aquifer of the at least one subterranean formation at locations adjacent the monitoring well.

11. An oil or gas well and field integrity system as claimed in claim 1 further comprising at least one injection well located externally of one of the at least one bund wall or on an opposing side to an adjacent oil or gas well of the at least one bund wall, the injection well enabling the injection of fluid into the oil or gas field to aid in maintaining hydrostatic pressure of the associated target zone and thereby assist in preventing dewatering and/or subsidence due to compaction around the oil or gas field.

12. An oil or gas well and field integrity system as claimed in claim 1, wherein the target zone of the at least one subterranean formation is an oil, gas or coal seam.

13. A method of protecting the integrity of a designated oil or gas field comprising at least one oil or gas well which passes through at least one subterranean formation containing pressurized formation fluids, said method comprising the steps of forming at least one bund wall within a target zone of the at least one subterranean formation, each bund wall extending along at least a portion of a perimeter surrounding the oil or gas field or along at least a portion of a section surrounding one or more oil or gas wells of the at least one oil or gas well within the oil or gas field to assist in maintaining hydrostatic pressure on at least one side of the bund wall within the target zone thereby reducing the possibility of subsidence within the oil or gas field and wherein the step of forming the at least one bund wall comprises:

forming at least one substantially vertical bore hole extending through the at least one subterranean formation and into the target zone;

forming at least one substantially horizontal bore hole extending from at least one of the substantially vertical bore holes within and along the target zone;

fracturing the target zone at or about the at least one substantially horizontal bore hole by injecting a fracturing fluid through the at least one substantially vertical bore hole and the at least one substantially horizontal bore hole; and filling the at least one horizontal bore hole and the fractured region with a structural compound to thereby form a bund wall along said region.

14. A method of protecting the integrity of an oil or gas field as claimed in claim 13 wherein the step of forming the at least one bund wall further comprises:

fracturing at or about the at least one substantially vertical bore hole by injecting a fracturing fluid through the at least one substantially vertical bore hole; and filling the at least one substantially vertical bore hole and the fractured region about the at least one substantially vertical bore hole with a structural compound.

15. A method of protecting the integrity of an oil or gas field as claimed in claim 13 wherein the step of fracturing the target zone comprises fracturing the target zone across a substantial or entire portion of a depth of the target zone along the at least one horizontal bore hole.

16. A method of protecting the integrity of an oil or gas field as claimed in claim 13 further comprising the step of filling one or more of the at least one substantially vertical bore holes with a structural compound to form at least one substantially vertical stabilization column within and/or about the oil or gas field.

17. A method of protecting the integrity of an oil or gas field as claimed in claim 13 further comprising the step of forming at least one monitoring well using one or more of the at least one substantially vertical bore holes after fracturing and filling the target zone for monitoring and/or analyzing the state and/or composition of the at least one aquifer of the at least one subterranean formation at locations adjacent the monitoring well.

18. A method of protecting the integrity of an oil or gas field as claimed in claim 13 wherein the step of forming at least one bund wall comprises forming at least one first bund wall extending around the oil or gas field to thereby substantially enclose the oil or gas field along the target zone and assist in maintaining hydrostatic pressure in a region external to the first bund wall and enclosed oil or gas field; and/or comprises forming at least one second bund wall extending about a section of the oil or gas field to thereby substantially enclose one or more oil or gas wells of the at least one oil or gas well within the oil or gas field and assist in maintaining hydrostatic pressure in a region of the oil or gas field external to the second bund wall and enclosed section.

19. A method of protecting the integrity of an oil or gas field as claimed in claim 13 wherein the step of forming at least one bund wall comprises forming at least one bund wall bund wall open at either end and extending adjacent one or more oil or gas wells of the at least one oil or gas well within the oil or gas field to reinforce and reduce the possibility of collapse of the oil or gas field or a section of the oil or gas field and to enhance cap rock support to minimize subsidence, and wherein the at least one open ended bund wall is formed in a location at or adjacent a fault zone of the at least one subterranean formation.

20. A method of protecting the integrity of an oil or gas field as claimed in claim 13 wherein each bund wall assists in maintaining a relatively higher hydrostatic pressure on a side of the bund wall most distal from the associated oil or gas field and/or from the associated oil or gas well(s).

* * * * *